United States Patent [19]

Nagashima et al.

[11] Patent Number: 4,618,246

[45] Date of Patent: Oct. 21, 1986

[54] IMAGE FORMING DEVICE

[75] Inventors: Nao Nagashima, Tokyo; Koji Suzuki, Yokohama; Jyoji Nagahira, Tokyo; Kouki Kuroda, Yokohama; Yoshiaki Takayanagi, Kawasaki, all of Japan

[73] Assignee: Canon Kabushiki Kaisha, Tokyo, Japan

[21] Appl. No.: 795,420

[22] Filed: Nov. 6, 1985

Related U.S. Application Data

[63] Continuation of Ser. No. 661,117, Oct. 15, 1984, Pat. No. 4,573,788, which is a continuation of Ser. No. 284,138, Jul. 16, 1981, abandoned.

[30] Foreign Application Priority Data

Jul. 22, 1980 [JP] Japan ..... 55-100087
Jul. 23, 1980 [JP] Japan ..... 55-101657
Jul. 24, 1980 [JP] Japan ..... 55-101504

[51] Int. Cl.[4] ..... G03G 15/00

[52] U.S. Cl. ..... 355/14 R; 355/3 CH; 355/14 C; 355/14 CH; 355/55

[58] Field of Search ..... 355/3 R, 3 CH, 14 R, 355/14 CH, 14 C, 14 E, 55, 56, 35; 219/216

[56] References Cited

U.S. PATENT DOCUMENTS

| | | | |
|---|---|---|---|
| 4,188,668 | 2/1980 | Finlay | 355/14 R X |
| 4,248,524 | 2/1981 | Takahashi | 355/14 E |
| 4,259,565 | 3/1981 | Ogino et al. | 219/216 |
| 4,261,660 | 4/1981 | Suzuki et al. | 355/14 R |
| 4,305,654 | 12/1981 | Shimizu et al. | 355/14 C |
| 4,335,953 | 6/1982 | Tsuchiya et al. | 355/14 CH |
| 4,350,435 | 9/1982 | Fiske et al. | 355/14 CH X |
| 4,355,885 | 10/1982 | Nagashima | 355/14 CH |
| 4,367,948 | 1/1983 | Suzuki | 355/14 CH X |
| 4,411,514 | 10/1983 | Komori et al. | 355/14 CH |
| 4,420,247 | 12/1983 | Suzuki et al. | 355/14 CH X |

*Primary Examiner*—A. C. Prescott

*Attorney, Agent, or Firm*—Fitzpatrick, Cella, Harper & Scinto

[57] ABSTRACT

An image forming device constracted with an image forming device, a memory device to store therein a plurality of programs for stable control of an image quality, and a device for selecting and executing one of the programs stored in the memory device. The image forming device is further provided with a humidity detection device, a temperature control device, and a control device to effect potential control.

5 Claims, 51 Drawing Figures

IMAGE FORMING DEVICE

This is a continuation of application Ser. No. 661,117, filed Oct. 15, 1984, now U.S. Pat. No. 4,573,788 which in turn is a continuation of Ser. No. 284,138, filed on July 16, 1981 now abandoned.

BACKGROUND OF THE INVENTION

1. Field of the Invention

This invention relates to an image forming device to form an image on an image recording member. More particularly it is concerned with an image forming device, such as, for example, an electrostatic recording device based on the electrophotographic process, having a function of stabilizing the image formed on the image recording member.

2. Description of Prior Arts

An electrostatic recording device to form an electrostatic latent image on a recording member such as a photosensitive member, an insulative member, etc. has already been known. Such known electrostatic recording device will be described hereinbelow by taking a reproduction device based on the electrophotographic process, as an example.

FIG. 2 of the accompanying drawing illustrates how surface potentials on a photosensitive drum corresponding to a bright portion (a portion with more light reflection) and a dark portion (a portion with less light reflection) vary at each processing position in the known reproduction device during the reproduction process. Of these potential variations, required as the final electrostatic latent image is the surface potential at a point Ⓒ in the graphical representation, wherein the surface potentials ⓐ and ⓑ at the dark portion and the bright portion, respectively, vary as shown by ⓐ' and ⓑ' in FIG. 3 when an ambient temperature of the photosensitive drum increases, and they also vary with respect to aging of the photosensitive drum with passage of time as shown by ⓐ' and ⓑ' in FIG. 4 with the consequent inability to obtain an image contrast between the dark portion and the bright portion.

Compensation for variations in such surface potentials is disclosed in British laid-open patent application No. 2039101 which was filed by the same assignee-to-be as the present application.

However, when the photosensitive member in the reproduction device is replaced by other photosensitive member of totally different characteristics, the control programs which have been prepared for the former photosensitive member become useless at all owing to such difference in the characteristics, which necessitates re-arrangement of the control program.

In addition, when an image of a variable magnification is to be obtained by changing a process speed, for example, there occurs such a phenomenon that the image density to the same surface potential becomes low with a high process speed, and it becomes high with a low process speed, provided that developing capability of a developer does not change, or remains constant.

Further, when humidity in the surrounding atmosphere increases, there occur variations in the charge characteristic coefficients $\alpha_1$, $\alpha_2$, $\beta_1$, $\beta_2$ (to be described later) of the photosensitive member with the consequence that the control effect cannot be displayed so remarkably as expected by the control method as disclosed in the abovementioned British specification No. 2039101.

SUMMARY OF THE INVENTION

It is an object of the present invention to provide an image forming device which has successfully removed the abovementioned disadvantages in the conventional device.

It is another object of the present invention to provide an image forming device having a plurality of control programs provided therein for stabilization of the recorded image.

It is still another object of the present invention to provide an image forming device having a plurality of control target values for stabilization of the recorded image.

It is other object of the present invention to provide an image forming device capable of selecting any appropriate control program for the image stabilization depending on humidity in the surrounding atmosphere.

The foregoing objects, other objects, detailed construction, functions, and resulting effects of the image forming device according to the present invention will become more apparent and understandable from the following description of the invention when read in conjunction with the accompanying drawing.

BRIEF DESCRIPTION OF THE DRAWING

FIGS. 6A-1 and 6A2 illustrate a flow-chart of a program stored in CPU2;

FIGS. 6B-1 and 6B-2 illustrate a flow chart of another program stored in CPU2;

FIGS. 6C-1 and 6C-2 illustrate a flow chart of still another program stored in CPU2;

FIGS. 6D-1 and 6D-2 illustrate a flow chart of yet another program stored in the CPU2;

FIGS. 6E-1 and 6E-2 illustrate a flow chart of other program stored in the CPU2;

FIGS. 6F-1 and 6F-2 illustrate a flow chart of still other program stored in the CPU2;

FIGS. 6H-1 and 6H-2 illustrate a flow chart of further program stored in the CPU2;

FIGS. 6I-1 and 6I-2 illustrate a flow chart of still further program stored in the CPU2;

FIGS. 6J-1 and 6J-2 illustrate a flow chart of yet further program stored in the CPU2;

FIGS. 9A-1 and 9A-2 show a flow chart of a program stored in CPU2';

FIGS. 9B-1 to 9B-3 show a flow chart of another program stored in the CPU2';

FIGS. 9C-1 and 9C-2 show a flow chart of still another program stored in CPU2';

FIGS. 9D-1 and 9D-2 show a flow chart of yet another program stored in CPU2'.

DETAILED DESCRIPTION OF PREFERRED EMBODIMENTS

Figure 1A:
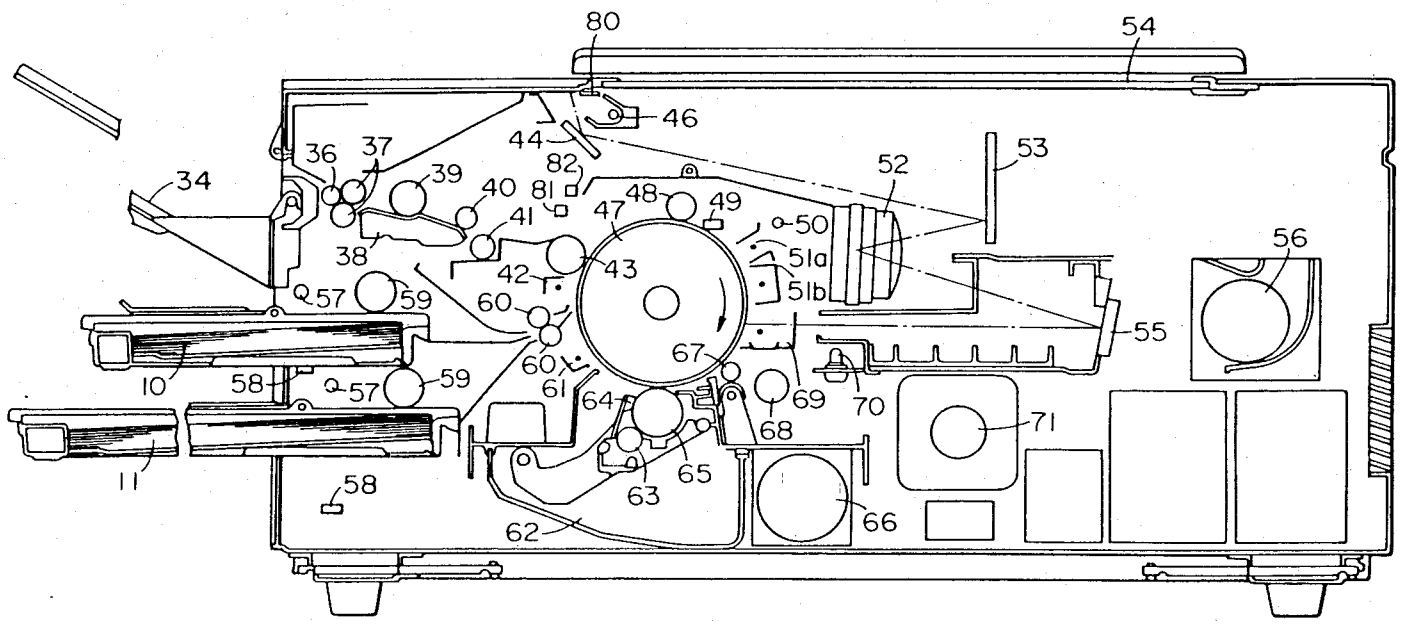
FIG. 1A is a side elevational view, in cross-section, of a reproduction device, to which the concept of the present invention is applicable.

Referring to FIG. 1A, the reproduction device, to which the concept of the present invention is applicable, is provided therein with a photosensitive member 47 in a drum form. The surface of the photosensitive drum 47 consists of a three-layered seamless photosensitive member using CdS photo-conductive material, and is rotatably supported on a shaft so that it may start rotation in an arrow direction by a main motor 71 to be actuated upon depression of a copy key.

Upon a predetermined angular rotation of the photosensitive drum 47, an image original placed on a glass table 54 for mounting thereon the image original is illuminated by an illuminating lamp 46 provided as an integral part of the first scanning mirror 44, and light reflected from the image original is scanned by the first scanning mirror 44 and the second scanning mirror 53. The first scanning mirror 44 and the second scanning mirror 53 move at a speed ratio therebetween of 1:½ so as to enable the image original scanning to be effected, while maintaining the light path length in front of a lens 52 constant.

The reflected light image passes through the lens 52 and the third mirror 55, after which it is focussed on the photosensitive drum 47 in the exposure section.

The photosensitive drum 47 is subjected to simultaneous image exposure and discharge by a pre-exposure lamp 50 and an AC pre-charger respectively, after which it is subjected to corona charging (in the positive polarity (+), for example) by a primary charger 51. Following this, the photosensitive drum 47 is subjected to slit-exposure of the image irradiated by the illuminating lamp 46 at the exposure section.

Simultaneously, corona discharging in AC or in an opposite polarity to that of the primary charging (e.g., negative polarity (−)) is effected by a discharger 69. After this, the entire surface of the photosensitive drum 47 is further subjected to uniform exposure by an overall exposure lamp 18 to thereby form an electrostatic latent image of a high image contrast. The electrostatic latent image on the photosensitive drum 47 is developed with liquid developer on a developing roller 65 of a developing device 62 to be made visible as a toner image. The toner image is made readily transferable by a pre-charger 61 for the image transfer.

Image transfer paper in an upper cassette 10 or a lower cassette 11 is forwarded sheet by sheet into the reproduction device by means of a paper feeding roller 59, and fed onto the photosensitive drum 47 with an accurate feed timing being taken by a pair of register rollers 60, whereby the forward end of the feed paper may be registered with the forward end of the latent image in the image transfer section of the reproduction device.

Subsequently, while the image transfer paper is passing through a space between an image transfer charger 42 and the photosensitive drum 47, the toner image on the photosensitive drum 47 is transferred onto the image transfer paper.

After completion of the image transfer operation, the image transfer paper, on which the image has been transferred, is separated by a separating roller 43 from the photosensitive drum 47, sent to a conveying roller 41 to be led into a space between a hot plate 38 and rollers 40, 39 for image fixation under heat and pressure, and, thereafter, it is discharged out into a paper receiving tray 34 by a pair of paper discharging rollers 37 through a paper detecting roller 36.

After the image transfer, the photosensitive drum 47 continues rotation for cleaning its surface by a cleaning device composed of a cleaning roller 48 and a resilient blade 49, after which it is ready for the subsequent copying cycle.

It should be noted here that a surface potentiometer 67 to measure the surface potential of the photosensitive drum is provided in contiguity to the surface of the photosensitive drum 47 between the overall surface exposure lamp 68 and the developing device 62.

Prior to the abovementioned copying cycle, there is a step of pouring the developing liquid onto the cleaning blade 49 after closure of a power source switch, while the photosensitive drum 47 is in stoppage. (This step will hereinafter be called "pre-wetting" step.) The step is for washing out the toner which has accumulated in the vicinity of the cleaning blade 49, and for lubricating the contact surface between the blade 49 and the drum 47. Following this pre-wetting step, which lasts for four seconds or so, there is another cleaning step for the drum surface by the cleaning roller 48 and the cleaning blade 49 after residual charge and memory on the drum 47 are removed by means of the preexposure lamp 50 and the AC pre-discharger 51*a*, while rotating the drum 47. (The step will hereinafter be called "prerotation INTR".) The step is to optimize sensitivity of the drum 47, and to form an image on its clean surface.

After completion of the copy cycle for a set number of copies, there is a further step of cleaning the drum surface by rotating the drum for several times to remove residual charge and memory on the drum by means of the secondary charger 69, and so forth. (The step will hereinafter be called "post-rotation LSTR".) The step is to clean the drum 47 both electrostatically and physically so that it may be left as cleaned.

Figure 1B:
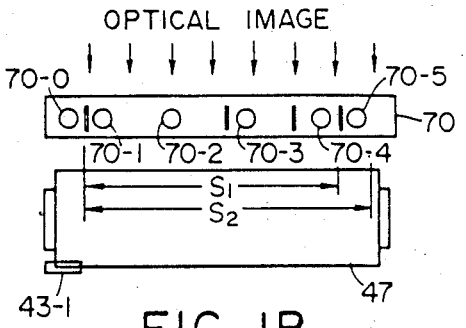
FIG. 1B is a plan view in the neighborhood of a blank exposure lamp.
Figure 2:
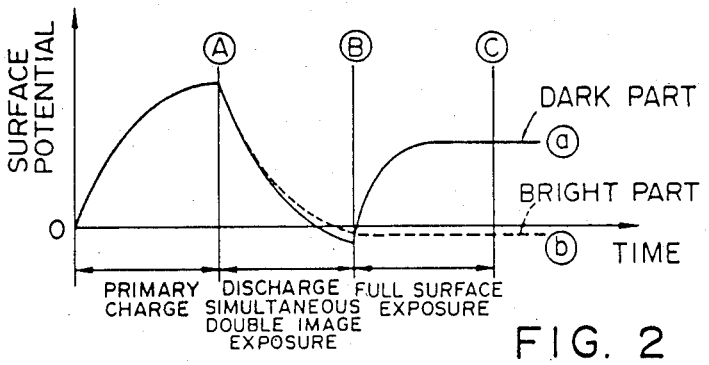
FIG. 2 is a graphical representation showing the characteristics of the surface potentials on every part of the photosensitive drum.
Figure 3:
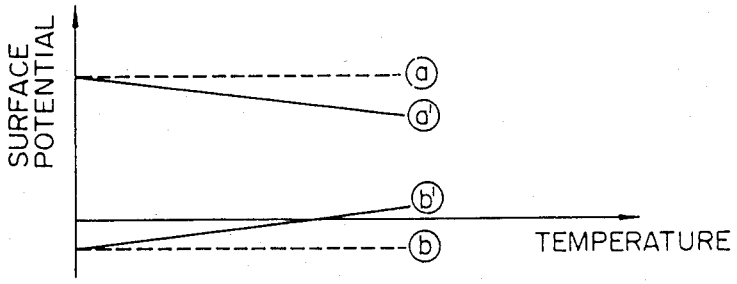
FIGS. 3 and 4 are graphical representations indicating variations in the surface potentials.
Figure 4:
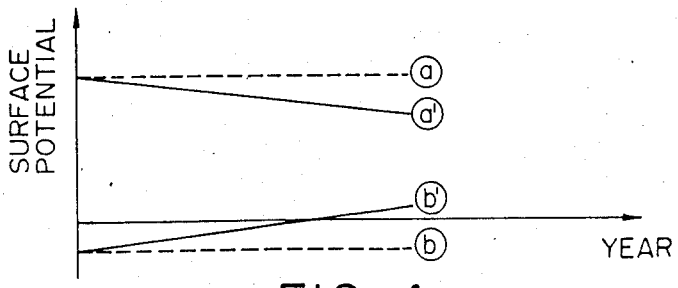

FIG. 1B is a plan view of a neighborhood of a blank exposure lamp 70 shown in FIG. 1A. The blank exposure lamps 70-1 to 70-5 are lit during the drum rotation, except for the exposure operation, to remove electric charge from the drum surface so as to prevent excessive quantity of toner from adhering onto the drum. However, since the blank exposure lamp 70-1 irradiates the drum surface corresponding to the surface potentiometer 67, it is instantaneously extinguished at the time of measuring the dark potential by the potentiometer 67. Further, with a copy sheet in B-4 and B-5 sizes, the image region is narrower than that in A-4 and A-3 sizes, hencethe blank exposure lamp 70-5 is lit to the non-image region, even during advancement of the optical system. The lamp 70-0 is generally called "sharp cut lamp", which is to irradiate light onto a drum portion where it contacts with a separating guide plate 43-1 to completely remove the charge from that portion so as to prevent adhesion of the toner to contaminate a marginal space used for the sheet separation. This sharp cut lamp is constantly lit on during the drum rotation. Incidentally, in FIG. 1A, a reference numeral 81 designates a temperature detector and 82 refers to a humidity detector. In the following, brief explanations will be given as to the surface potential control system to compensate temperature change or surface potential change due to aging of the photosensitive member through passage of time.

In this embodiment, the blank exposure lamp 70 is used for detecting the drum surface potentials at both bright and dark portions, not using the image original illuminating lamp 46 as shown in FIG. 1A. In this instance, the surface potential at a drum surface portion, where light from the blank exposure lamp 70 has been irradiated, is measured as the bright portion surface potential, while the surface potential at a drum surface portion, where no light from the blank exposure lamp has been irradiated, is measured by the potentiometer 67 as the dark portion surface potential. For the potentiometer to be used, reference may be had to the afore-mentioned British specification 2039101.

In the first place, there are established, as the target values, potential values for both bright and dark portions which are sufficient to produce a proper image contrast.

Now assume that the target value of the bright portion potential is $V_{LO}$ and that of the dark portion potential is $V_{DO}$. Also assume that the measured value of the bright portion potential at the n'th times (n=1, 2, 3, . . . ) is $V_{Ln}$ and that of the dark portion potential of the n'th times is $V_{Dn}$. On the basis of these notations, explanations will be given hereinbelow as to the first control program to make the potentials at both bright and dark portions coincident with the abovementioned target values. The first control program operates when no output is produced from the temperature detector 81 and the humidity detector 82. In other words, the first control program is selected when the temperature detector 81 detects no temperature at its predetermined level and above, and the humidity detector 82 detects no humidity at its predetermined level and above.

Further assume that the initial current value of the primary charger is $DC_O$ and the current value in the primary charger at the n'th control is $DC_n$. Assume also that the initial current value of the secondary charger is $AC_O$ the current value in the secondary charger at the n'control is $AC_n$. Based on these assumptions, the current value $DC_n$ of the primary charger at the n'th control and the current value $AC_n$ of the secondary charger at the n'th control are given by the following equations.

$$DC_n=\alpha_1\cdot(V_{Dn}-V_{DO})+\alpha_2\cdot(V_{Ln}-V_{LO})+DC_{n-1} \quad (1)$$

$$AC_n=\beta_1\cdot(V_{DN}-V_{DO})+\beta_2\cdot(V_{Ln}-V_{LO})+AC_{n-1} \quad (2)$$

(where: n=1, 2, 3, . . . )

$$\alpha_1=\frac{\Delta DC(\text{change in primary charger current})}{\Delta V_D(\text{dark potential change})}\ (=\text{constant}) \quad (3)$$

$$\alpha_2=\frac{\Delta DC(\text{change in primary charger current})}{\Delta V_L(\text{bright potential change})}\ (=\text{constant}) \quad (4)$$

$$\beta_1=\frac{\Delta AC(\text{change in secondary charger current})}{\Delta V_D(\text{dark potential change})}\ (=\text{constant}) \quad (5)$$

$$\beta_2=\frac{\Delta AC(\text{change in secondary charger current})}{\Delta V_L(\text{bright potential change})}\ (=\text{constant}) \quad (6)$$

($\alpha_1$, $\alpha_2$, $\beta_1$, and $\beta_2$ are the constant to be determined by the characteristics of the photosensitive drum 47, which differ from drum to drum.)

First of all, the initial values $DC_O$, $AC_O$ are output to the primary charger 51b and the secondary charger 69, respectively. At this instant, the blank exposure lamp 70-1 is turned on and off, during which the bright potential $V_{L1}$ and the dark potential $V_{D1}$ and are measured by the surface potentiometer 67, based on which measurements $DC_1$ and $AC_1$ are calculated from the above equations (1) and (2) for output. In the same manner, $V_{L2}$ and $V_{D2}$ are measured to calculate $DC_2$ and $AC_2$ for output. These operations are repeated to obtain the n'th control values $DC_n$ and $AC_n$.

In the following, outline explanations of the second control program will be given. This second control program operates when the temperature detector 81 or the humidity detector 82 detects that the interior of the device attains a high temperature or high humidity.

Explaining control of the dark potential $V_D$ at first, a reference current DCSA is caused to flow initially through the primary charger 51 to determine whether the surface potential $V_{D1}$ at that portion of the photosensitive member is greater or smaller than the target value $V_{DO}$. When the potential is large, a value obtained by subtracting a parameter P from the initial value of the primary charger current $DC_O$ is fed to the primary charger 51. While gradually decreasing the value of the parameter P, this control is repeated for several times, and the dark potential value gradually approaches the target value $V_{DO}$.

As for the bright potential $V_L$, the same control as that of the dark potential is effected to the current flowing in the secondary charger 69.

As stated in the foregoing, when the sensitivity characteristic of the photosensitive member is known, the number of repeating times for detection and control in the first control program may be small to a certain degree, which is effective. In the case of the second control program, it is possible to converge the surface potential to the target value irrespective of the sensitivity characteristic of the photosensitive member.

In the following, explanations will be given as to the control circuits, with which the present invention is practicable.

Figure 5:
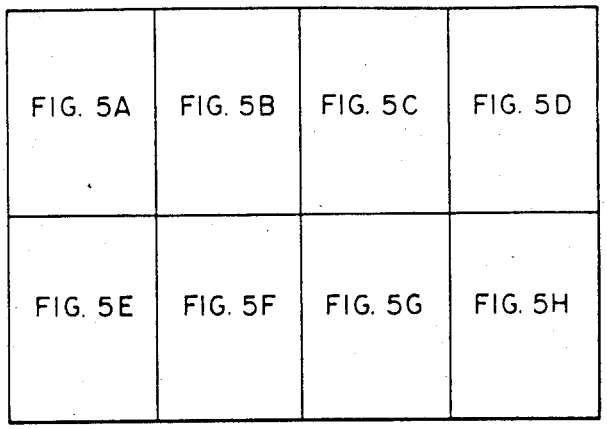
FIG. 5 is a combination scheme of FIGS. 5A through 5H.
Figure 5A:
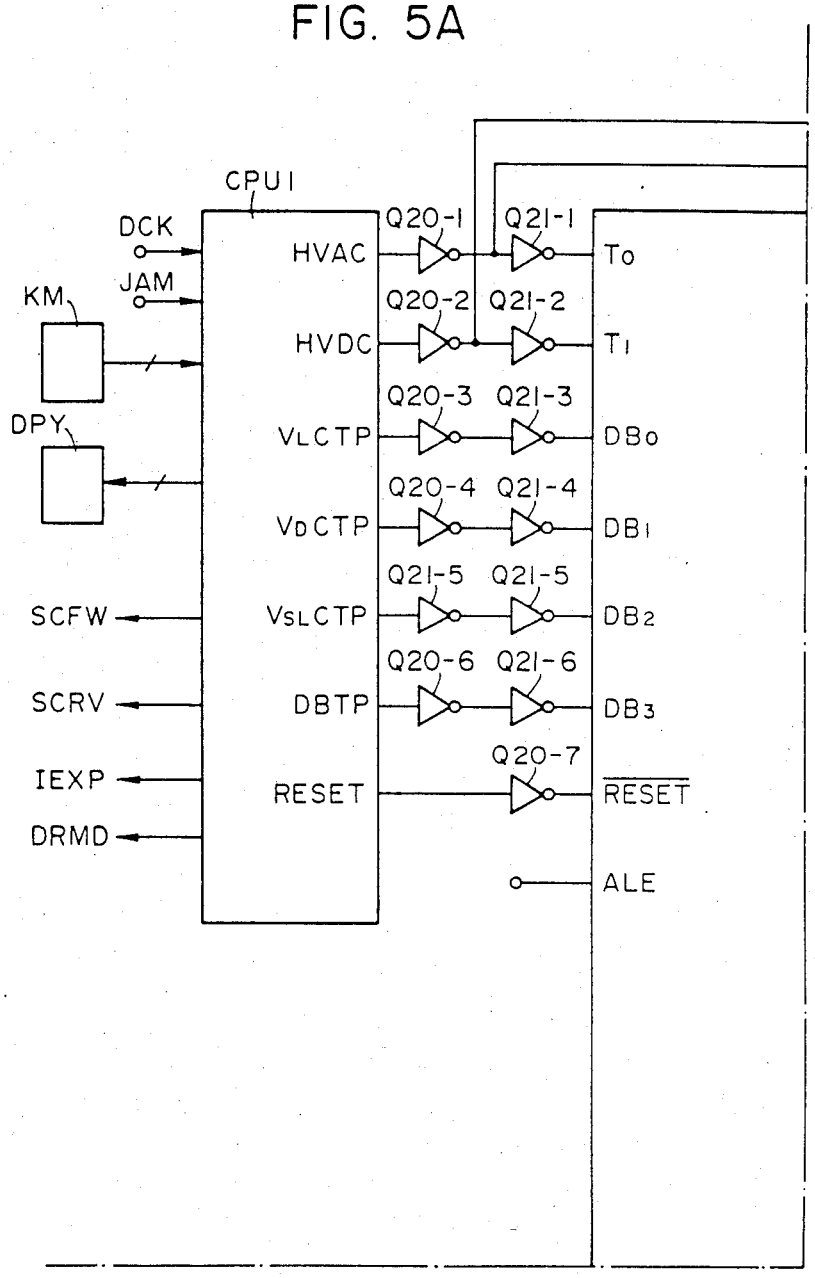
FIGS. 5A–5H show a potential control unit circuit diagram.
Figure 5B:
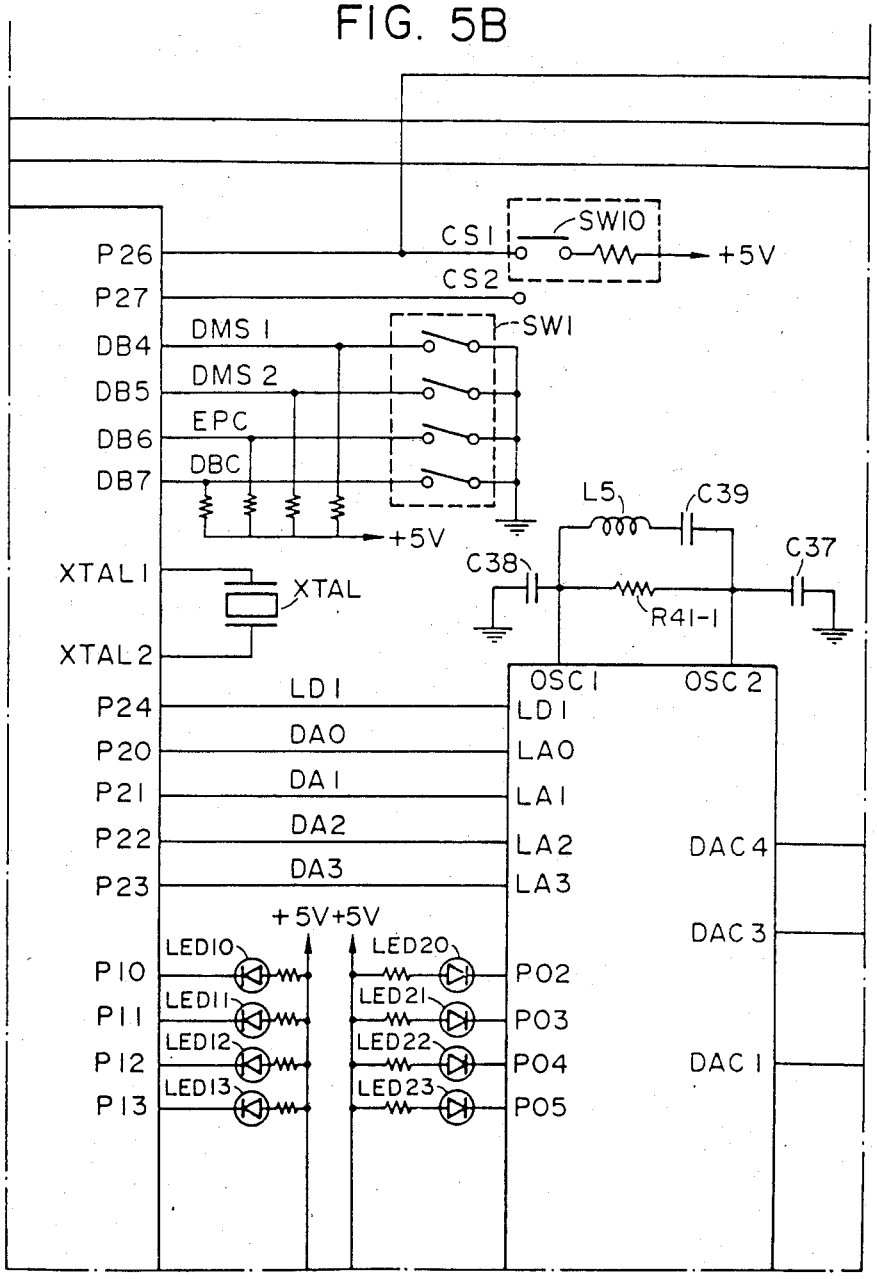
Figure 5C:
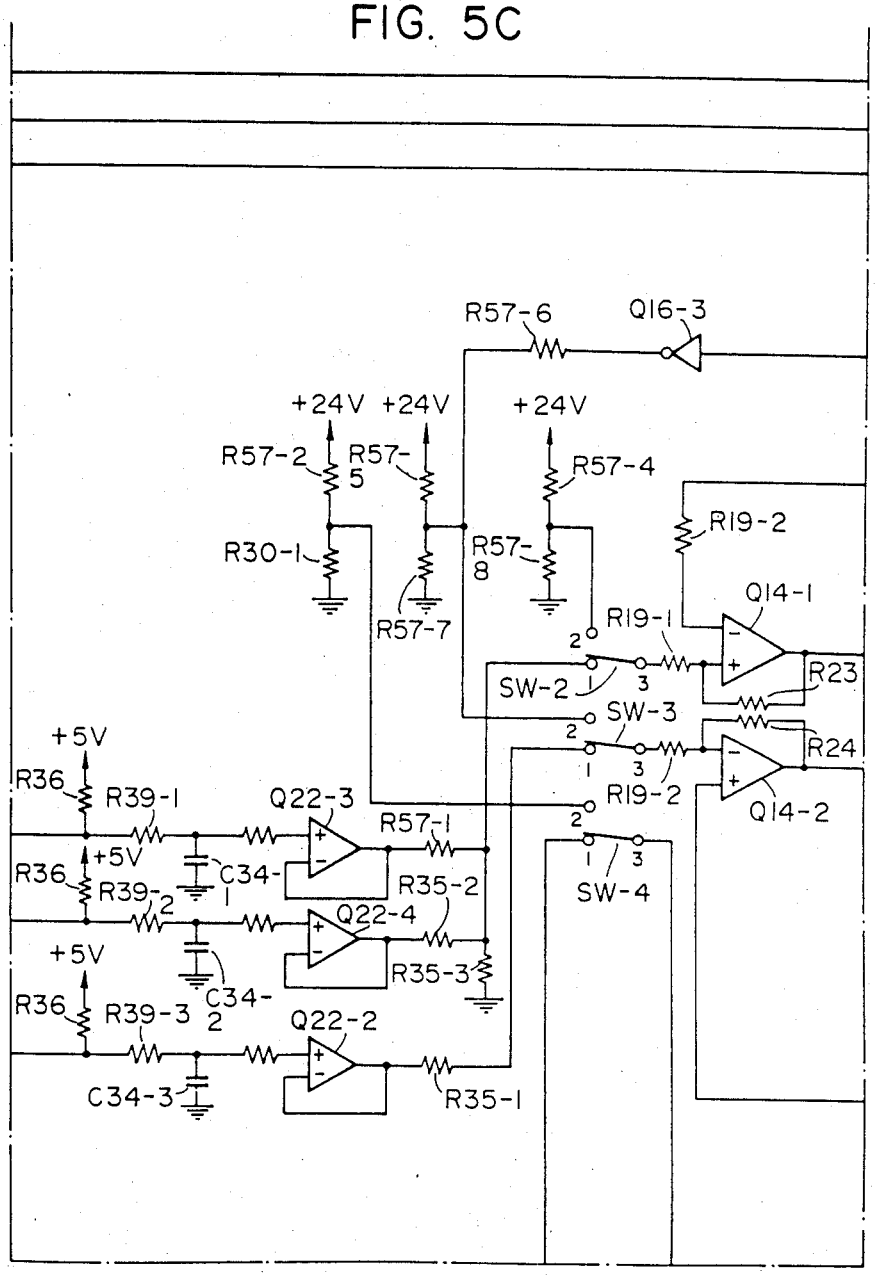
Figure 5D:
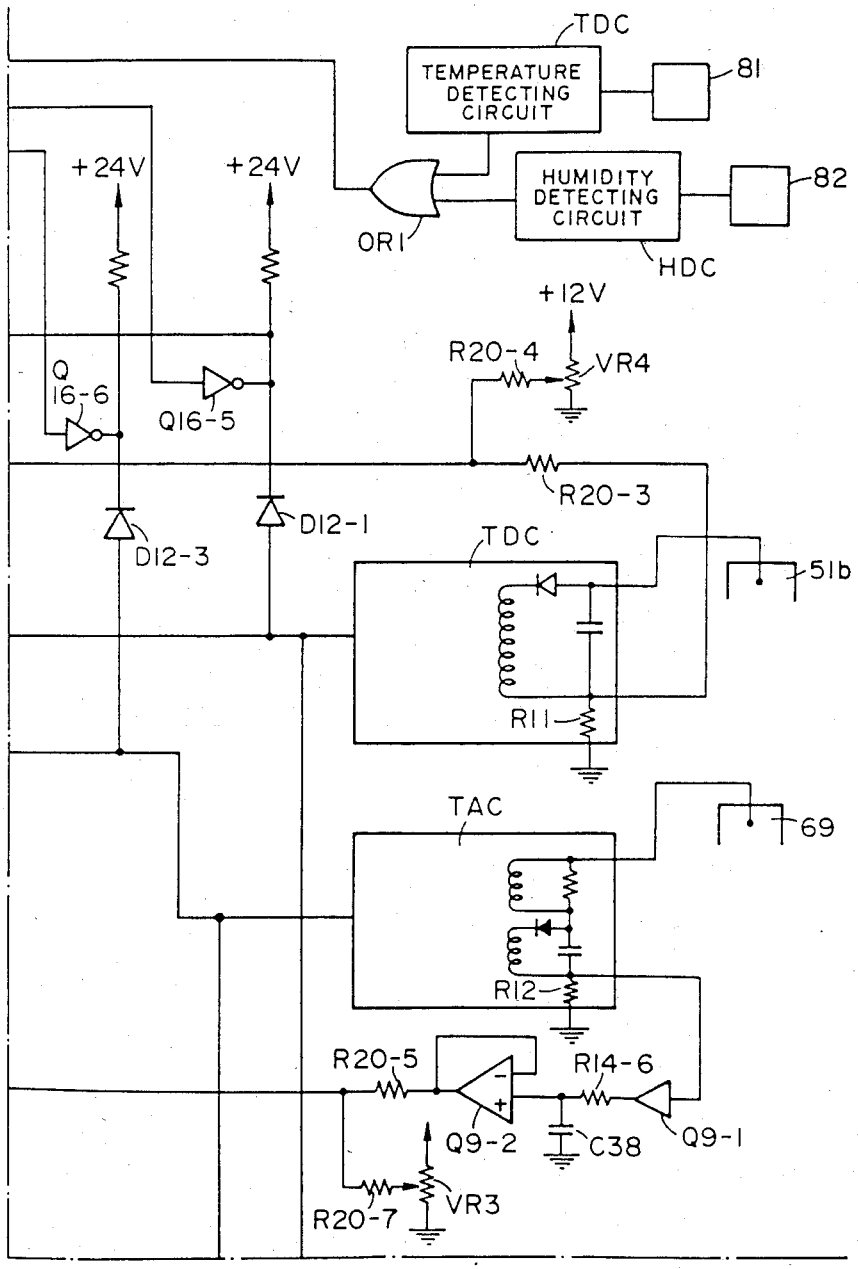
Figure 5E:
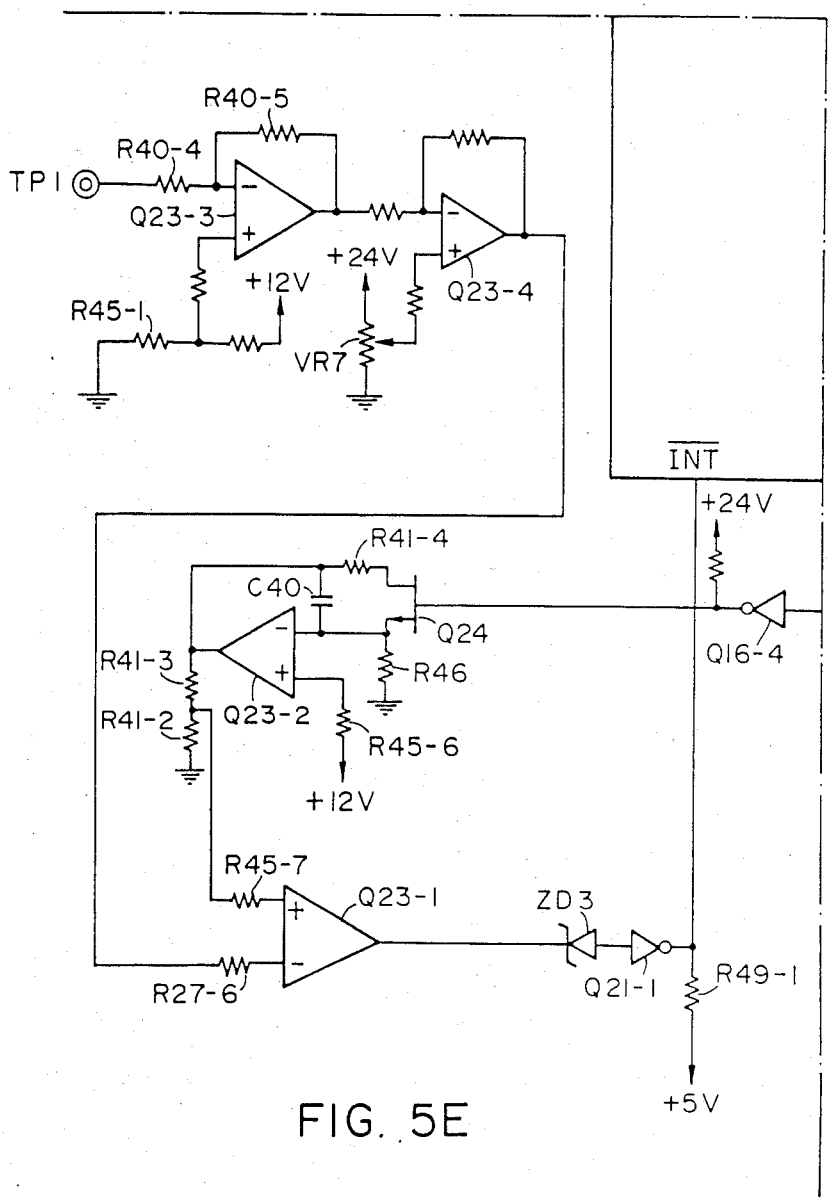
Figure 5F:
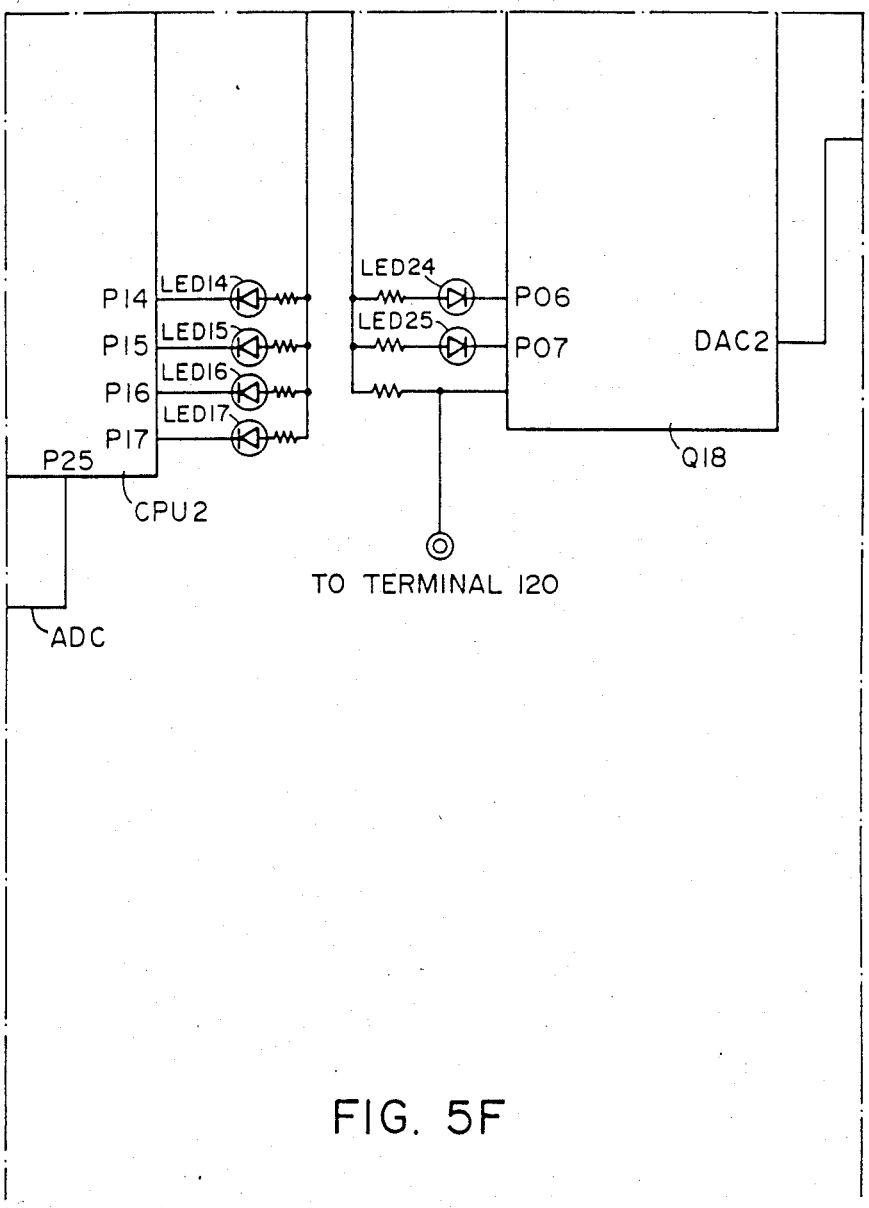
Figure 5G:
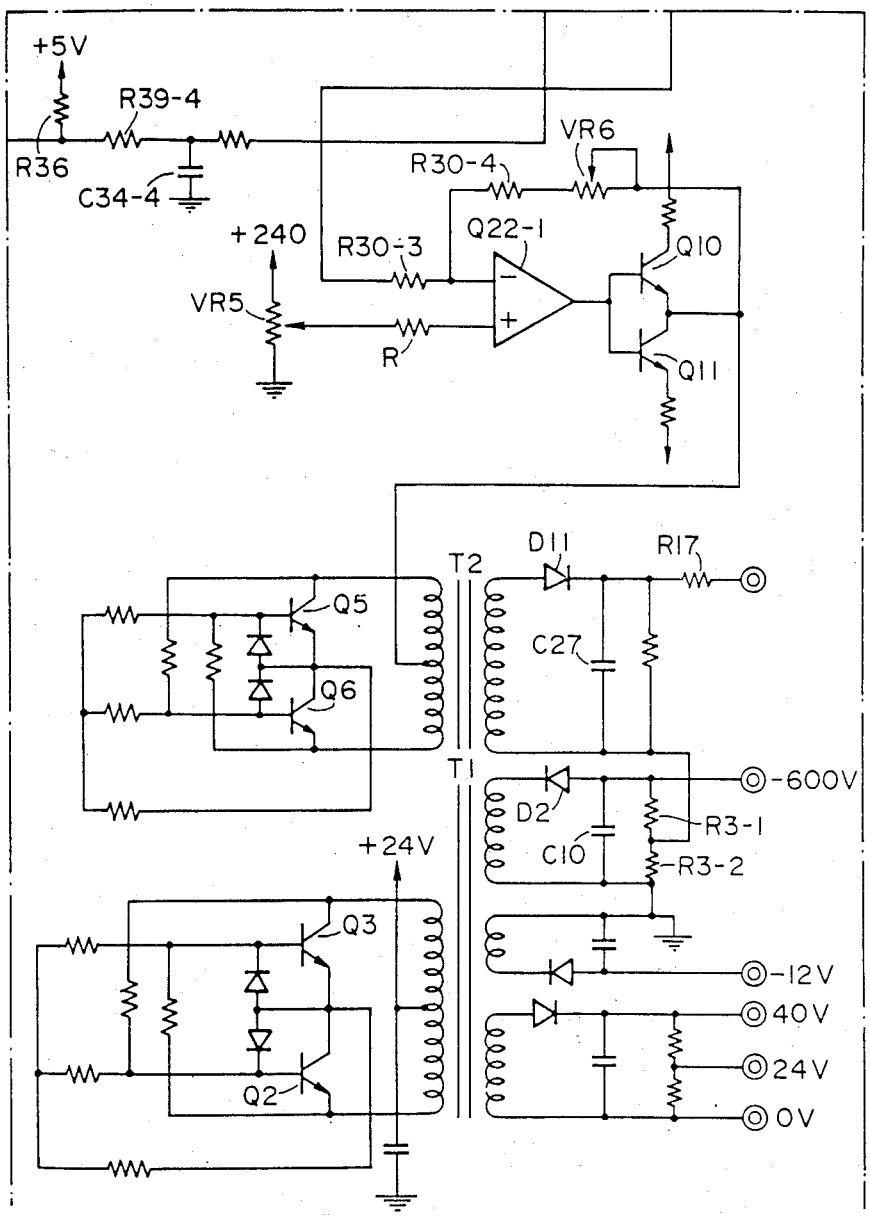
Figure 5H:
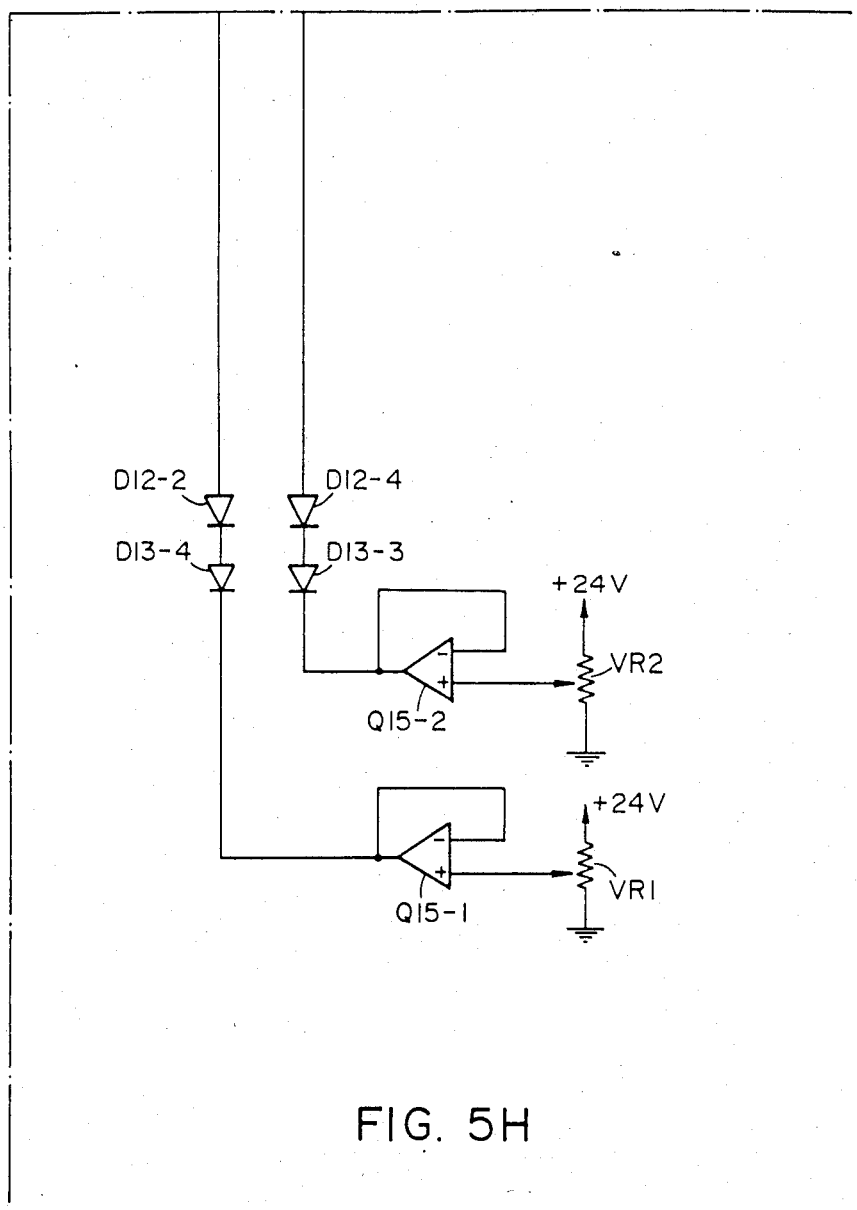

A potential control unit circuit shows in FIG. 5 (composed of fractional figures of 5A through 5H) includes a sequence control micro-computer CPU1 which stores therein a program for producing output signals to drive and control each and every part of the reproduction device. The microcomputer CPU1 produces various output signals such as a drum rotation signal DRMD, an image original table advancing signal SCFW, an image original table return signal SCRV, image original illuminating lamp drive signal IEXP, a primary charger drive signal HVDC, an HC discharger drive signal HVAC, an output signal to a display device DPY, etc. on the basis of input signals such as a drum clock pulse DCK synchronous with rotation of the photosensitive drum 47, a jam detection signal JAM, a signal from a key matrix KM, and others. At the same time, the CPU1 also produces an output signal to control a potential control micro-computer CPU2.

The AC discharger drive signal HVAC, the primary charger drive signal HVDC, a bright potential detecting timing pulse $V_L$CTP, a dark potential detecting timing pulse $V_D$CTP, a reference bright potential detection timing pulse $V_{SL}$CTP, and a developer drive signal DBTP, all being from the sequence control micro-computer CPU1, are respectively fed to input terminals T0, T1 and data buses DB0 to DB3 of the potential control micro-computer CPU2, through inverter buffers Q20, Q21. An initial reset pulse is input into a terminal $\overline{\text{RESET}}$ of the CPU2 through the inverter Q20-7.

With these timing signals, the CPU2 takes thereinto A/D conversion data for the surface potential (to be described later), performs a predetermined operational processing in its interior, and outputs the operational results to the D/A converter as the primary current control value, the secondary current control value, and the developing bias voltage control value. It is also possible, by change-over of a mode change-over switch SW1, to output from the CPU2 a value which causes a reference current to flow in the primary and secondary chargers, and a value corresponding to zero volt for the developing bias, irrespective of the abovementioned control values.

The surface potential as measured by the surface potentiometer is introduced as an input into a terminal TP1. The surface potential is further introduced into a reversible input terminal of an operational amplifier Q23-3 through a resistor R40-4, and is reversed and amplified by a gain to be determined from a ratio between the resistors R40-4 and R40-5. A bias voltage of +6 V which can be divided by the resistors R45-1 and R45-2 is given to an irreversible input terminal of the operational amplifier Q23-3 to effect a level shifting. An output from the operational amplifier Q23-3 is input into a reversible buffer of a gain 1 due to the operational amplifier Q23-4. The measured potential is then subjected to its level adjustment by making a voltage to be applied to the irreversible input of the operational amplifier Q23-4 variable by means of a variable resistor VR7. An output from the operational amplifier Q23-4 is input into an A/D conversion section constructed with the operational amplifiers Q23-1, Q23-2, etc. as a low impedance signal which varies in a range of from 12 V to 17 V in proportion to variations in the surface potential. An A/D command signal ADC from the CPU2 is normally at a level "H", an output from the inverter Q16-4 is at a level "L", the sourcegate of an FET switch Q24 is rendered zero bias, and the source-drain of Q24 is conductive, whereby the output from the operational amplifier Q23-2 is maintained at +12 V.

CPU2 detects trailings of the timing pulses $V_L$CTP, $V_D$CTP, and $V_{SL}$CTP given from CPUl to change the level of the A/D command signal from "H" to "L", and feed the outputs into the inverter Q16-4. At this instant, the output from Q16-4 assumes the level "H", and a reverse bias voltage is applied to the gate of the FET Q24, which is then interrupted. Since a bias voltage of +12 V is imparted to the irreversible input terminal of Q23-2 through the resistor R45-6, there is formed an integration circuit loop with an output from Q23-2, a capacitor C40, and a resistor R46, and an output from Q23-2 linearly charges the capacitor C40 with a current flowing in the resistor R46 until the FET Q24 becomes conductive when the A/D command signal assumes the level "H" with a bias 12 V as the initial voltage. When the FET Q24 becomes conductive, the charge accumulated in the capacitor C40 is discharged through a resistor R41-4, and the output from Q23-2 is rapidly lowers to 12 V. After a certain time lapse from start of the integration by the A/D command signal as mentioned in the foregoing, the CPU2 commences computation in its interior. With a view to agreeing this count start timing with the minimum value 12 V of the output from Q23-4, the output from Q23-2 is subjected to the level shifting by the resistors R41-2, R41-3, and is input into an irreversible input terminal of the operational amplifier Q23-1 constituting a comparator. On the other hand, the abovementioned measured potential is input into the reversible input terminal of the operational amplifier Q23-1 through the resistor R27-6. While an output voltage from the integration circuit is lower than the abovementioned measured potential, the output from the operational amplifier Q23-1 is at a level "L", during which the counting is effected within the microcomputer CPU2. When both voltages become coincident, the output from the operational amplifier Q23-1 assumes the level "H", the level change of which is introduced as an input into an interrupting terminal $\overline{\text{INT}}$ of the microcomputer CPU2 as a count completion pulse through a Zener diode ZD3 and an operational amplifier Q21-2. In the microcomputer CPU2, internal count values upto and including the count completion are processed as the A/D converted values of the abovementioned measured potentials. In this manner, it is possible to A/D-convert the bright potential, dark potential, and reference bright potential in synchronism with the respective timing pulses of $V_L$CTP, $V_D$CTP, and $V_L$CTP.

It should be noted here that, in this embodiment, the micro-computer CPU2 is constructed with NMOS one-chip, eight-bit micro-computer (μPD8048C). Various input and output terminals in this micro-computer CPU2 receive thereinto and give forth therefrom various signals as tabulated hereinbelow.

Input signals indicating that the temperature detecting circuit TDC and the humidity detecting circuit HDC have detected a high temperature and high humidity are introduced into one of its input terminals (P26) through an OR gate OR1. The temperature detecting circuit TDC produces an output only when the temperature detector 81 has detected a high temperature. Similarly, the humidity detecting circuit HDC gives forth an output only when the humidity detector 82 has detected high humidity. Further, it is possible to send out an output signal to the terminal P26 by the switch SW10 irrespective of the levels of temperature and humidity.

TABLE 1

| Terminals | Terminal No. | Input/output | |
|---|---|---|---|
| TO | 1 | input | HVAC |
| XTAL1 | 2 | | clock crystal terminal |
| XTAL2 | 3 | | clock crystal terminal |

TABLE 1-continued

| Terminals | Terminal No. | Input/output | |
|---|---|---|---|
| $\overline{RESET}$ | 4 | " | reset |
| $\overline{SS}$ | 5 | | connected to +5 |
| $\overline{INT}$ | 6 | " | CEP count completion pulse |
| EA | 7 | | connected to GND |
| $\overline{RD}$ | 8 | | not used |
| $\overline{DSEN}$ | 9 | | not used |
| $\overline{WR}$ | 10 | | not used |
| ALE | 11 | output | clock oscillation checking |
| DB0 | 12 | input | $V_L$CTP |
| DB1 | 13 | " | $V_O$CTP |
| DB2 | 14 | " | $V_S$CTP |
| DB3 | 15 | " | DBTP |
| DB4 | 16 | " | DMS1: display mode select 1 |
| DB5 | 17 | " | DMS2: display mode select 2 |
| DB6 | 18 | " | EPC: potential control select (control at zero) |
| DB7 | 19 | " | DBC: developing bias control select (control at zero) |
| Vss | 20 | " | GND: grounding terminal |
| P20 | 21 | output | DA0 } transfer outputs to D/A converter Q18 |
| P21 | 22 | " | DA1 } transfer outputs to D/A converter Q18 |
| P22 | 23 | " | DA2 } transfer outputs to D/A converter Q18 |
| P23 | 24 | " | DA3 } transfer outputs to D/A converter Q18 |
| PROG | 25 | | |
| $V_{DD}$ | 26 | | +5 V power source terminal |
| P10 | 27 | " | high tension secondary current upper limit LED10 } potential display LED (LSB) |
| P11 | 28 | " | High tension secondary current lower limit LED11 } potential display LED |
| P12 | 29 | " | High tension primary current upper limit LED12 } potential display LED |
| P13 | 30 | " | High tension primary current lower limit LED13 } potential display LED |
| P14 | 31 | " | contrast 1 LED14 } potential display LED |
| P15 | 32 | " | contrast 2 LED15 } potential display LED |
| P16 | 33 | " | } display LED16, 17 } potential display LED |
| P17 | 34 | " | } display LED16, 17 } potential display LED (MSB) |
| P24 | 35 | " | LD1 |
| P25 | 36 | " | ADC |
| P26 | 37 | input | CS1 |
| P27 | 38 | " | CS2 |
| T1 | 39 | " | HVDC |
| Vcc | 40 | | +5 power source terminal |

Signals DMS1, DMS2, EPC, and DBC are input into the terminals DB4 to DB7 from the change-over switch SW1. The following Table 2 indicates the control modes of the CPU2 in each signal state.

TABLE 2

| SW1 DMS1 | SW1 DMS1 | SW1 EPC | SW1 DBC | High tension primary and secondary output values | Developing bias Output value | Displayed contents of LED10~LED17 | Mode |
|---|---|---|---|---|---|---|---|
| 0 | 0 | 0 | 0 | control value | control value | contrast limit | normal mode |
| 0 | 0 | 0 | 1 | control value | reference value | contrast limit | " |
| 0 | 0 | 1 | 0 | reference value | control value | contrast | " |
| 0 | 0 | 1 | 1 | reference value | reference value | surface potential | potential display mode |
| 0 | 1 | 0 | 0 | control value | control value | VL potential | potential display mode |
| 0 | 1 | 0 | 1 | control value | reference value | VL potential | potential display mode |
| 0 | 1 | 1 | 0 | reference value | control value | VL potential | potential display mode |
| 0 | 1 | 1 | 1 | reference value | reference value | surface potential | potential measuring mode |
| 1 | 0 | 0 | 0 | control value | control value | VD potential | potential display mode |
| 1 | 0 | 0 | 1 | control value | reference value | VD potential | potential display mode |
| 1 | 0 | 1 | 0 | reference value | control value | VD potential | potential display mode |
| 1 | 0 | 1 | 1 | reference value | reference value | surface potential | potential measuring mode |
| 1 | 1 | 0 | 0 | control value | control value | VL potential | potential display mode |
| 1 | 1 | 0 | 1 | control value | reference value | VL potential | potential display mode |
| 1 | 1 | 1 | 0 | reference value | control value | VL potential | potential display mode |
| 1 | 1 | 1 | 1 | reference value | reference value | surface potential | potential measuring mode |

In the following, explanations will be given as to the D/A conversion section. The CPU2 and the D/A converter Q18 are connected by four data lines DA0 to DA3 and one control line LD1. At the rising of the control line LD1, the CPU2 designates, through the data lines DA0 to DA3, whether the data to be D/A-converted are the primary current control data or the secondary current control data or the developing bias control data. At the trailing of the control line LD1, the data on the data lines DA0 to DA3 sent out of the CPU2 are latched into the D/A converter Q18. The D/A converter Q18 performs the conversion by detecting coincidence between the data latched in its interior and those 4-bit, 6-bit, and 12-bit binary counters to be calculated by the internal clock oscillated by the capacitors C37, C38, C39, the resistor R41-1, and the coil L5. In other words, analog values are obtained by integrating pulses with changing duties resulted in accordance with the data. The converter is so constructed that a 4-bit resolution pulse may be obtained at the D/A output terminals DAC3 and DAC4, a 12-bit resolution pulse at DAC1, and a 6-bit resolution pulse at DAC2. These pulses are converted to analog voltages by the integration circuit constructed with the resistor R39 and the capacitor C34. R36 refers to a pull-up resistor which is added because of these pulse outputs being the open drain.

The primary current control value which has been D/A-converted constitutes voltage values corresponding to higher 4-bit pulse in the DAC4, and to lower 4-bit pulse in the DAC3. These voltage values are added with resistance by the resistors R57-1, R35-2, and R35-1 after passing through the irreversible buffer in the operational amplifiers Q22-3, Q22-4 to constitute a voltage values corresponding to 8-bit pulse, and then sent into the first terminal of the change-over switch SW2.

The secondary current control value is converted to a voltage value corresponding to the 12-bit pulse, is output from the DAC1, and, after passing through the irreversible buffer in the operational amplifier Q22-2, is imparted to the first terminal of the change-over switch SW3.

The developing bias control value is integrated, after which it is imparted to the first terminal of the change-over switch SW4.

The change-over switches SW2, SW3, and SW4 are provided for effecting the potential control by the CPU2, and changing over a circuit to cause a reference current to flow in the charger and bring the developing bias to a predetermined value without intermediary of the CPU2. By changing over of these switches, even when the CPU2 becomes inoperable for some reason or other, the reference current can be flown through the charger, and the developing bias can be brought to a predetermined value.

At the primary side, a voltage which tends to apply a reference current is imparted to the second terminal of the change-over switch SW-2 by a resistance-division in the resistors R57-4 and R57-8. At the secondary side, the inverter Q16-3 is turned on and off by the primary charger drive signal HVDC for changing over AC and weak AC. When HVDC is at the level "H", the output from Q16-3 assumes the level "L", whereby a voltage to be determined by the resistors R57-4, R57-6, and R57-7 is imparted to the second terminal of the change-over switch SW-3. This voltage is so establish that it may apply an AC reference current. Next, when HVDC assumes the level "L" and weak AC is caused to flow, the Q16-3 is turned off to be changed over to a voltage determined by the resistors R57-4 and R57-7, thereby applying the weak AC current. As to the developing bias, a voltage resulted from resistance-division by the resistors R57-2 and R30-1 is imparted to the second terminal of the change-over switch SW-4 as a reference voltage for the developing bias, as is the case with the primary current control value.

As stated in the foregoing, the converter is set at a predetermined value by the change-over switches SW2 to SW4 so that, when the circuit before the D/A converter is in abnormal operation, the high tension charger and the developing bias circuit after the converter may not be affected by such abnormality, and further that the high tension charger and the developing bias circuit may produce a reference current or a reference voltage as output. Accordingly, even when the circuit before the D/A converter is out of order, the image formation can be successfully carried out, and any extreme deterioration in the resulting image quality can be prevented.

The primary charger control voltage VP passes through the terminals 1-3 of the switch SW-2, and is input into the reversible input terminal of the operational amplifier Q14-1 through the resistor R19-1. From the operational amplifier Q14-1, an output is produced in the form of a differential voltage between a voltage $V_{FP}$ to be imparted to the irreversible input terminal of Q14-1 and the abovementioned voltage $V_P$ being multiplied by $$-\frac{R23}{R19-1}.$$

When the primary charger driver signal HVDC is at the level "L", an output from Q20-2 is at "H", and an output from Q16-5 is at "L", whereby the diode D12 is forwardly biased to become conductive, while the output from the operational amplifier Q14-1 is clamped at about 0.6 V, and the primary charger is turned off. When the abovementioned primary charger drive signal HVDC assumes the level "H", the output from the operational amplifier Q14-1 is sent to the primary high tension transformer TDC. The voltage applied to the primary transformer TDC is elevated at its secondary side in accordance with the winding ratio of the transformer, then rectified and smoothed by a diode and a capacitor, and applied to the primary charger 51*b*. The primary corona current $I_P$ flowing in the primary charger 51*b* is detected by the resistor R11, level-shifted by the resistors R20-4, VR-4, and R20-3 in combination, and then input into the irreversible input terminal of Q14-1 through the resistor R19-2, whereby the primary corona current $I_P$ is controlled to make the voltage $V_{FP}$ and the primary charger control voltage $V_P$ coincident.

In the same manner, the AC discharger control voltage $V_{AC}$ is input into the irreversible input terminal of Q14-2 through the resistor R19-4. From Q14-2, an output is produced in the form of a differential voltage between a voltage $V_{FAC}$ to be applied to the irreversible input terminal of Q14-2 and the abovementioned corrective voltage $V_{AC}$ being multiplied by $$-\frac{R24}{R19-4}.$$

When the AC discharger drive signal HVAC is at the level "L", the output from Q20-7 is at the level "H", and the output from the Q16-6 is at the level "L", whereby the diode D12-3 becomes conductive and the output from Q14-2 is clamped at about 0.6 V, and the AC discharger is turned off.

When the AC discharger drive signal HVAC assumes the level "H", the output voltage from Q14-2 is applied to the AC high tension transformer TAC. The voltage which has been elevated at the secondary side of the transformer in accordance with the winding ratio of the transformer is rectified and smoothed by a diode and a capacitor to constitute a direct current output component. The AC high tension transformer TAC also outputs an a.c. high tension voltage to be superposed on the abovementioned d.c. component output for output into the secondary AC charger. AC corona current $I_{AC}$ flowing in the secondary AC charger 69 is detected by the resistor R12. The detected output is amplified by the amplifier Q9-1, integrated by the resistor R14-6 and the capacitor C38, and then buffered by the amplifier Q9-2. Thereafter, the output is subjected to level shifting by the resistors R20-5, R20-7, and VR3 to be input into the irreversible input terminal of the operational amplifier Q14-2 for the control of the AC corona current $I_{AC}$ in such a manner that the voltage $V_{FAC}$ and the secondary AC corrective voltage $V_{AC}$ may become coincident.

As mentioned above, the outputs from the high tension chargers 51*b*, 69 are inhibited by the diodes $D_{12-1}$, $D_{12-2}$. The reason for this is that, since the CPU2 is not initially reset, and the output from the digital computer is instable, the outputs from the high tension chargers, i.e., the primary charger 51*b* and the AC discharger, should be inhibited by the use of the signals HVDC and HVAC, irrespective of the digital computer output, thereby preventing occurrence of a state, wherein high tension corona discharge takes place by the instable control voltage to give mal-effect to the image forming cycle.

The operational amplifier Q15-1 constitute a buffer circuit which produces at its output a value resulted from division of a voltage of 24 V by the variable resistor VR1. The operational amplifier Q14-1 constitutes an inverter, wherein a high tension output current increases when the primary charger control signal $V_P$ lowers. If the primary charger control signal $V_P$ tends to be lower than the minimum value, the output of Q14-1 increases to its maximum value, with the consequence that an input into the primary high tension transformer TDC increases to its maximum value. If the output of the abovementioned operational amplifier Q15-1 is adjusted by the variable resistor VR1 to a value lower by about 1.2 V than the output from Q14-1 which determines this maximum value, the diodes $D_{12-2}$ and $D_{13-4}$ become conductive, and the output from Q14-2 no longer increases beyond its maximum value when the output from Q14-2 tends to be higher than the abovementioned maximum value. Same thing can be said of the limitter at the AC discharger side.

The developing bias control signal applied to the first terminal of SW-4 is input into the operational amplifier Q22-1 from the third terminal of the switch through the resistor R30-3, amplified by a gain to be determined by a ratio among the resistors R30-4, VR6, and R30-3, and applied to an intermediate point of the inverter transformer T2 from the output terminal of the operational amplifier Q22-1 through a current booster constructed with the transistors Q10, Q11. To the irreversible input terminal of Q22-1, there is applied a voltage resulted from division of a voltage of 24 V by the variable resistor VR5. By adjusting the variable resistor VR5, the level of the developing bias can be varied. Also, by adjusting the variable resistor VR6, there can be effected a gain adjustment of the developing bias.

In case no development is being conducted during the drum rotation, the abovementioned bias voltage is so set that it may be at a level of −75 V, thereby preventing the developer from adhering onto the drum surface. During a stand-by period, the device is so set that the above-mentioned bias voltage may be zero volt, thereby preventing the charged liquid developer from becoming stagnant at the drum surface, when the drum is not in rotation.

During the developing operation, the device is so controlled that the developing bias value may be +102 V with respect to a reference bright potential by the developing bias control signal from the D/A converter.

A variable output inverter transformer T2, in which an oscillating output varies by an output from the above-mentioned current booster, and a fixed output inverter transformer T1, when combined, would produce the abovemention developing bias value.

The variable output inverter is a self-excited oscillating inverter composed of transistors Q5, Q6. By the transistors Q5, Q6 repeating the on-off operations alternately, a voltage induced at the primary side of the transformer T2 in accordance with the developing bias control voltage applied to the intermediate point of T2 is elevated to the secondary side voltage to be determined by the winding ratio of T2, and subjected to a semi-wave rectification by D11, followed by smoothing in the capacitor C27, whereby the d.c. high tension output is fed to the developing roller through the resistor R17. On the other hand, the fixed output inverter obtains a negative fixed d.c. high tension voltage by application of a voltage of 24 V to the intermediate point at the primary side of the transformer T1, and by rectification and smoothing of the secondary high tension output in accordance with the transformer winding ratio with the diode D2 and the capacitor C10. A divided voltage from the center of the resistors R3-1 and R3-2 is superposed on an output from the abovementioned variable output inverter, whereby the developing bias voltage linearly varies from the positive to the negative polarity in correspondence to the input control voltage.

In the fixed output inverter T1, there are produced, besides a fixed output for the developing bias voltage, a power source voltage of −12 V, a power source voltage of 24 V to be supplied to the surface potential measuring circuit, a voltage of 40 V as the floating source voltage, and a power source voltage of −600 V to be supplied to the surface potential measuring circuit.

When these circuits are constructed with ordinary regulators and other component parts, there would arise various disadvantages such that more space is required in the device, number of parts constituting the circuits increase and, in particular, the floating power source becomes highly complicated. According to the construction of the present invention, however, various power source voltages as mentioned above can be obtained with extremely good efficiency.

The micro-computer CPU2 stores in its ROM the first and second control programs for effecting the afore-described surface potential control system, the program flow charts of which are illustrated in FIGS. 6A to 6J. In these flow charts, "DC" refers to a digital value for controlling the primary charger, "AC", "DB" refer respectively to control digital values for the AC discharger and the developing bias voltage. "DCSA", "ACSA", and "DBSA" designate RAM areas within the CPU2 for saving the abovementioned digital values DC, AC, and DB.

(Step SP 0)

When the reset signal RESET from the CPU1 is introduced as an input, it clears the entire memory area in RAM to set an input port of CPU2 in an inputtable state, and an output port thereof in an outputtable state. It also initially sets ACSA, DCSA, and DBSA. Further, the reset signal renders the current flowing in the primary charger and the AC discharger to be zero μA, and the developing bias voltage to be zero volt. Then, watching the terminal P26, if the signal CS1 is at the level "1", the first control program from steps SP1 to SP23 is executed, and, if the signal CS1 is at a level "0", the second control program is executed by immediately skipping to the step SP24.

(Step SP 1)

A digital value corresponding to 160 $\mu$A is saved in the area ACSA, a digital value corresponding to 350 $\mu$A in the area DCSA, and a digital value corresponding to zero V in the area DBSA.

(Step SP 2)

Determining whether the AC discharger drive signal HVAC to indicate commencement of the copying operation is at a level "0" or "1", if the level is "0", the program proceeds to the step SP23, and, if "1", it proceeds to the step SP 3.

(Step SP 3)

The ports in the CPU2 are reset to output sensor drive signals. At the same time, LED24 and LED25 are lit to indicate that HVAC and HVDC are at the level "1".

(Step SP 4)

From the signal EPC of the change-over switch SW1, determination is made as to whether a reference value is output to the primary charger and the AC discharger, or a control value from a detected output of the potentiometer is to be output.

(Step SP 5)

Based on the determination made in the previous step SP 4, reference currents or stored values in the areas ACSA, DCSA are output to the primary charger and the AC discharger. The outputs are so made that the developing bias voltage may be −72 V.

(Step SP 6)

While determining the signals HVAC, HVDC, $V_L$CTP, $V_D$CTP, $V_{SL}$CTP, and DBTP, the program proceeds to processing step for each signal. In the display sub-routine, when designation is made for a potential display mode or a potential measuring mode, such potential is displayed with 8-bit pulse in LED's 10 to 17. In the potential measuring mode and the potential display mode, the potential designated by the change-over switch SW1 is transferred to an accumulator in the CPU2, thereby displaying the same on the LED's 10 to 17.

(Step SP 7)

When the bright potential $V_L$ and the detected signal $V_L$CTP are output, the light emitting diode LED20 to indicate the outputs is turned on. At the same time, $V_L$ is measured and the measured result is saved. Thereafter, operation is effected for $(V_L-V_{LO})$ and the resulted operational value is saved. Next, determining the signals CS1, CS2 to be input into the terminals P26, P27 of the CPU2, a coefficient $\alpha_2$ is selected. Subsequently, calculation is done for $\alpha_2(V_L-V_{LO})$, and the result is saved. Similarly, calculation is done for $\beta_2(V_L-V_{LO})$, and the result is saved. Upon completion of the above calculations and savings, the light emitting diode LED 20 is turned off, and the program returns to the STEP SP 4.

(Step SP 8)

When the dark potential $V_D$ and the detection signal $V_D$CTP are output, a light emitting diode LED21 indicating the outputs is turned on, whereupon $V_D$ is measured and the measured result is saved.

(Step SP 9)

Watching the change-over switch SW1 to determine presence or absence of the potential control, if there is no control, the program proceeds to the step SP 17. In case the control is present, the program proceeds to the step SP 10.

(Step SP 10)

Calculation is done for $(V_D-V_{DO})$, $\alpha_1(V_D-V_{DO})$, $\beta_1(V_D-V_{DO})$, and the calculated results of $\alpha_1(V_D-V_{DO})$, $\beta_1(V_D-V_{DO})$ are saved.

(Step SP 11)

Calculation is done for $\alpha_1(V_D-V_{DO})+\alpha_2(V_L-V_{LO})=\Delta DC'$, and the calculated result is added to the previous primary charger control current value DC. At this instant, the primary charger control current value DC is in 8-bit, and $\Delta DC'$ is in 16-bit. Therefore, operation is effected for $(DC\times 8+\Delta DC')$ to obtain a value for the DC' (16-bit).

(Step SP 12)

Determination is made as to whether DC' is within a control range, or not. In case of overflow, the light emitting diode LED12 to indicate the situation is turned on, and DC' is set in a predetermined value. In case of underflow, the light emitting diode LED13 to indicate the situation is turned on, and DC' is set in a predetermined value.

(Step SP 13)

DC' (16 bit) is converted to DC (8 bit) and saved in DCSA.

(Step SP 14)

With a view to finding an AC discharger control current value AC' (16-bit), a calculation is done for $\beta_1(V_D-V_{DO})+\beta_2(V_L-V_{LO})$ to obtain $\Delta AC'$(16-bit). The previous control current value AC is multiplied by 8, and added to the obtained value of $\Delta AC'$.

(Step SP 15)

Determination is made as to whether the value AC' is within a control range, or not. In case of overflow, the LED 10 to indicate the overflow is turned on, and AC' is set in a predetermined value. In case of the underflow, the LED11 is turned on, and the value AC' is set in a predetermined value.

(Step SP 16)

AC' (16 bits) is converted to AC (8 bits), and saved in ACSA.

(Step SP 17)

A difference between the dark potential $V_D$ and the bright potential $V_L$, i.e., a contrast CNT is found. When the contrast CNT is below zero volt, or below 396 volts, LED14 and LED15 are both turned on. When the contrast CNT is above 396 volts and below 498, the LED14 alone is turned on. When the contrast CNT is above 498 volts, none of these LED's are lit. Upon completion of this step, the LED21 is turned off.

(Step SP 18)

When the reference bright potential detection signal $V_{SL}$CTP is output, the light emitting diode LED22 is lit, and the value $V_{SL}$ is measured, and a result is saved. Determining whether $V_{SL}$ is within a controllable range, or not, if $V_{SL}$ is below −474 volts and above 288 volts, the developing bias voltage DB is set in respective predetermined values, and saved in the area DBSA. When the value $V_{SL}$ is within the controllable range, calculation is made for ($V_{SL}$+120 V), and the result is saved in DBSA. Upon completion of the abovementioned step, the light emitting diode LED22 is extinguished.

(Step SP 19)

When the developing operation starts, the developing bias signal DBTP is output from the CPU1, and the light emitting diode LED23 is lit. While watching the signal DBC from the change-over switch SW1, determination is made as to presence or absence of the developing bias control. In case of no control, the developing bias voltage is rendered zero volt. In case of the control being done, the developing bias voltage DB obtained at the step SP 18 is output. Thereafter, the display sub-routine is executed until the signal DBTP assumes the level "0". When the level "0" is attained, the light emitting diode LED23 is turned on.

(Step SP 20)

When HVAC is at the level "1", and HVDC is at the level "0", the photosensitive drum is in the post-rotation LSTR. Therefore, the LED25 to indicate that HVDC is at the level "1" is extinguished, and weak AC current (60 μA) is caused to flow in the AC discharger, while no current is caused to flow in the primary charger.

(Step SP 21)

Determination is made as to whether the potential measuring mode is designated, or not in the display sub-routine. When not in the potential measuring mode, the potential sensor is turned off, and the display subroutine is repeated until the post-rotation LSTR is completed. If the HVDC assumes the level "1" during the post-rotation, the program returns to the step SP 3.

(Step SP 22)

When HVAC assumes the level "0", the LED24 is extinguished, since no copying operation is being performed, and the outputs from both primary charger and the AC discharger are cut off to render the developing bias voltage to be zero bolt.

(Step SP 23)

Determination is made as to whether the display sub-routine is in the potential measuring mode, or not. In case of the potential measuring mode, the potential sensor is driven, and the measured value is displayed in LED10 to LED17.

In the following, explanations will be given as to the second control program.

(Step SP 24)

A parameter (1 0 0 0 0 0 0 0) is first set in the address P. Simultaneously, control number of times N is set. In this case, if the parameter is set for seven and half times, it will become finally (0 0 0 0 0 0 0 1), hence N is set in "7". Also, the primary charger current and the AC discharger current are respectively set in their intermediate values or 400 μA and 200 μA. Further, the developing bias voltage is set in zero volt.

(Steps SP 25 to SP 29)

They are identical with the steps SP 2–SP 6 in the first control program.

(Step SP 30)

When $V_L$CTP is output, the LED20 is turned on, the bright potential is measured, and the measured result is saved.

(Step SP 31)

Presence or absence of the potential control is detected. If the control is present, the program proceeds to the step SP 32. If no control is present, the LED20 is extinguished at the step SP 33.

(Step SP 32)

The address P which was set in the step SP 24 is shifted to the right. Since the address P is at "80", it can be expressed by binary-coded decimal notations, as follows.

$$\begin{array}{cccccccc} 1 & 0 & 0 & 0 & 0 & 0 & 0 & 0 \\ & & & & \downarrow & & & \\ 0 & 1 & 0 & 0 & 0 & 0 & 0 & 0 \end{array}$$

(Step SP 33)

Since the bright potential is largely affected by the AC discharger output, the AC charger current control is effected with the bright potential $V_L$. The bright potential $V_L$ is compared with the control target value $V_{LO}$. As the result of the comparison, if $V_L > V_{LO}$, [AC+P→AC] is performed, and, if $V_L < V_{LO}$, [AC−P→AC] is performed. When $V_L = V_{LO}$, no change occurs in the value AC. Thereafter, the value AC is saved in the area ACSA, and the LED20 is turned off.

(Step SP 34)

When the dark potential detection signal $V_D$CTP is output, the LED21 is lit, and the dark potential $V_D$ is detected simultaneously, and saved in DCSA.

(Step SP 35)

If the potential control is present, the program proceeds to the step SP 36. If no control is present, the program proceeds to the SP 37.

(Step SP 36)

Since the dark potential $V_D$ is largely affected by the primary charger output, the primary charger current control is performed with the dark potential $V_D$. The dark potential $V_D$ is compared with the control target value $V_{DO}$. As the result of comparison, if $V_D > V_{DO}$, [DC−P→AC] is performed, and, if $V_D < V_{DO}$, [DC+P→DC] is performed, and the output value DC is changed. When $V_C = V_{DO}$, the value $V_D$ is not changed.

(Step SP 37)

The controls of both bright and dark potentials being once completed, 1 is subtracted from the control number of times N. Then, steps SP 24 to SP 36 are repeated until the control number of times N becomes zero, when the parameter P is shifted to the right at the step SP 2.

(Step SP 38)

In this step, a difference between the measured values of $V_D$ and $V_L$, i.e., contrast, is found out. When the contrast is below a predetermined value, LED20 is turned on, and LED21 is turned off. The values of the address P can be expressed by binary codes as follows.

| | |
|---|---|
| N = 7 | 0 1 0 0 0 0 0 0 |
| N = 6 | 0 0 1 0 0 0 0 0 |
| N = 5 | 0 0 0 1 0 0 0 0 |
| N = 4 | 0 0 0 0 1 0 0 0 |
| N = 3 | 0 0 0 0 0 1 0 0 |
| N = 2 | 0 0 0 0 0 0 1 0 |
| N = 1 | 0 0 0 0 0 0 0 1 |

Since the address P is added to, or subtracted from, the values DC and AC by the abovementioned operations, the value of AC (hexadecimal) can be taken at an interval of 1-bit between "00" to "FF".

(Steps SP 39 to SP 44)

These steps are identical with those in the steps SP 18 to SP 23.

That characteristics of the control by the afore-described second control program is that a quantity to be varied on the basis of measurement of the bright potential $V_L$ can be well converged, in spite of the AC discharger current alone being used, by addition to the subsequently measured dark potential $V_D$ of an influence to the variations in a.c. current. Needless to say, influence of the bright potential to the variations in the primary charger current is also added.

Further, since the operations required for the controls consist of shifting, comparison, addition, and subtraction, the programming of the micro-computer becomes very simple. Furthermore, even when the electric charge characteristic coefficient of the photosensitive member varies at a high temperature or humidity condition, there remain unchanged simple increase in the dark potential with increased primary charger current and simple decrease in the bright potential with increased AC discharger current, hence these potentials can always be controlled to the values close to the target values.

As stated in the foregoing, since the present invention is capable of the surface potential control without being affected by the charge characteristic of the recording member, it can provide the effective control under the high humidity condition, in particular. Also, by closure of the switch SW10, the second control program can be selected irrespective of the high temperature or high humidity conditions. This makes it possible to secure constantly stabilized potential control even at the time of exchanging a recording member for another whose photosensitive characteristics are unknown, which is therefore very effective.

In the following, the second embodiment of the present invention will be explained.

Figure 6A:
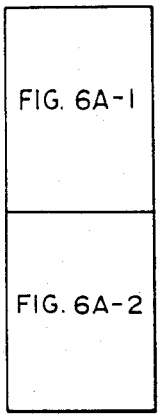
FIG. 6A is a combination scheme of FIGS. 6A-1 and 6A-2.
Figure 6B:
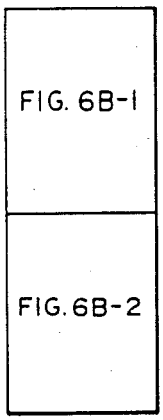
FIG. 6B is a combination scheme of FIGS. 6B-1 and 6B-2.
Figure 6C:
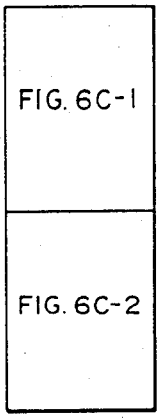
FIG. 6C is a combination scheme of FIGS. 6C-1 and 6C-2.
Figure 6D:
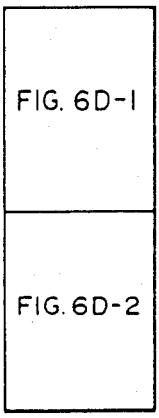
FIG. 6D is a combination scheme of FIGS. 6D-1 and 6D-2.
Figure 6E:
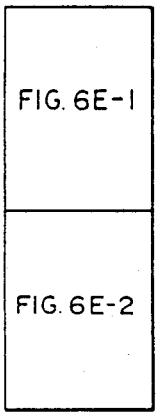
FIG. 6E is a combination scheme of FIGS. 6E-1 and 6E-2.
Figure 6F:
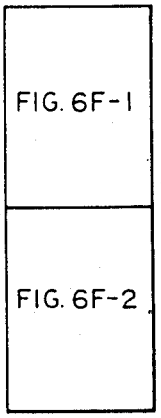
FIG. 6F is a combination scheme of FIGS. 6F-1 and 6F-2.
Figure 6H:
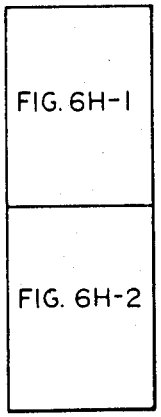
FIG. 6H is a combination scheme of FIGS. 6H-1 and 6H-2.
Figure 6I:
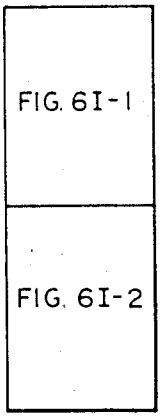
FIG. 6I is a combination scheme of FIGS. 6I-1 and 6I-2.
Figure 6J:
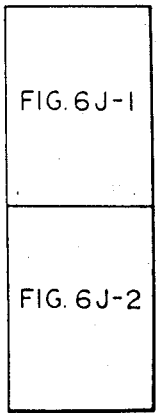
FIG. 6J is a combination scheme of FIGS. 6J-1 and 6J-2.
Figures 1, 6A:
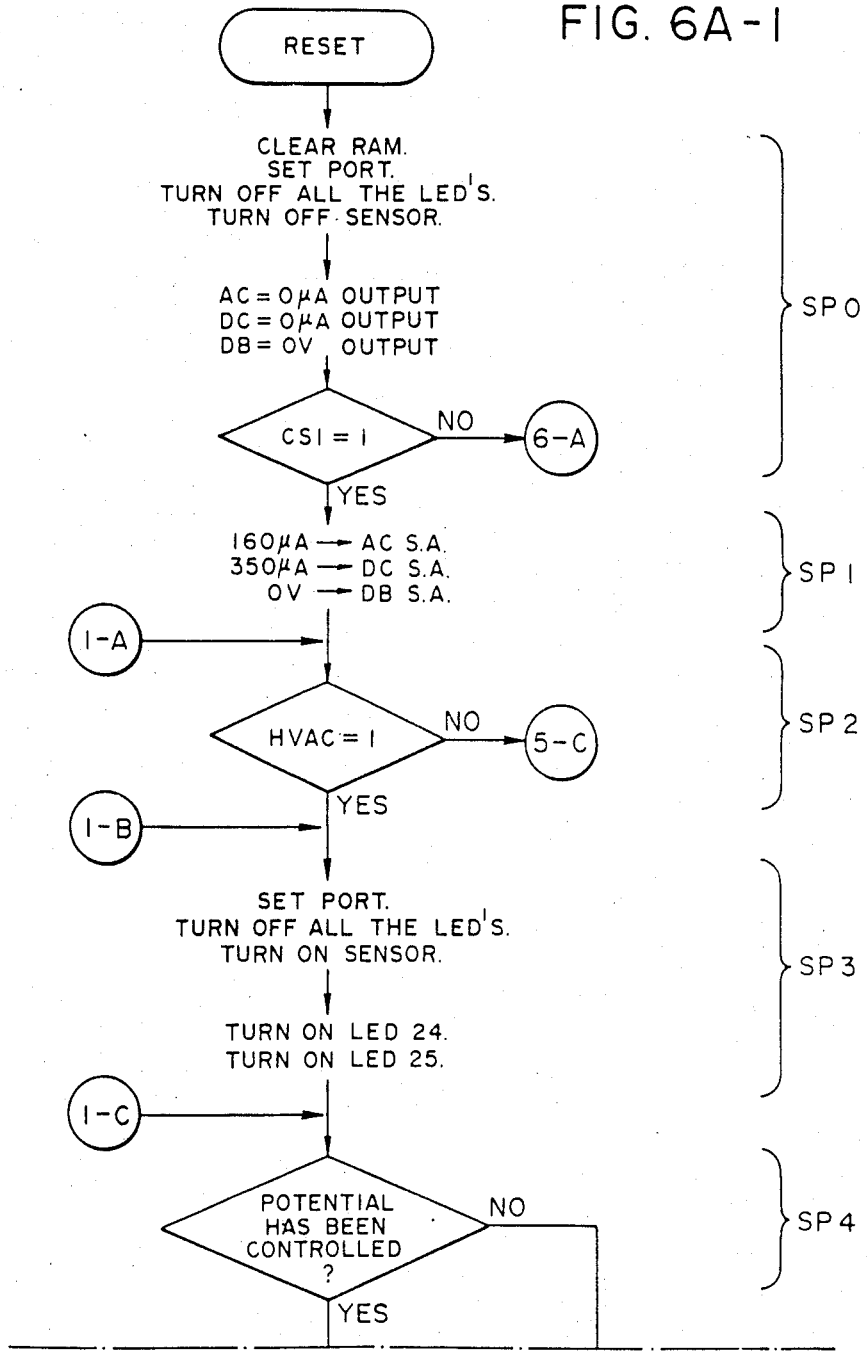
Figures 2, 6A:
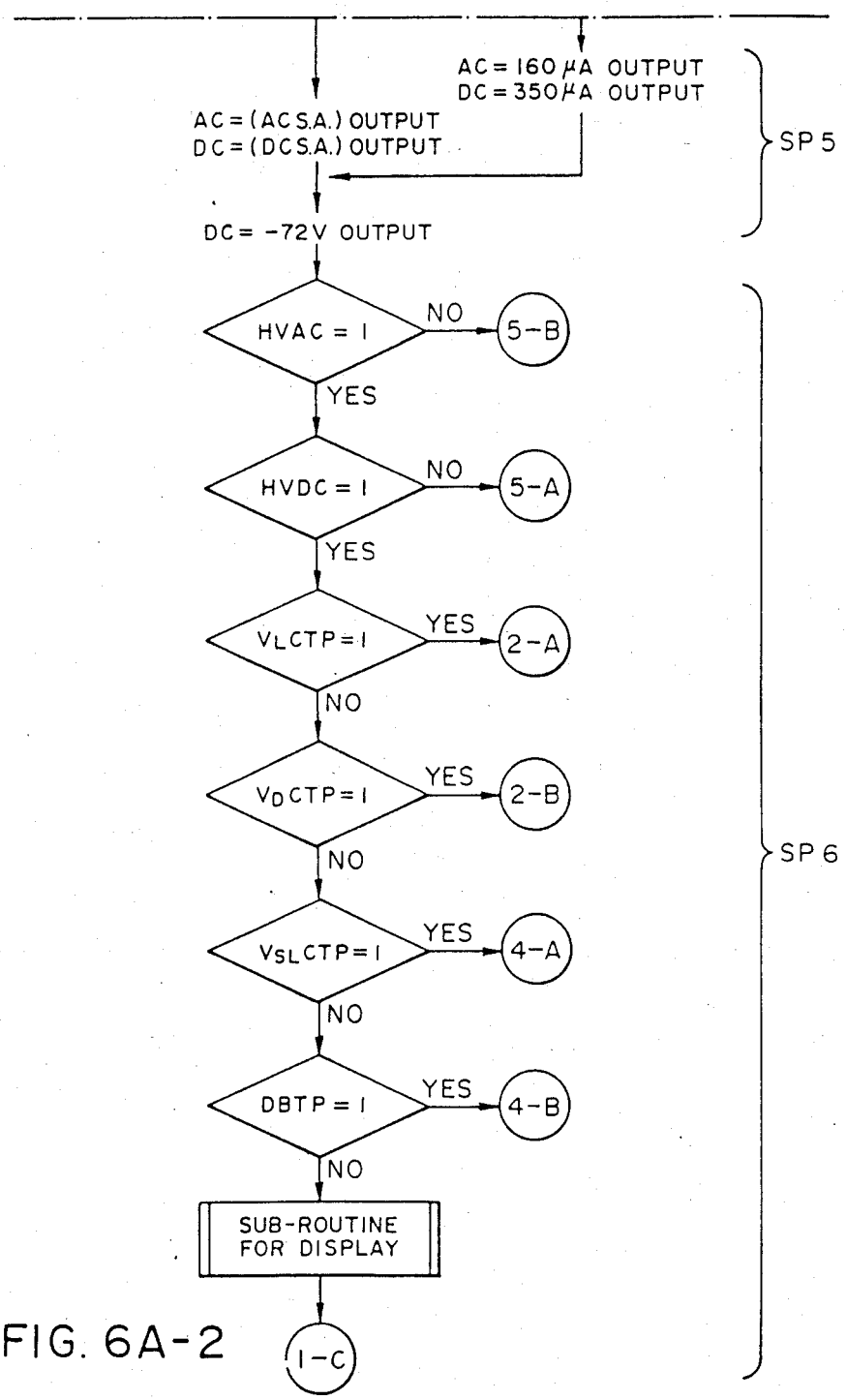
Figures 1, 6B:
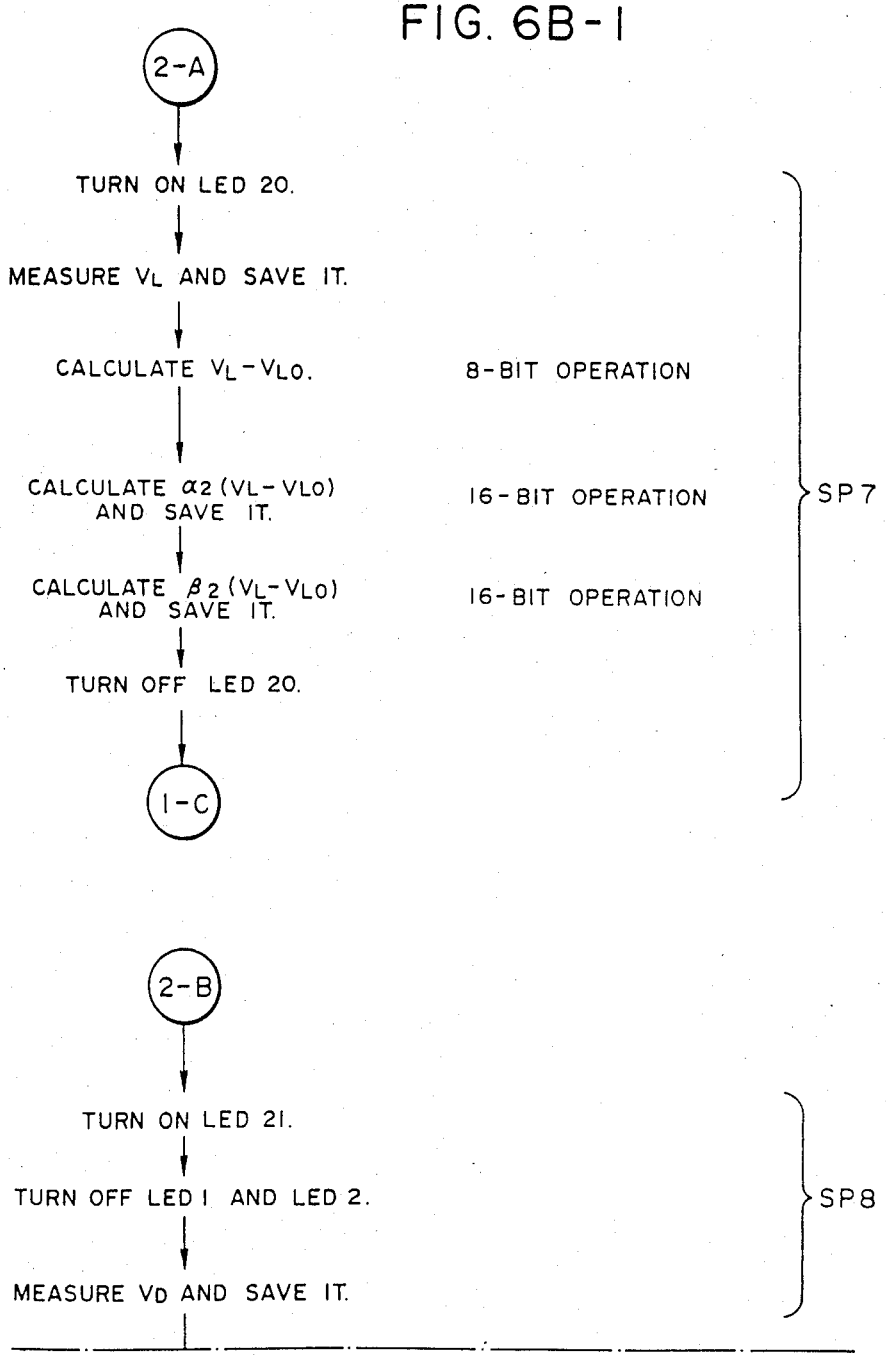
Figures 2, 6B:
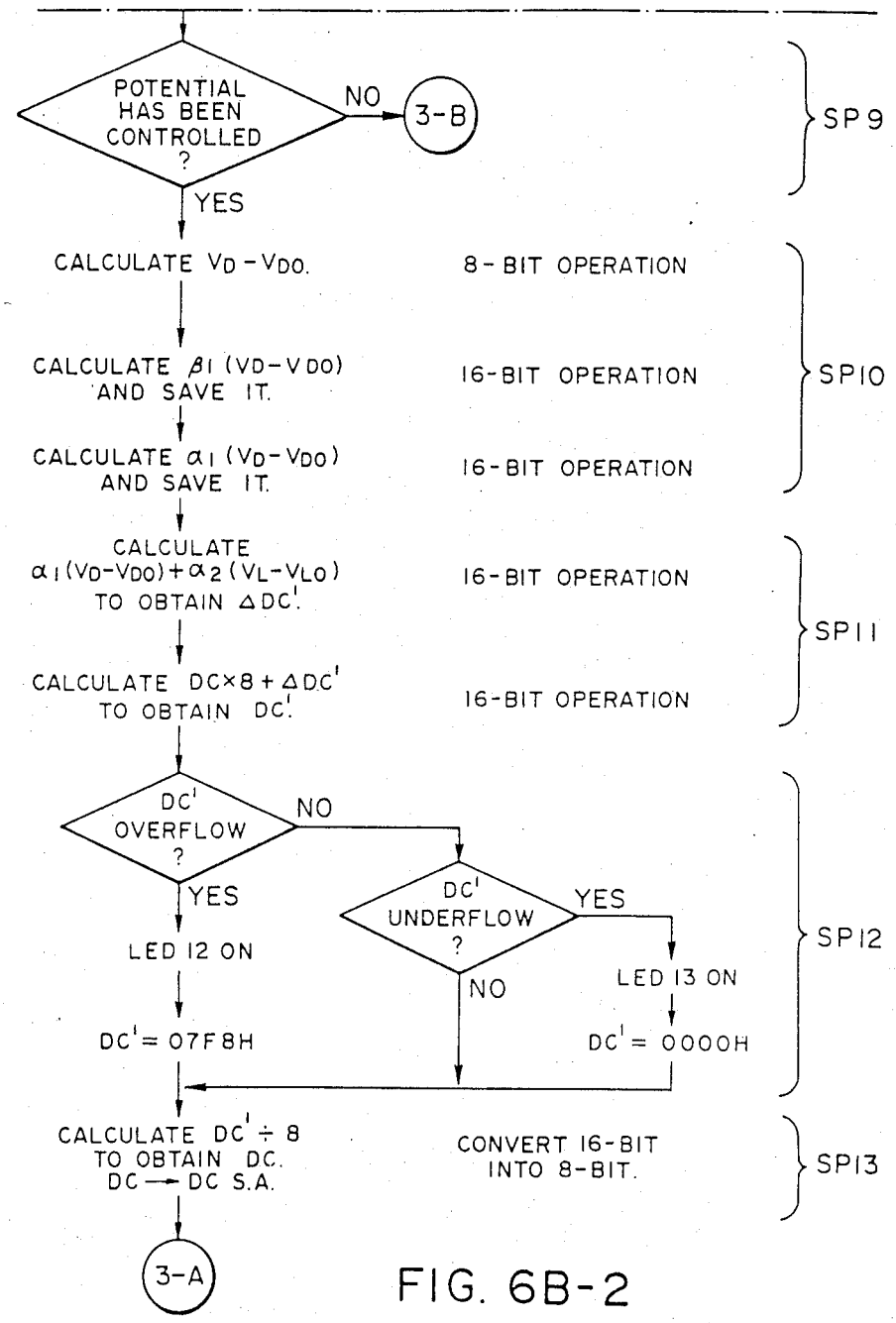
Figures 1, 6C:
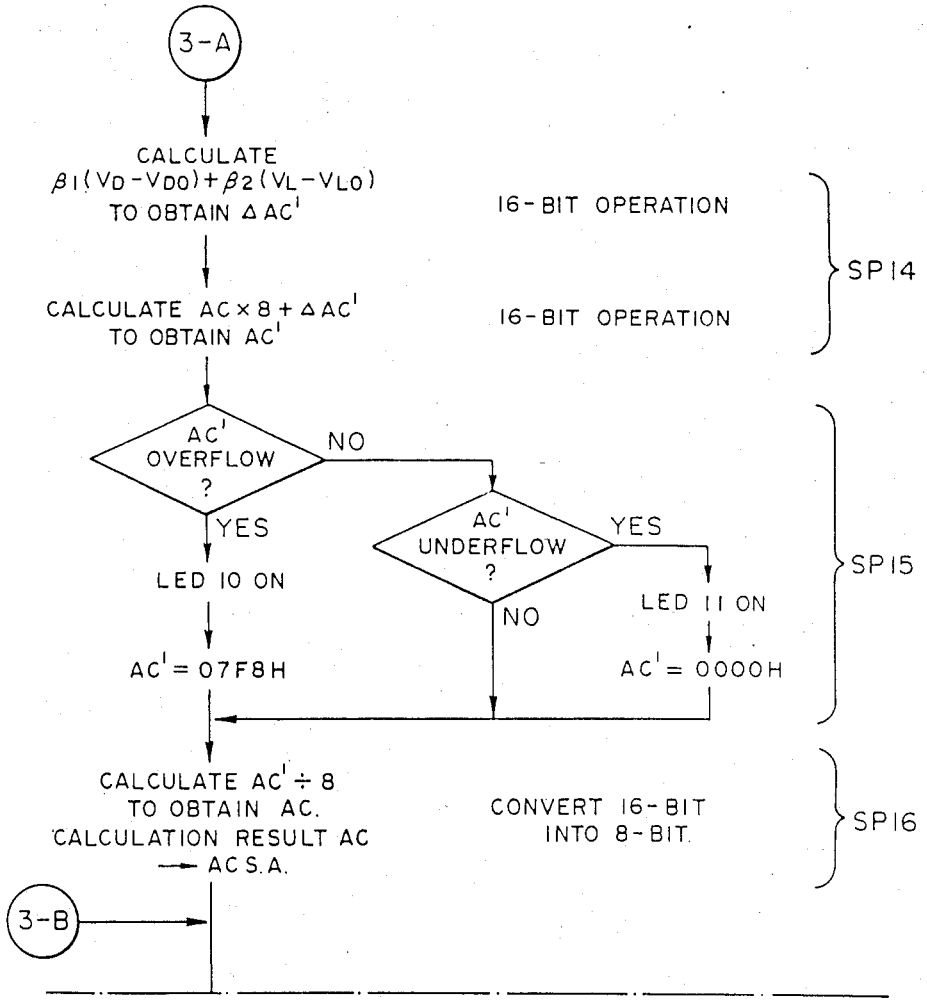
Figures 2, 6C:
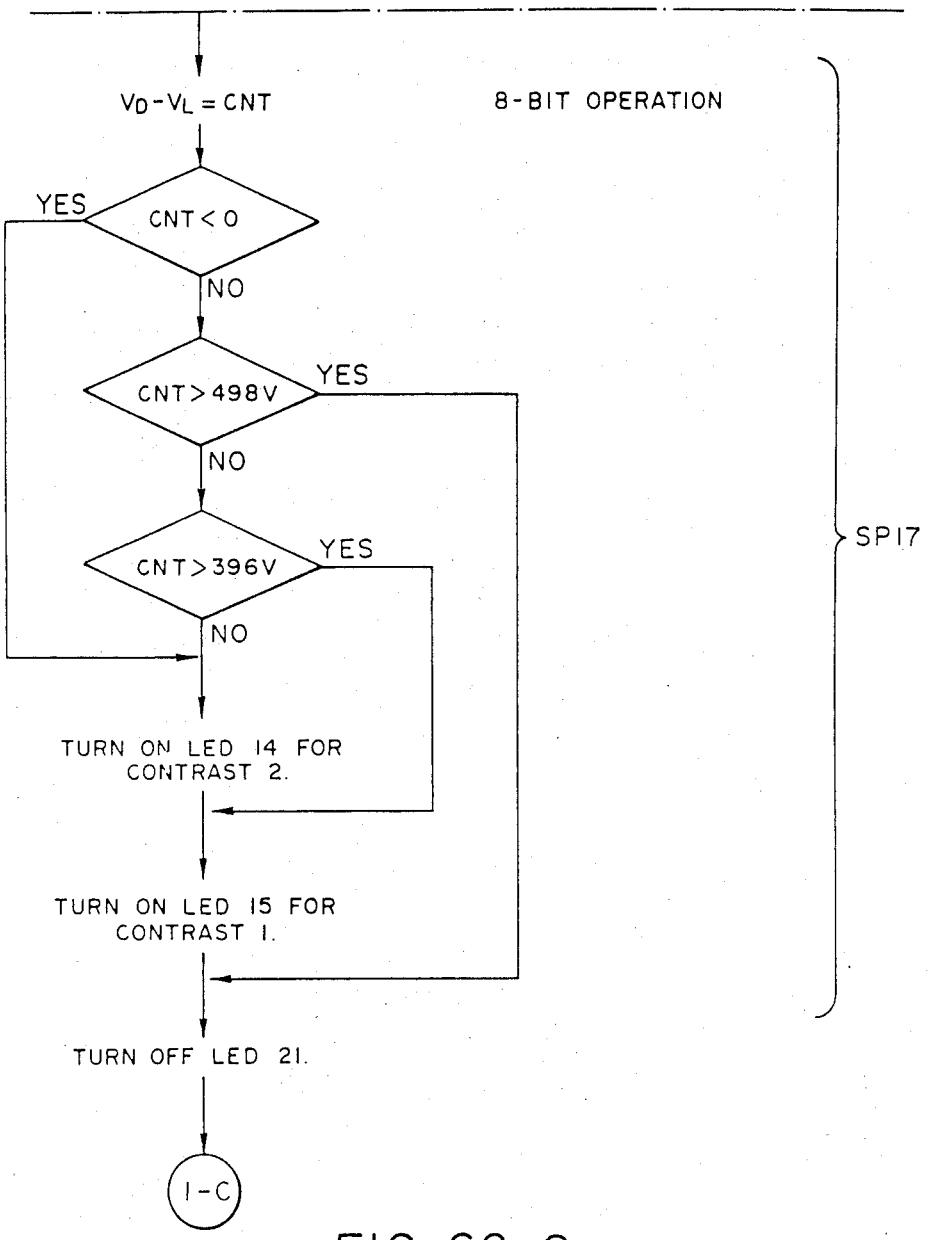
Figures 1, 6D:
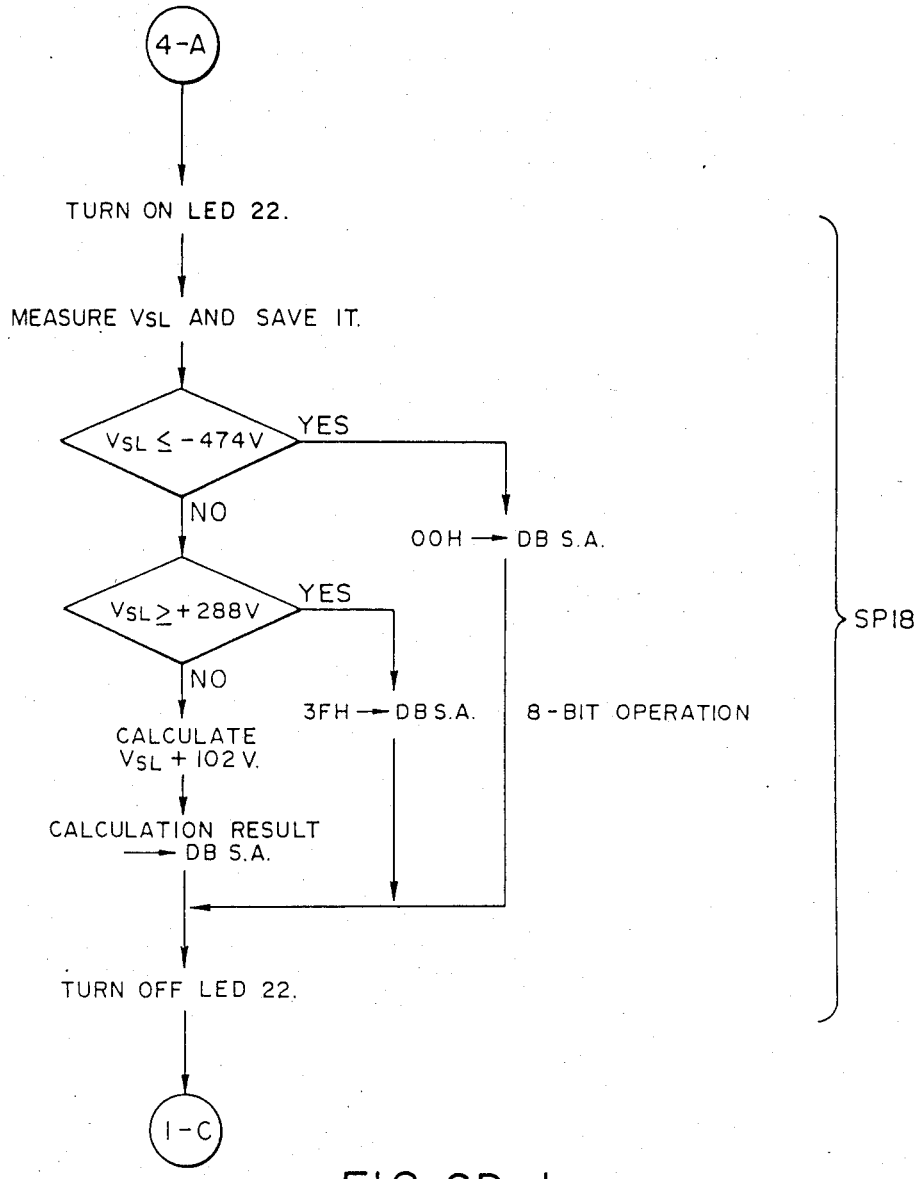
Figures 2, 6D:
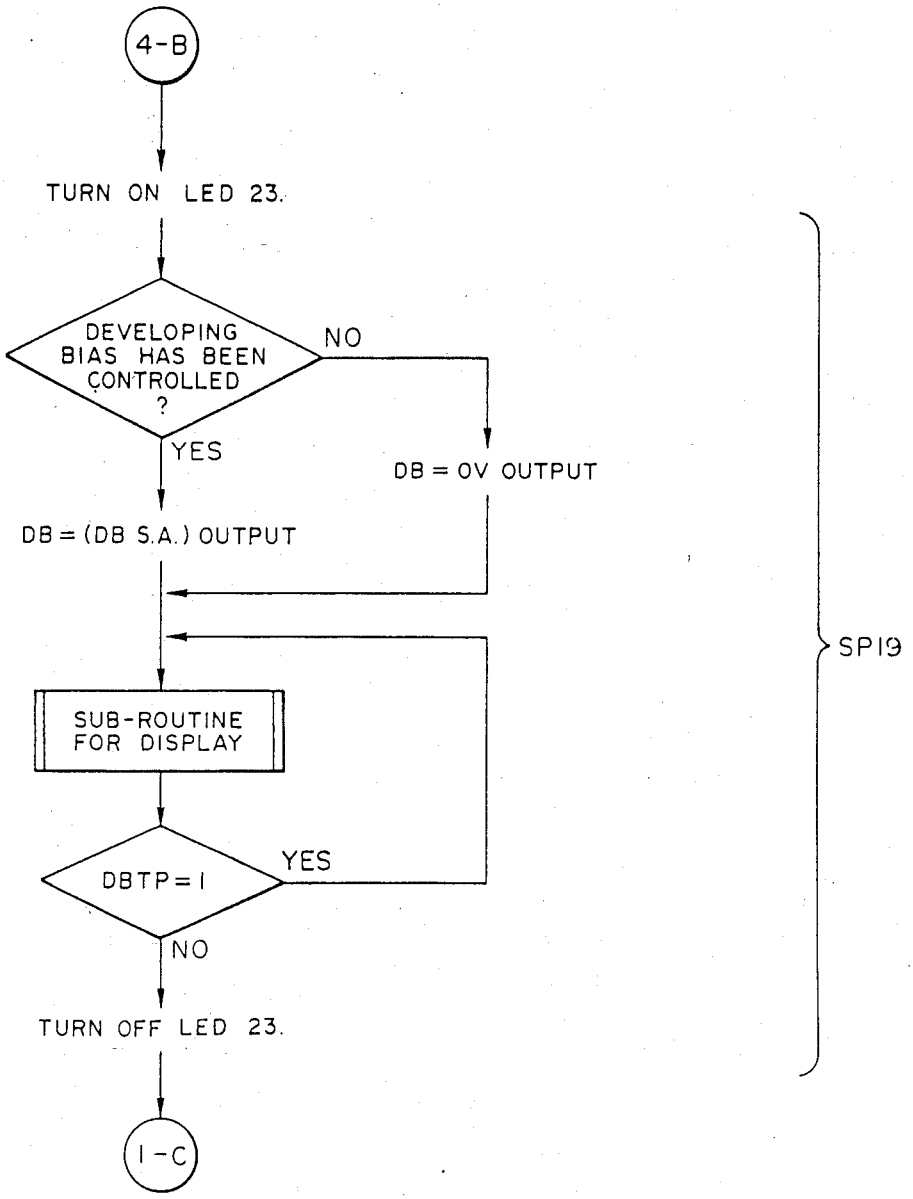
Figures 1, 6E:
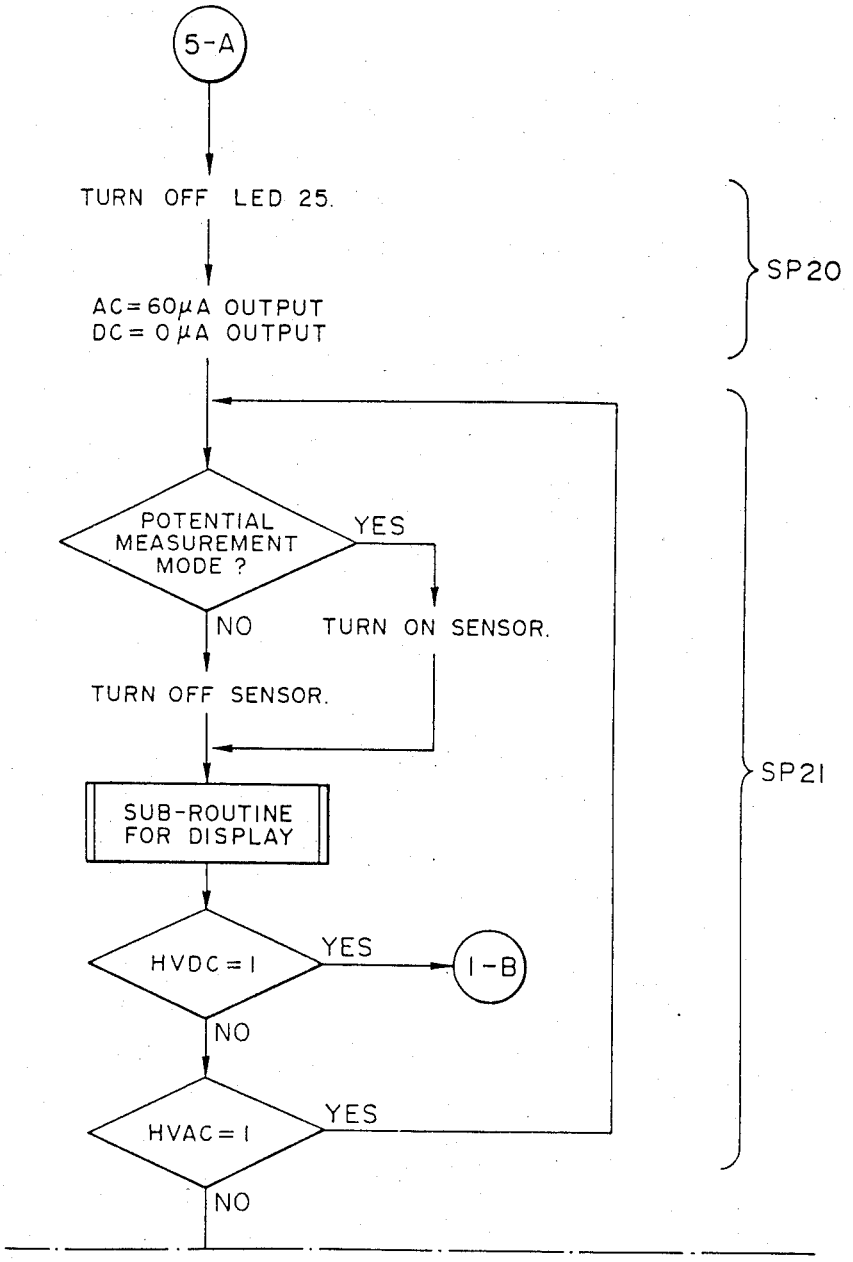
Figures 2, 6E:
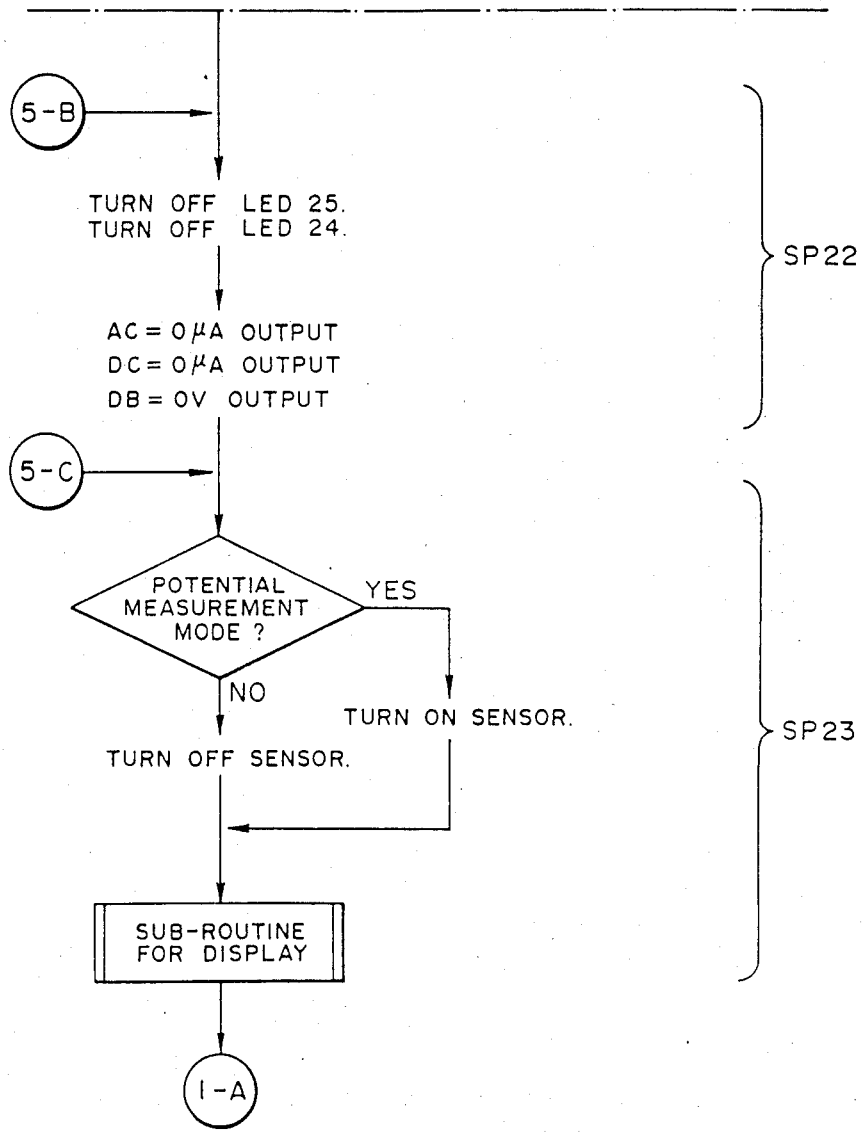
Figures 1, 6F:
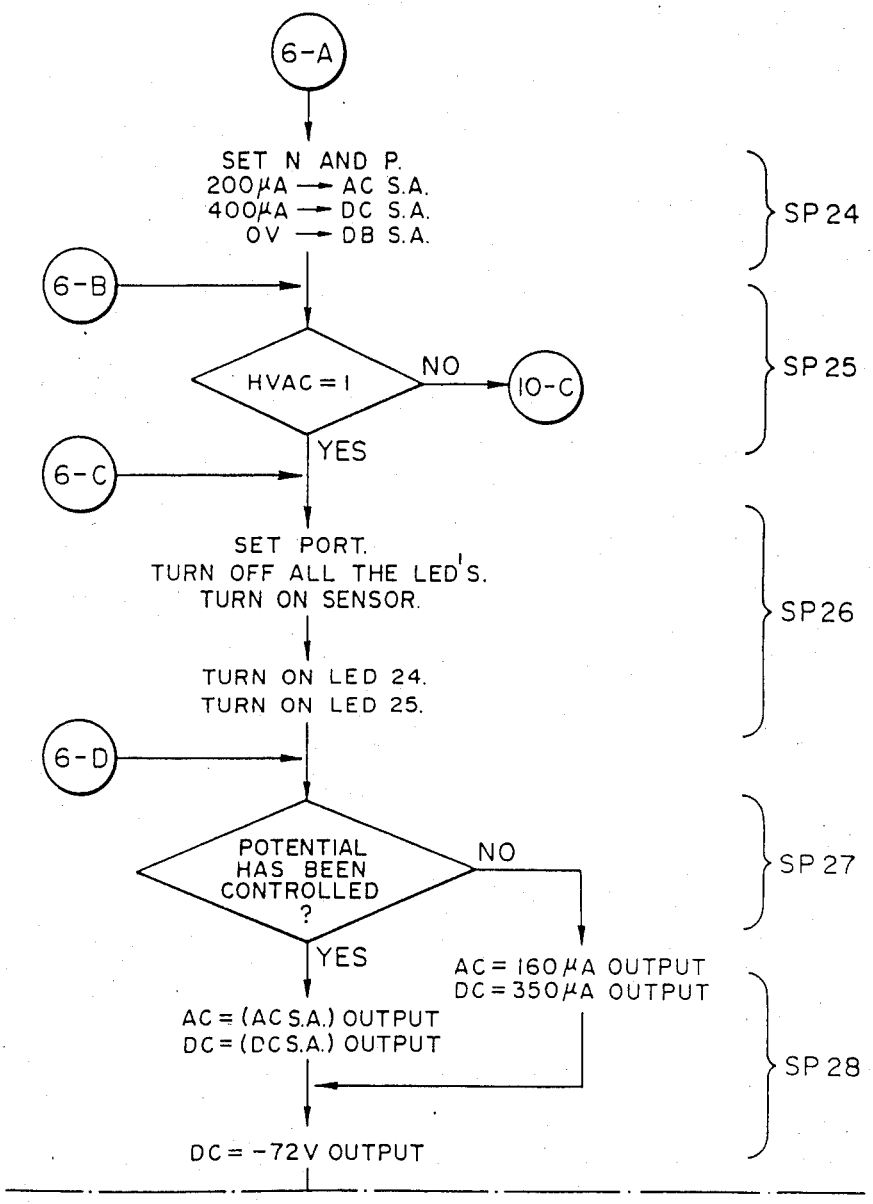
Figures 2, 6F:
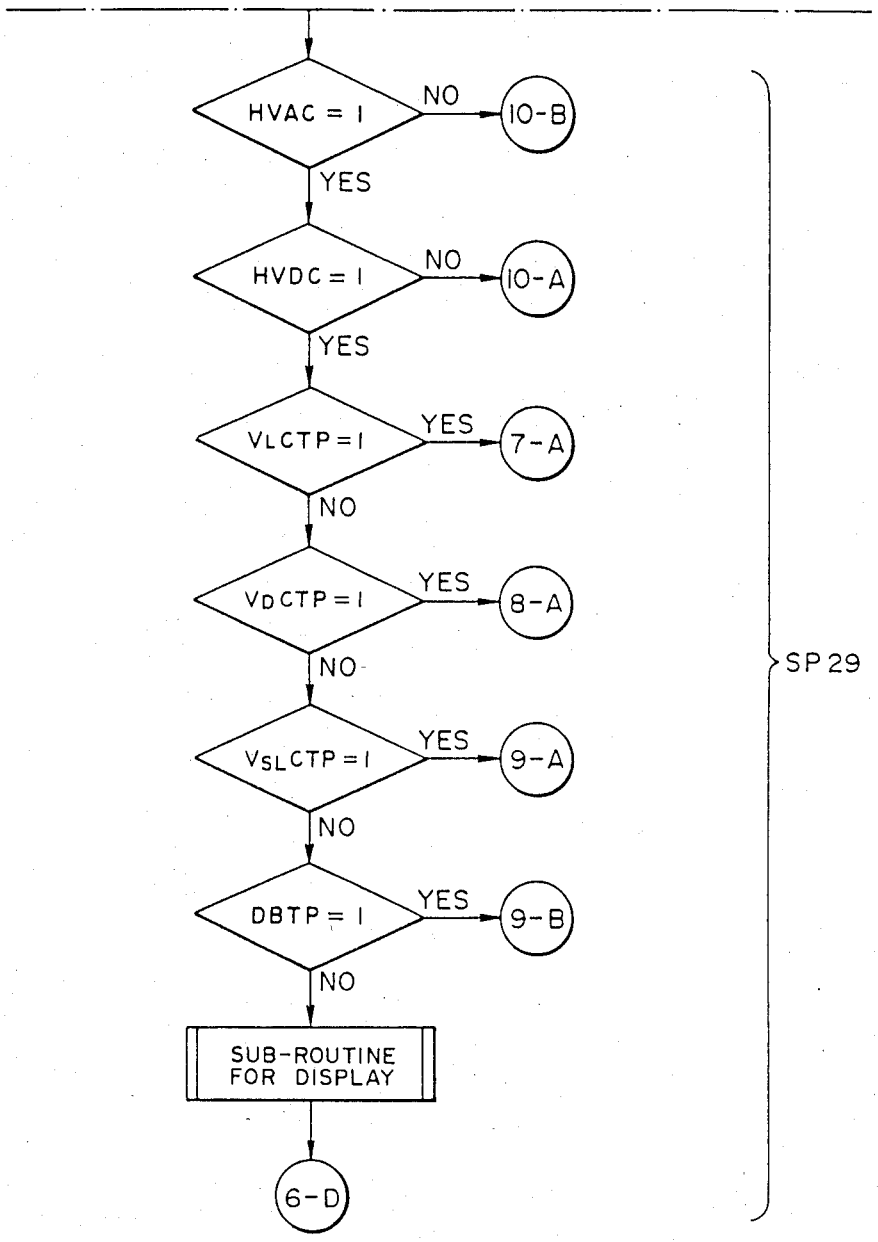
Figure 6G:
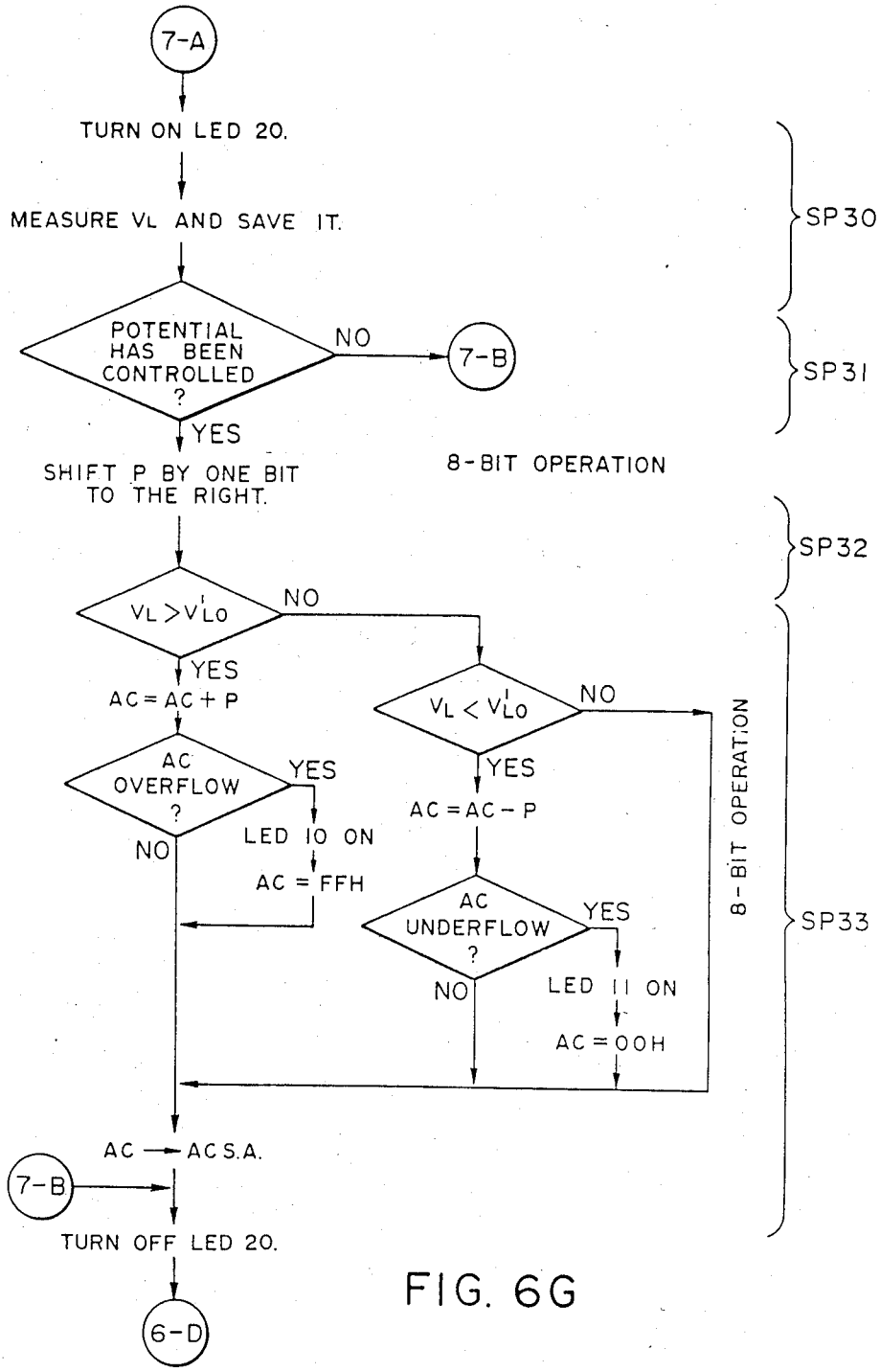
FIG. 6G is a flow chart of yet other program stored in the CPU2.
Figures 1, 6H:
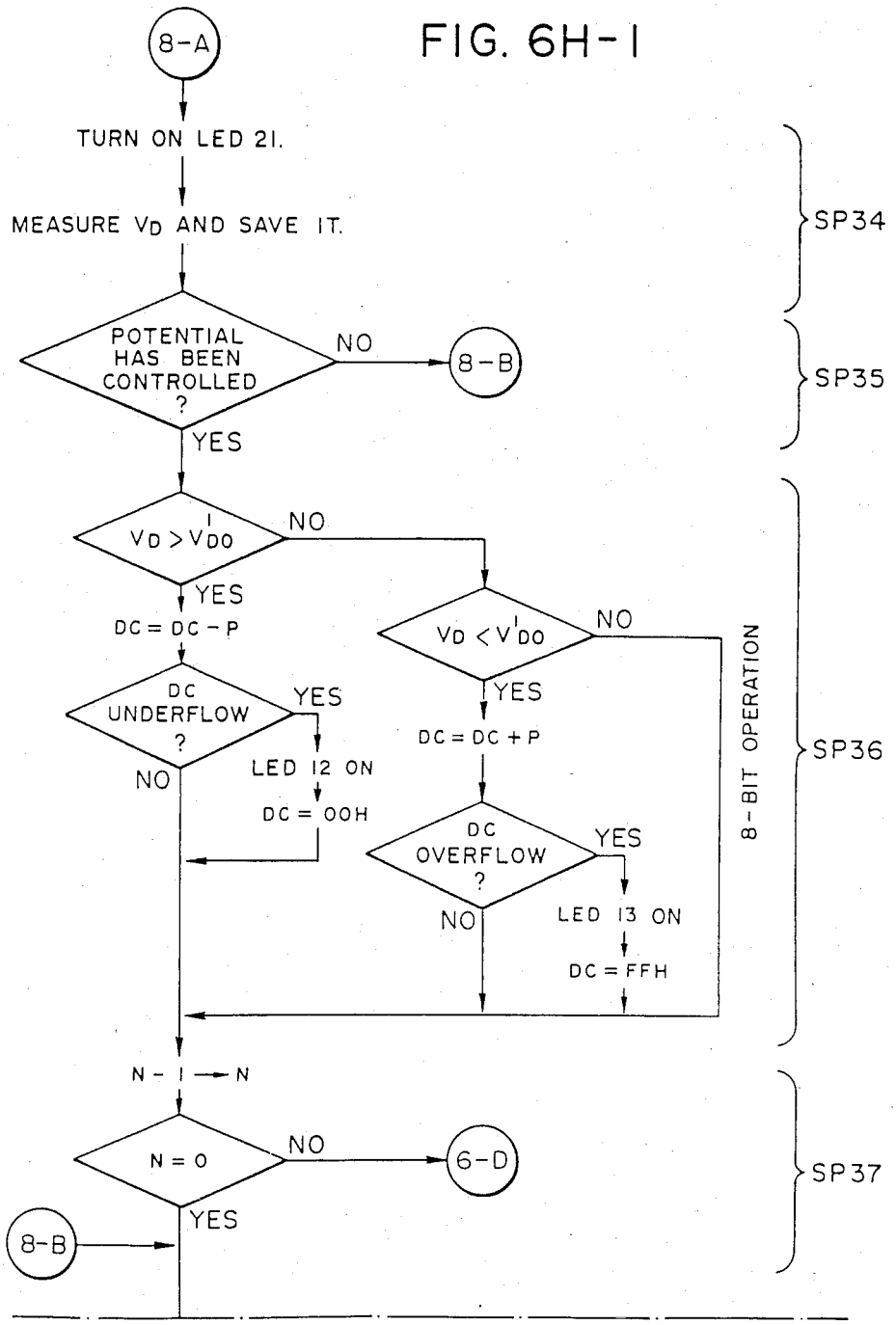
Figures 2, 6H:
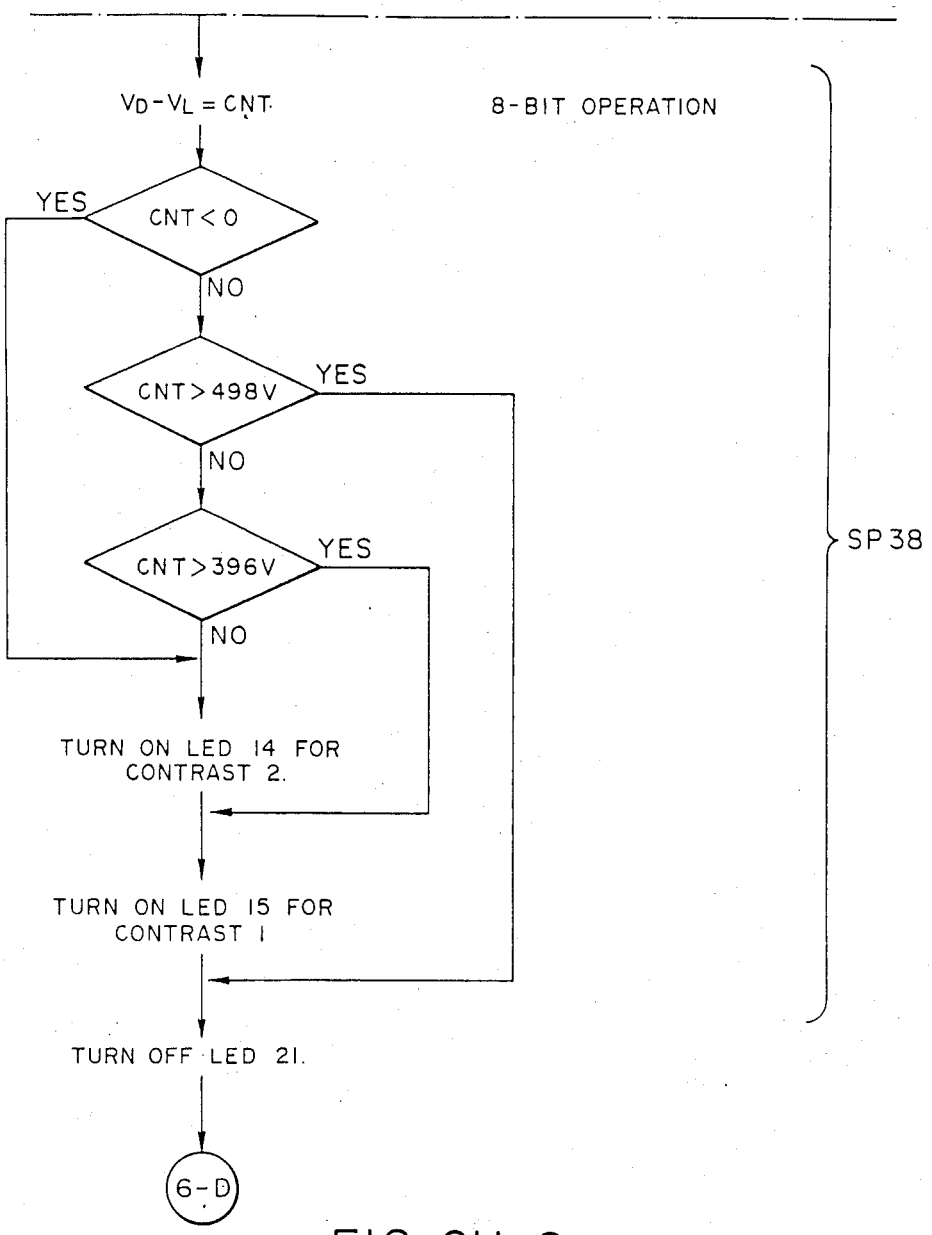
Figures 1, 6I:
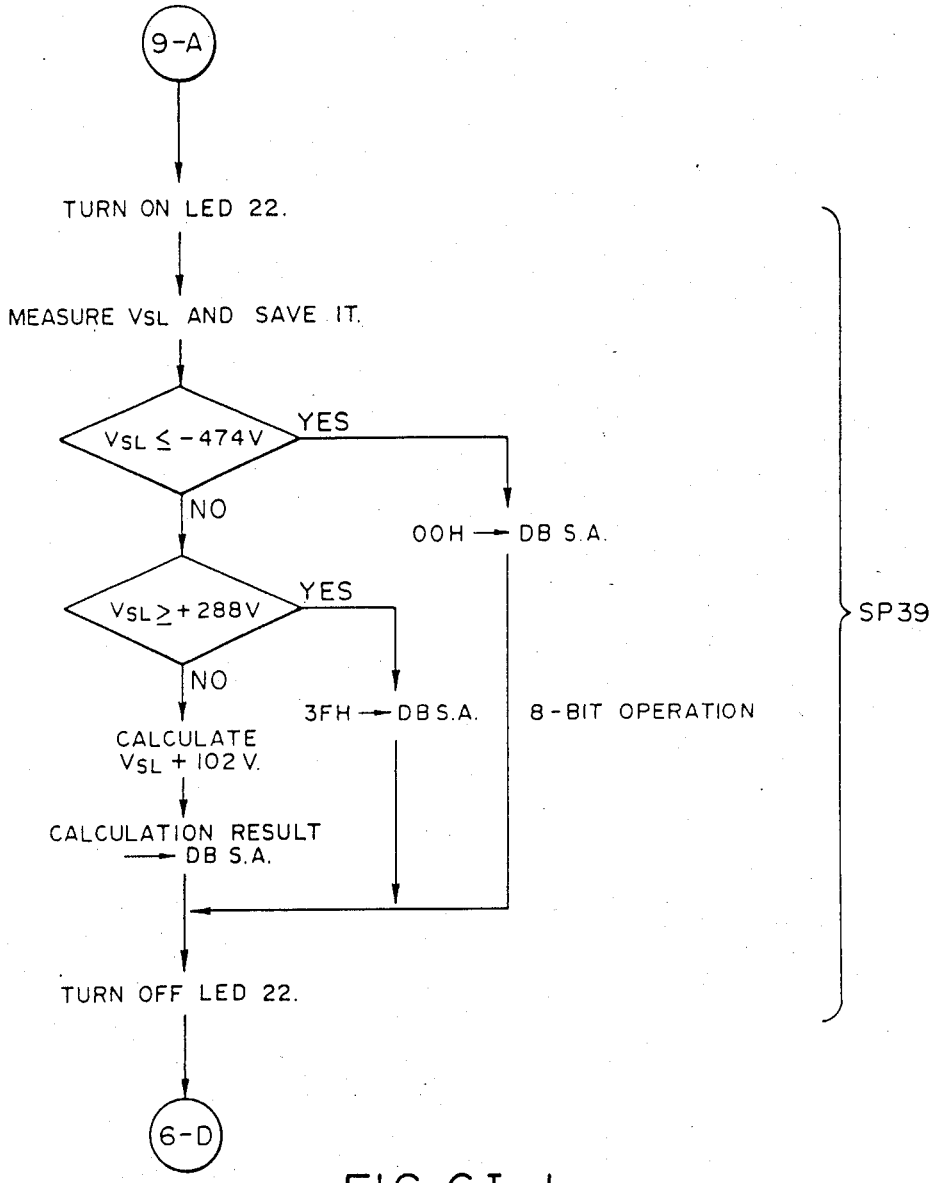
Figures 2, 6I:
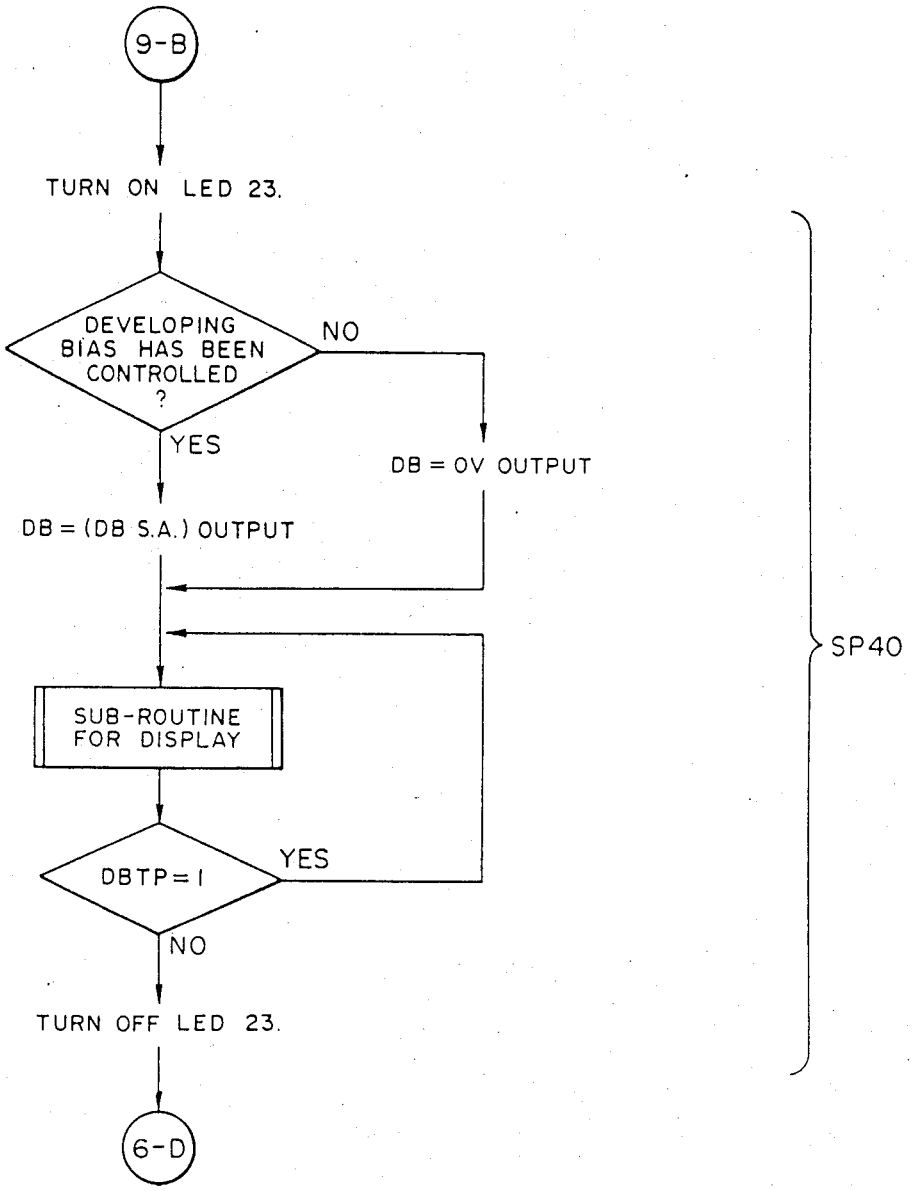
Figures 1, 6J:
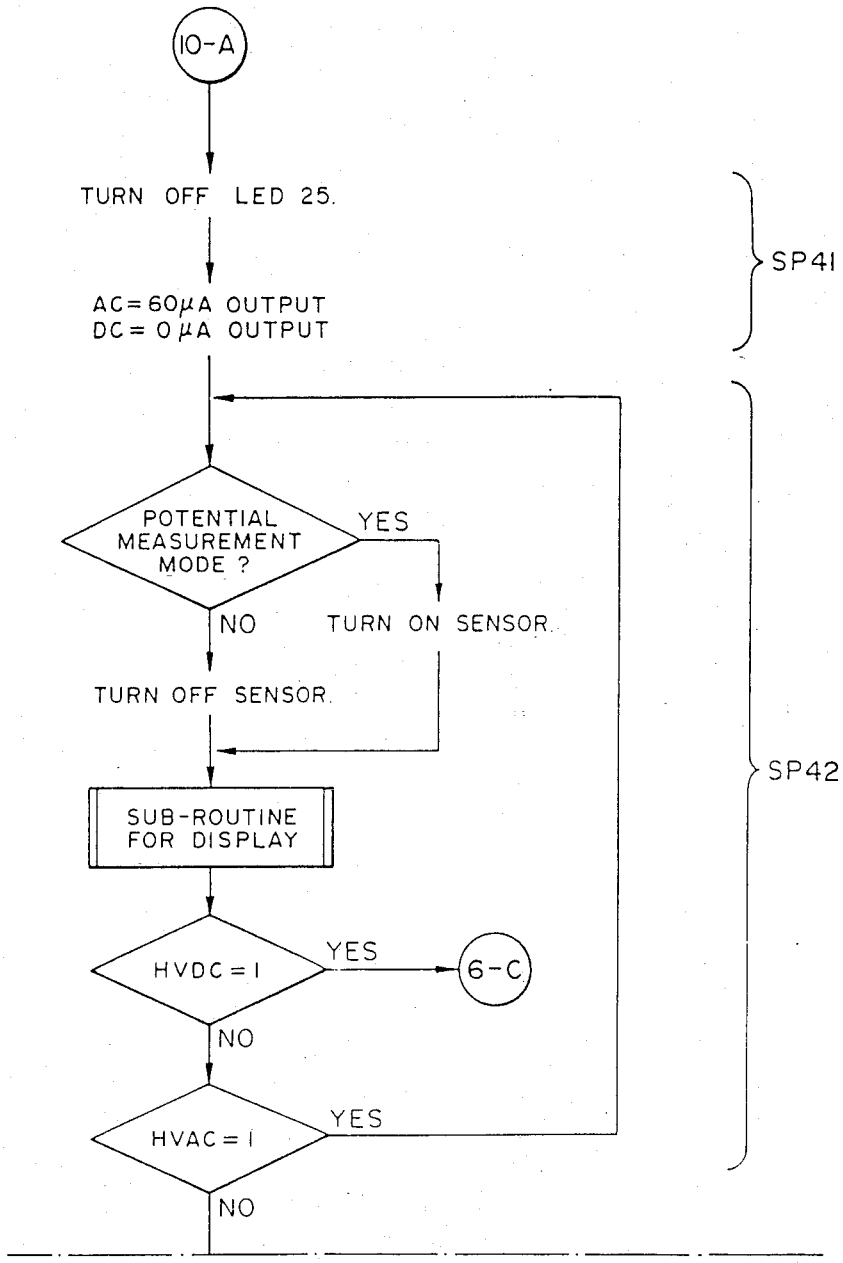
Figures 2, 6J:
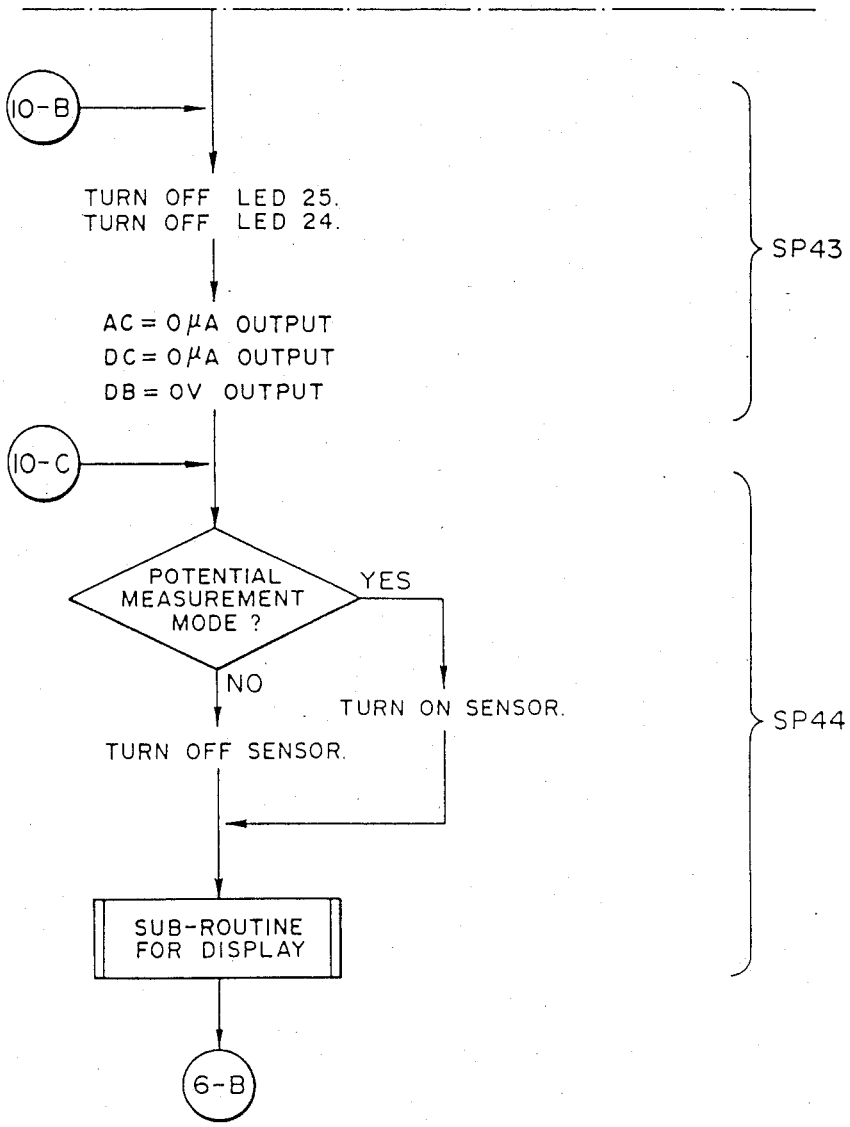
Figure 7:
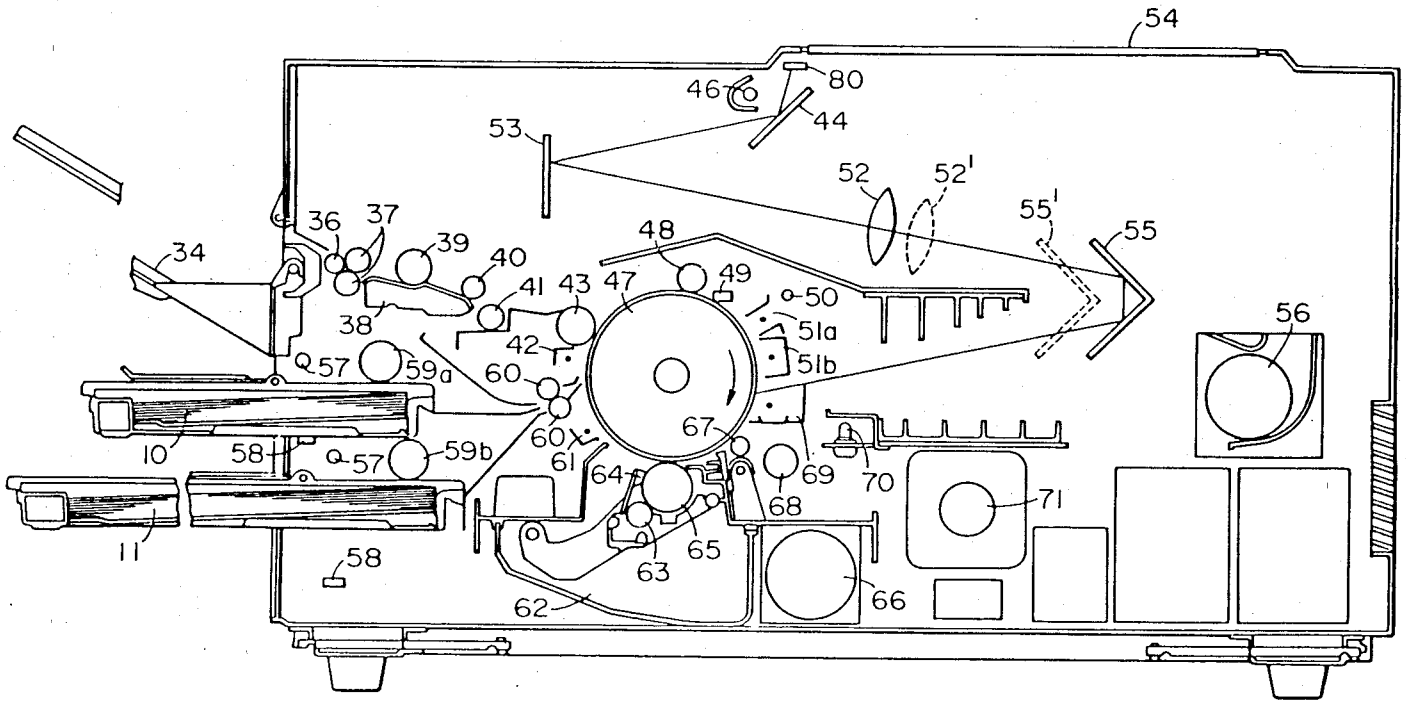
FIG. 7 is a side elevational view, in cross-section, of another embodiment of the reproduction device according to the present invention.

FIG. 7 illustrate a side elevational view, in cross-section, of the reproduction device according to the present invention, wherein those parts having the same functions as those in the device of FIG. 1 are designated by the same reference numerals. At the time of the full scale reproduction, the device operates in the same manner as explained with reference to FIG. 1. Here, explanations will be given as to the magnification-changing reproduction operations.

When a scale-reduction button on an operating panel (not shown in the drawing) is depressed, and subsequently a copy start button, the lens 52 and the mirror 55 shift to their respective positions 52', 55'. Thereafter, the mirror 44 and 53 move at a speed ratio of 1:½, and at the same speed as that in the case of the full scale reproduction. The photosensitive drum 47 also rotates with its rotational speed being increased in accordance with a scale-reduction ratio. That is, the image forming speed differs between the scale-reduction and full scale reproduction. By this scanning operation, an electrostatic latent image is obtained on the photosensitive drum 47 with its scale reduced in both vertical and horizontal directions at an equal ratio. The operations to follow thereafter are the same as those in the afore-described full scale reproduction operations.

Figure 8:
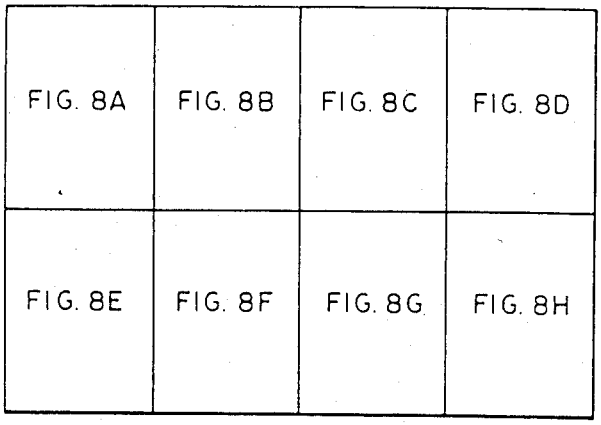
FIG. 8 is a combination scheme of FIGS. 8A through 8H.
Figure 9A:
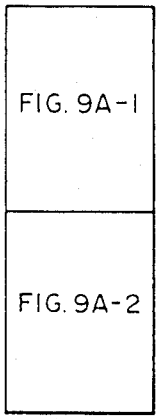
FIG. 9A is a combination scheme of FIGS. 9A-1 and 9A-2.
Figure 9B:
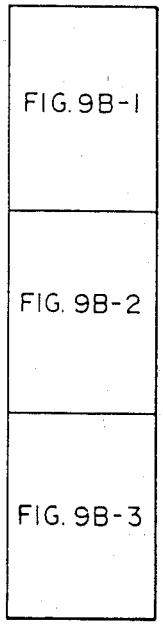
FIG. 9B is a combination scheme of FIGS. 9B-1 to 9B-3.
Figure 9C:
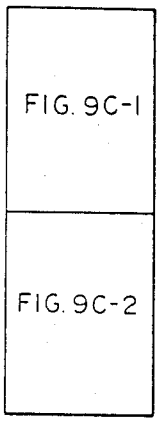
FIG. 9C is a combination scheme of FIGS. 9C-1 and 9C-2.
Figure 9D:
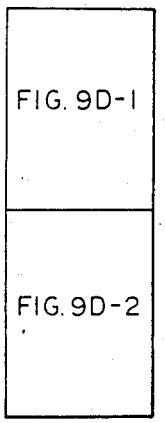
FIG. 9D is a combination scheme of FIGS. 9D-1 and 9D-2.
Figure 9E:
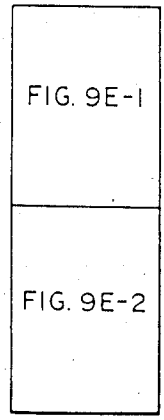
FIG. 9E is a combination scheme of FIGS. 9E-1 and 9E-2 FIGS. 9E-1 and 9E-2 show a flow chart of other program stored in CPU2'.
Figure 8A:
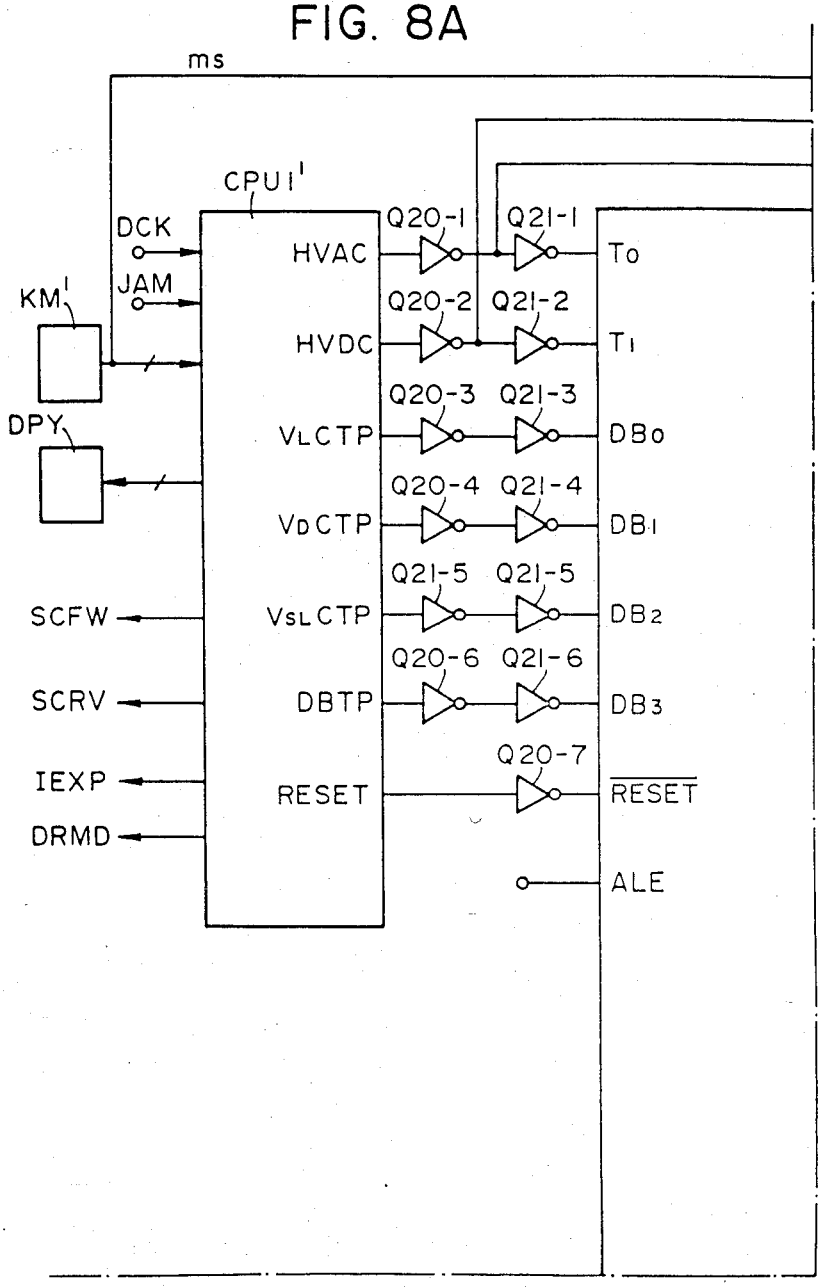
FIGS. 8A through 8H show another embodiment of the potential control unit circuit according to the present invention.
Figure 8B:
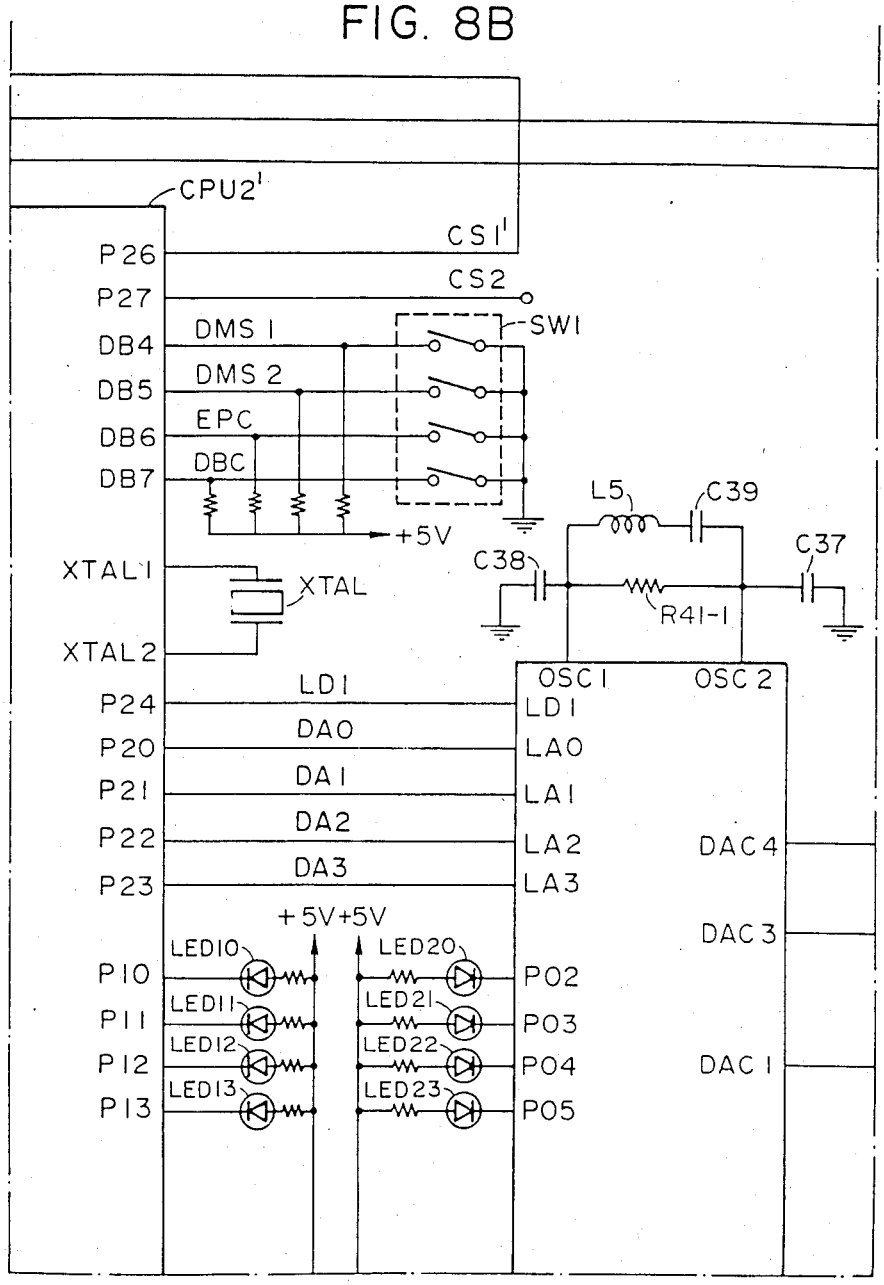
Figure 8C:
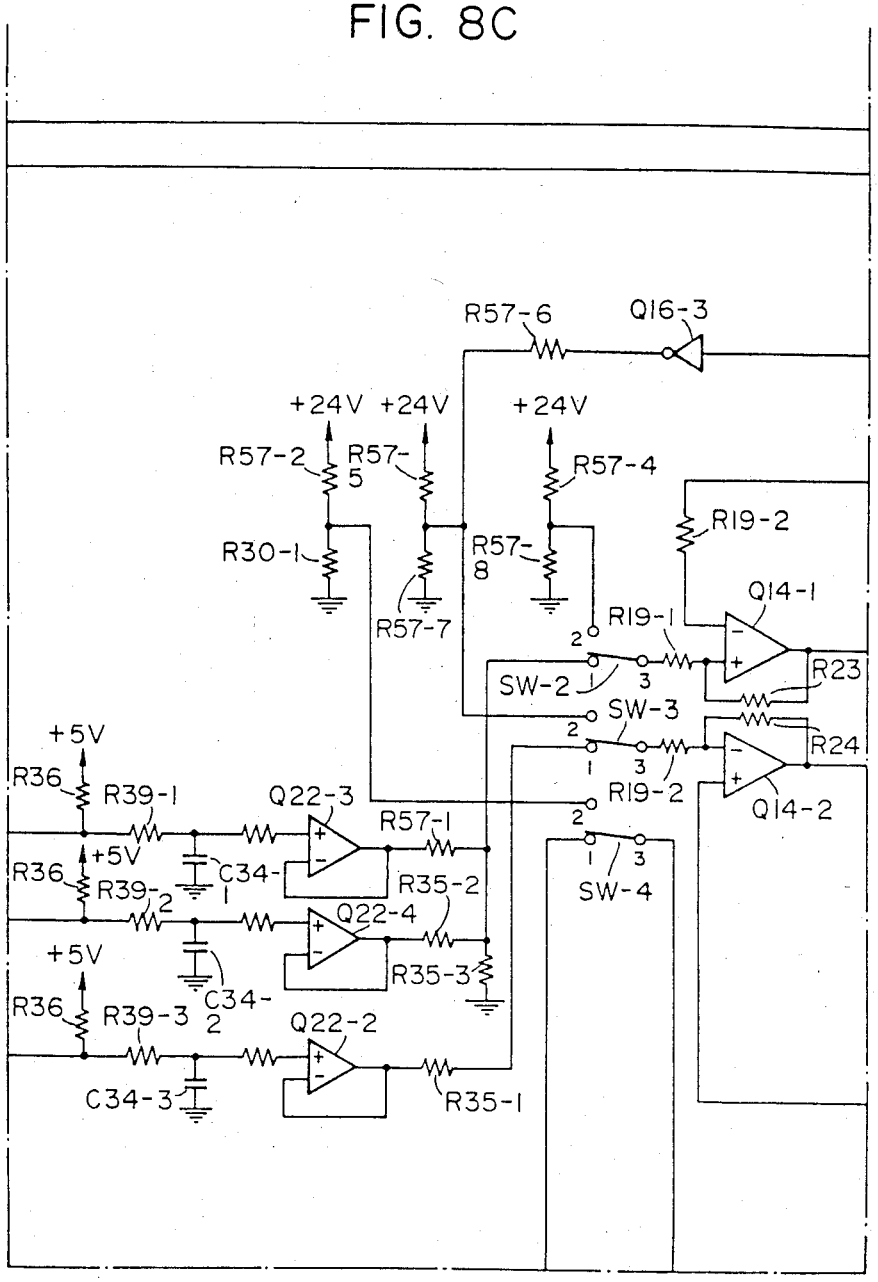
Figure 8D:
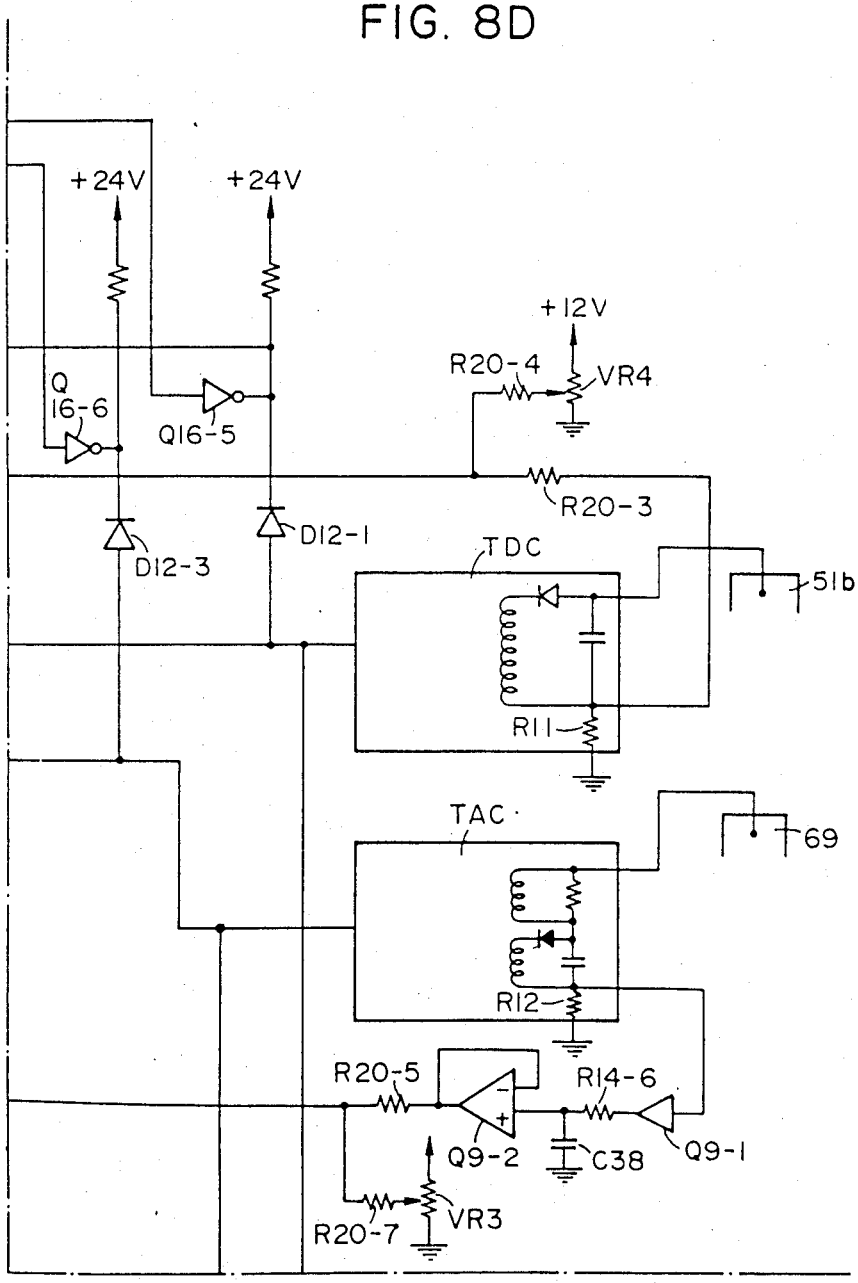
Figure 8E:
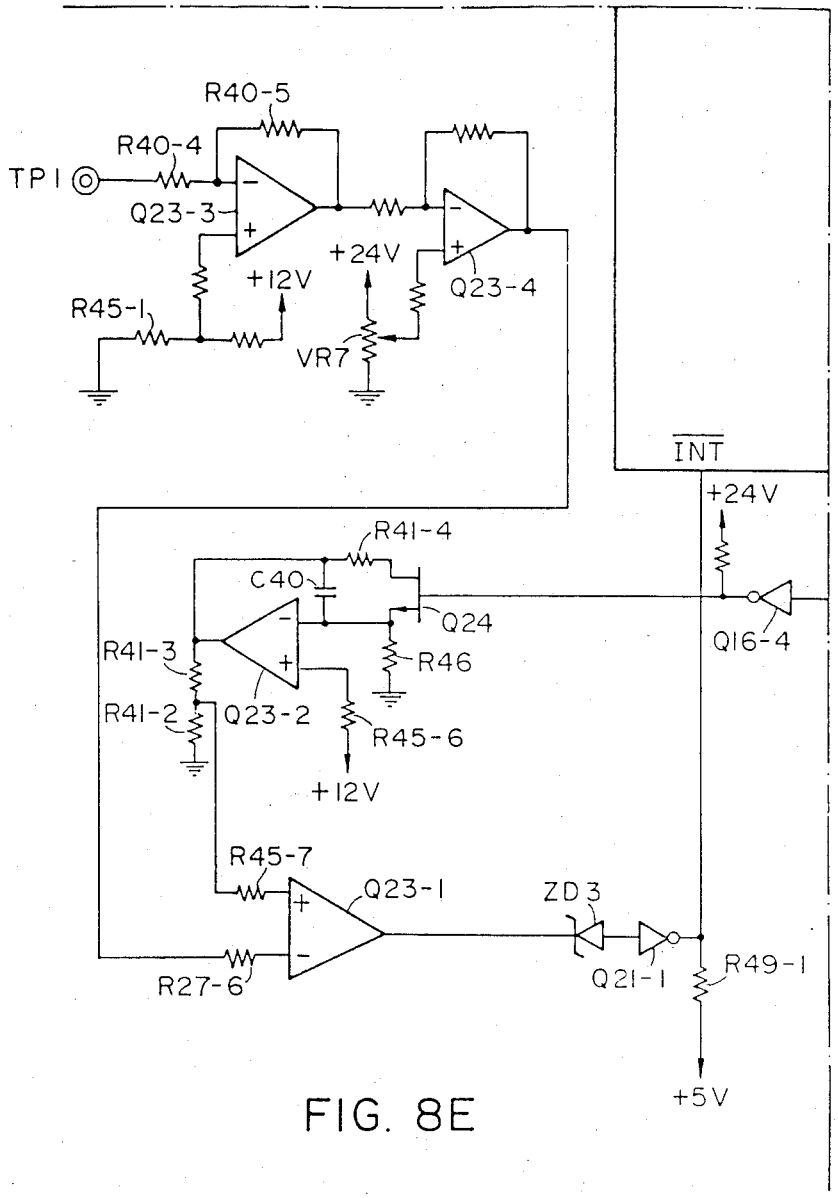
Figure 8F:
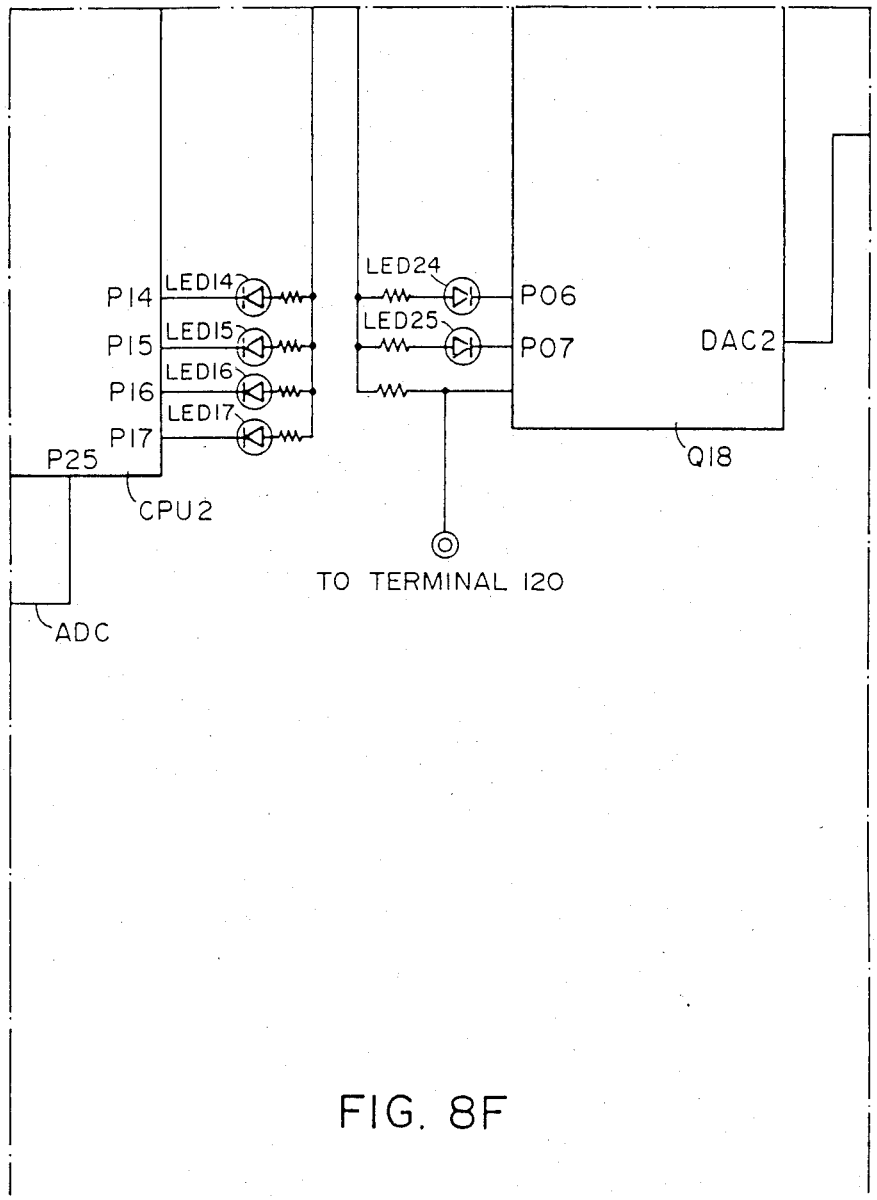
Figure 8G:
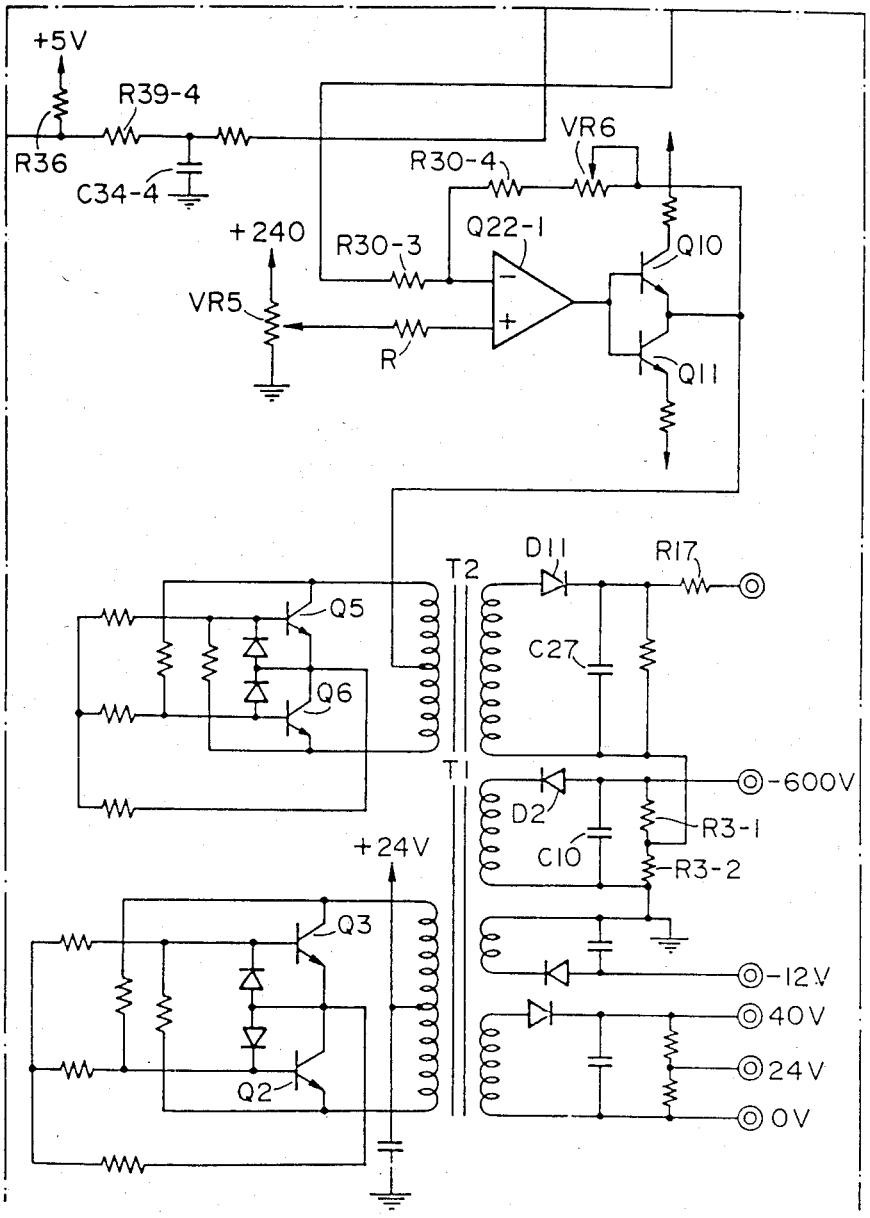
Figure 8H:
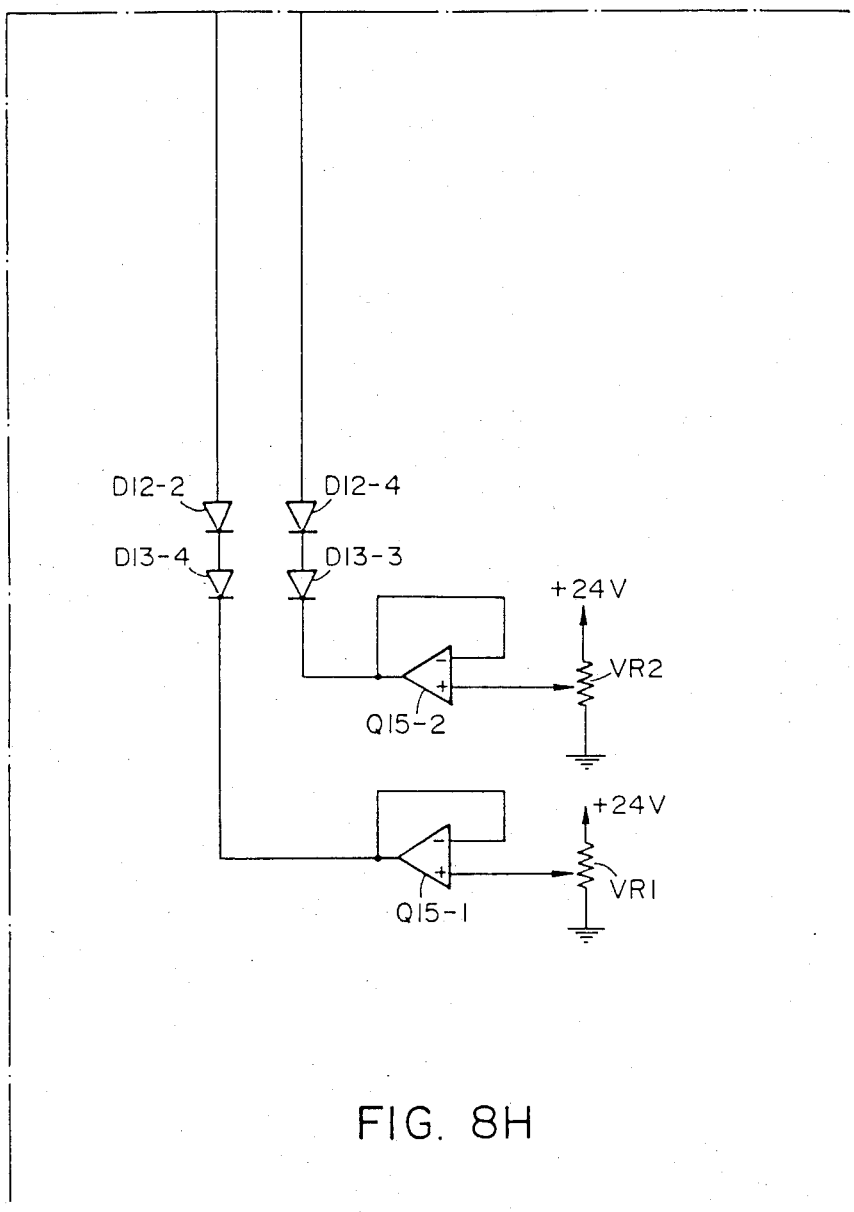
Figures 1, 9A:
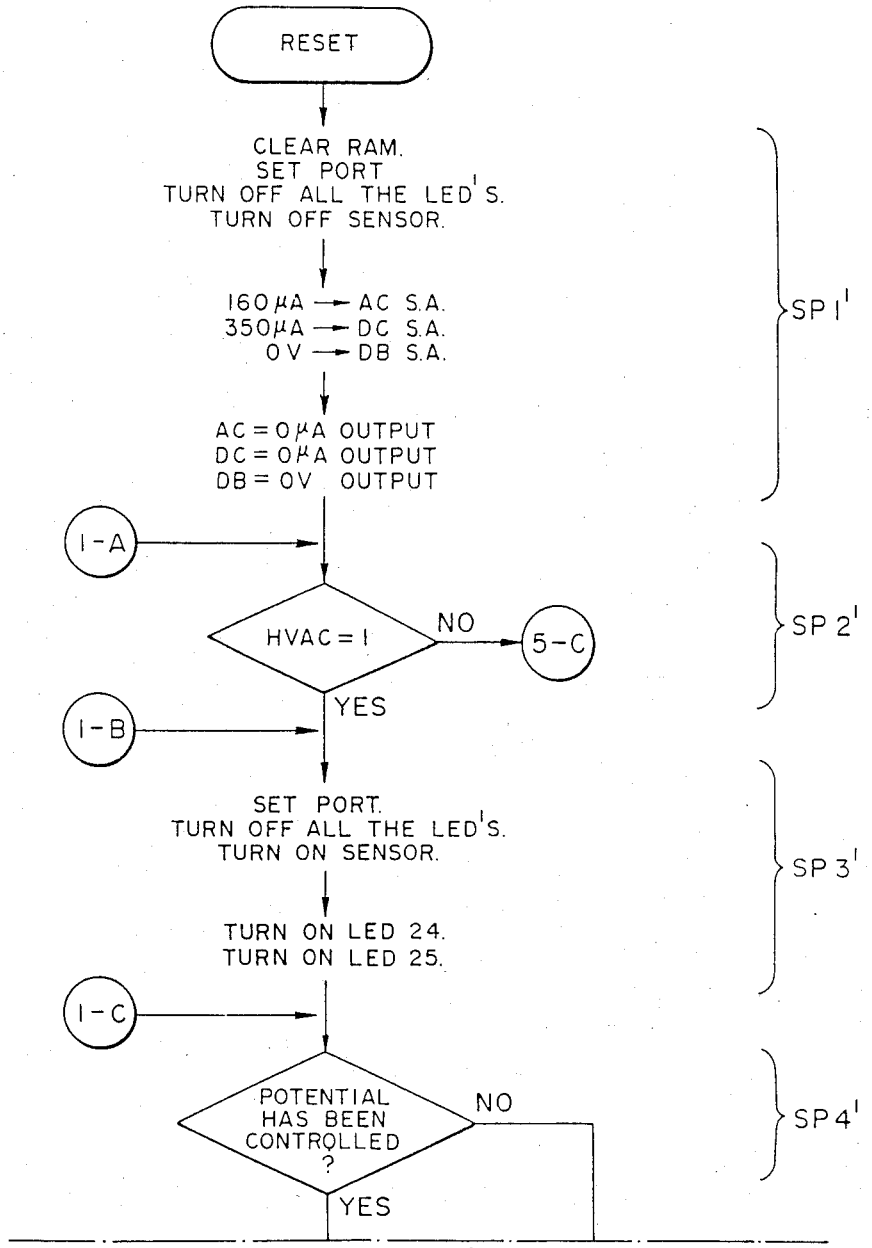
Figures 2, 9A:
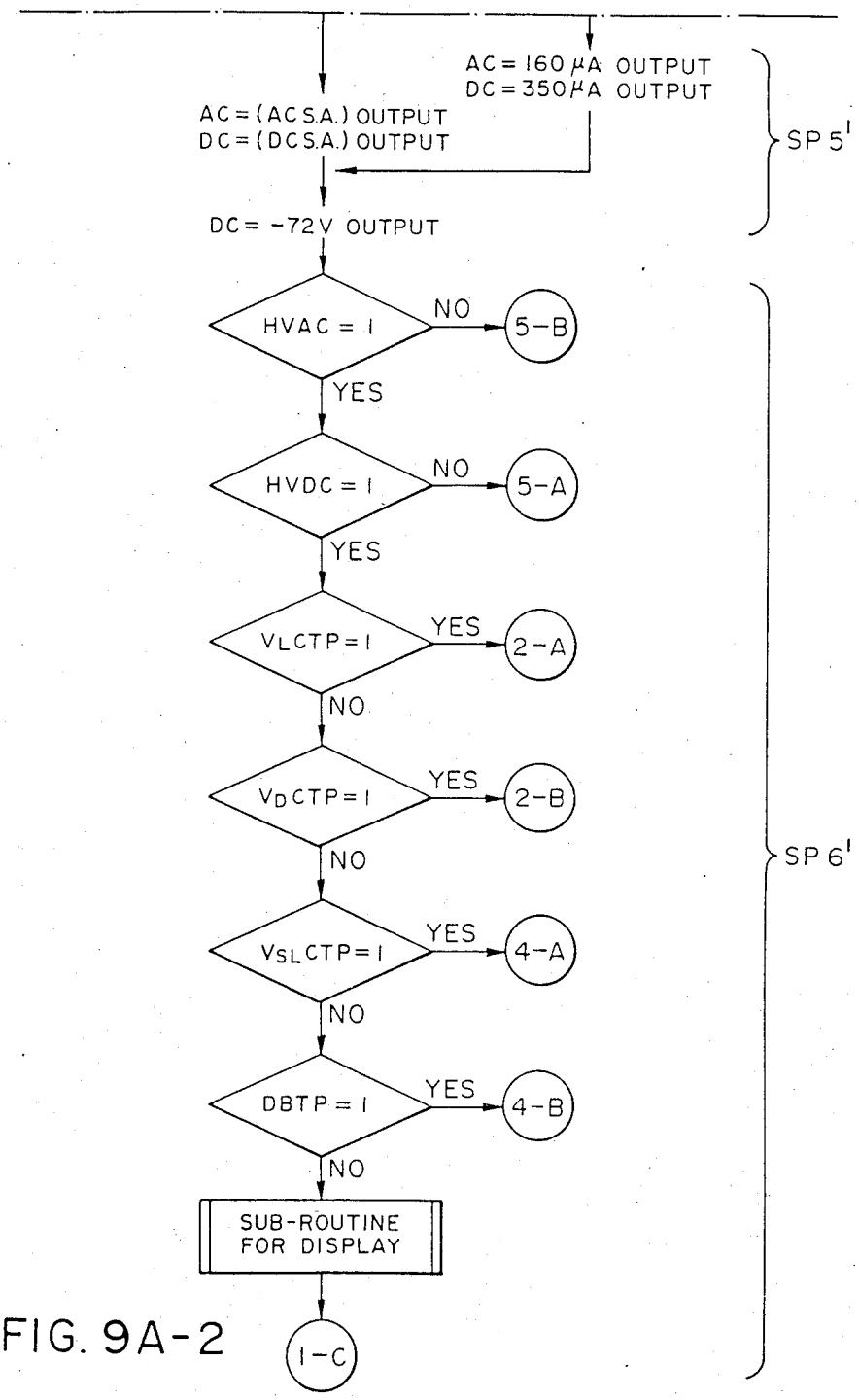
Figures 1, 9B:
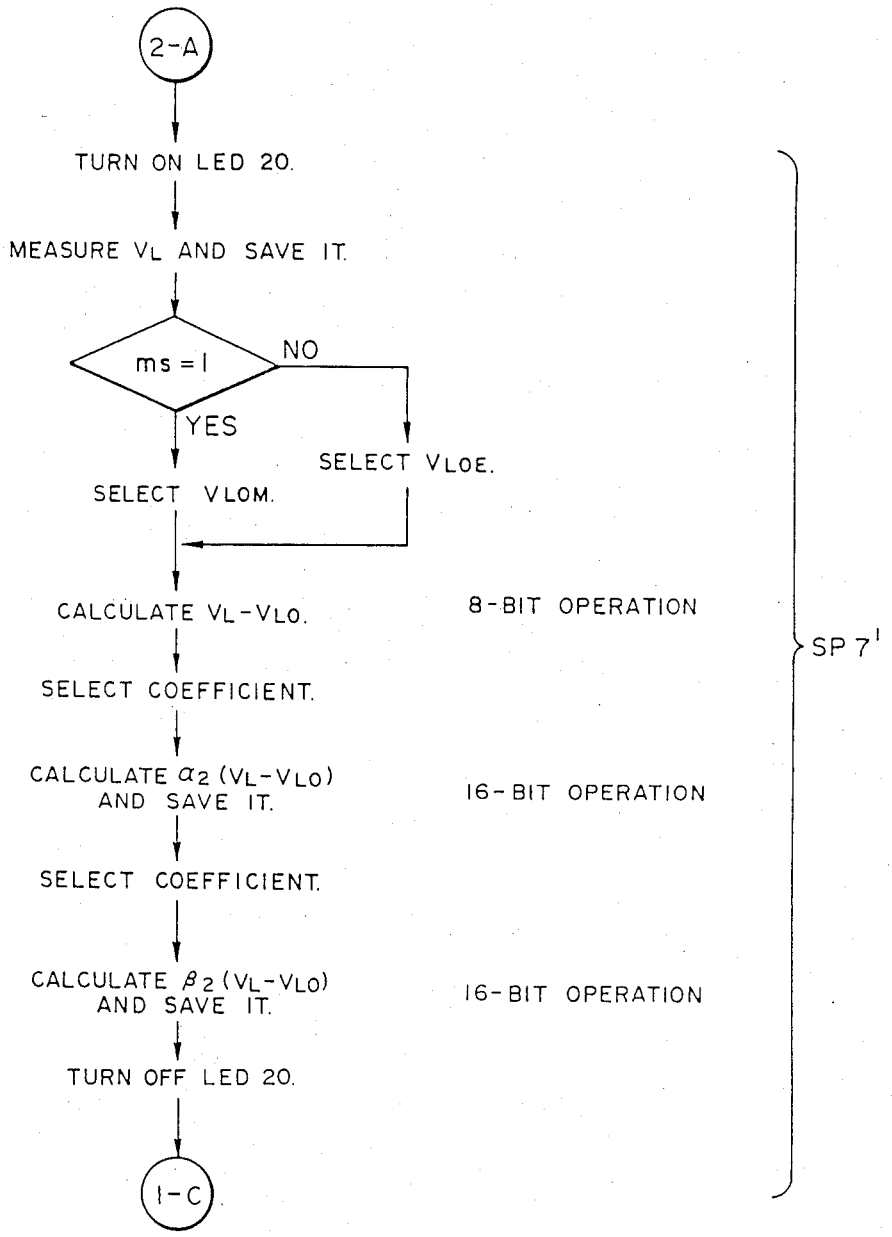
Figures 2, 9B:
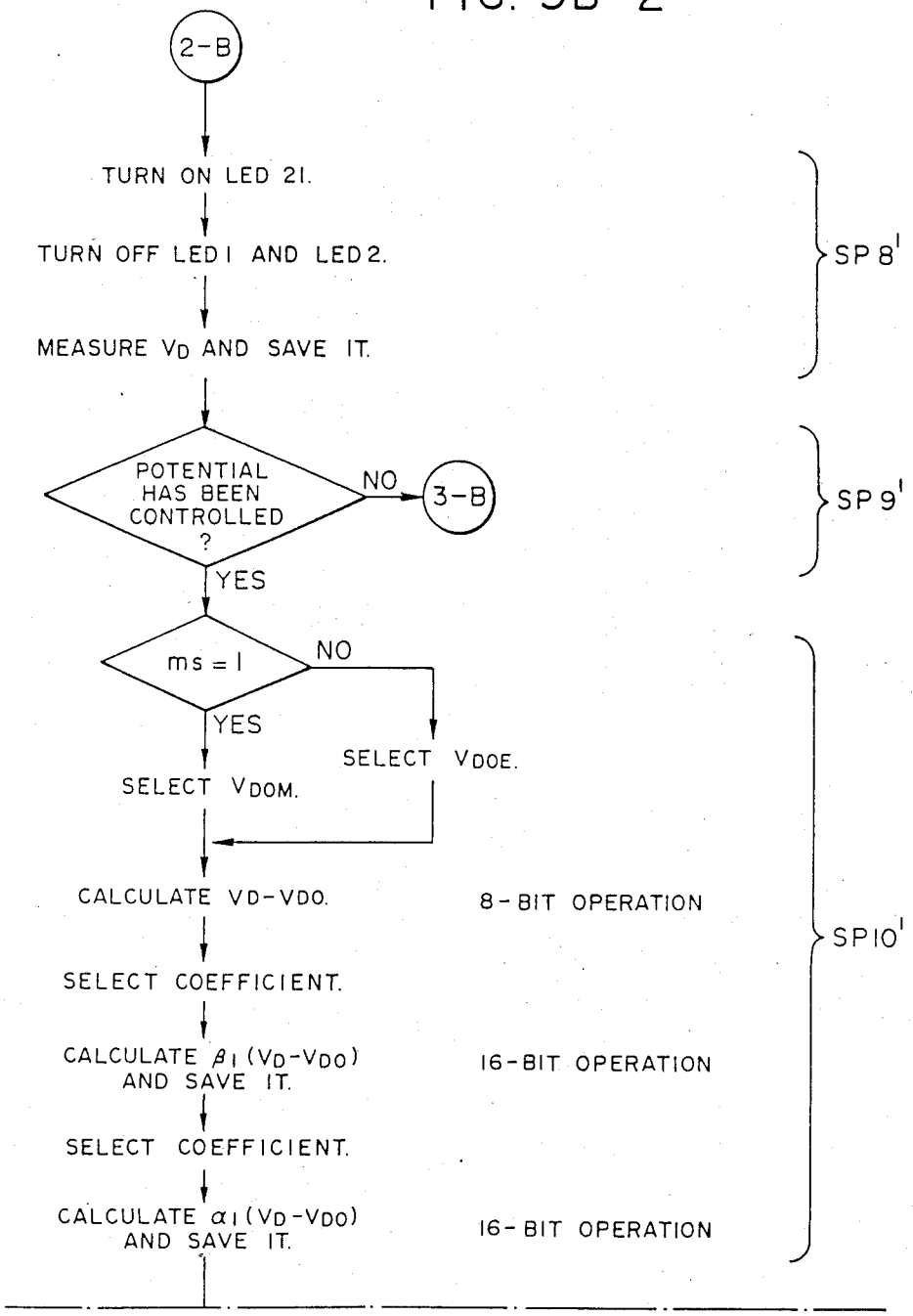
Figures 3, 9B:
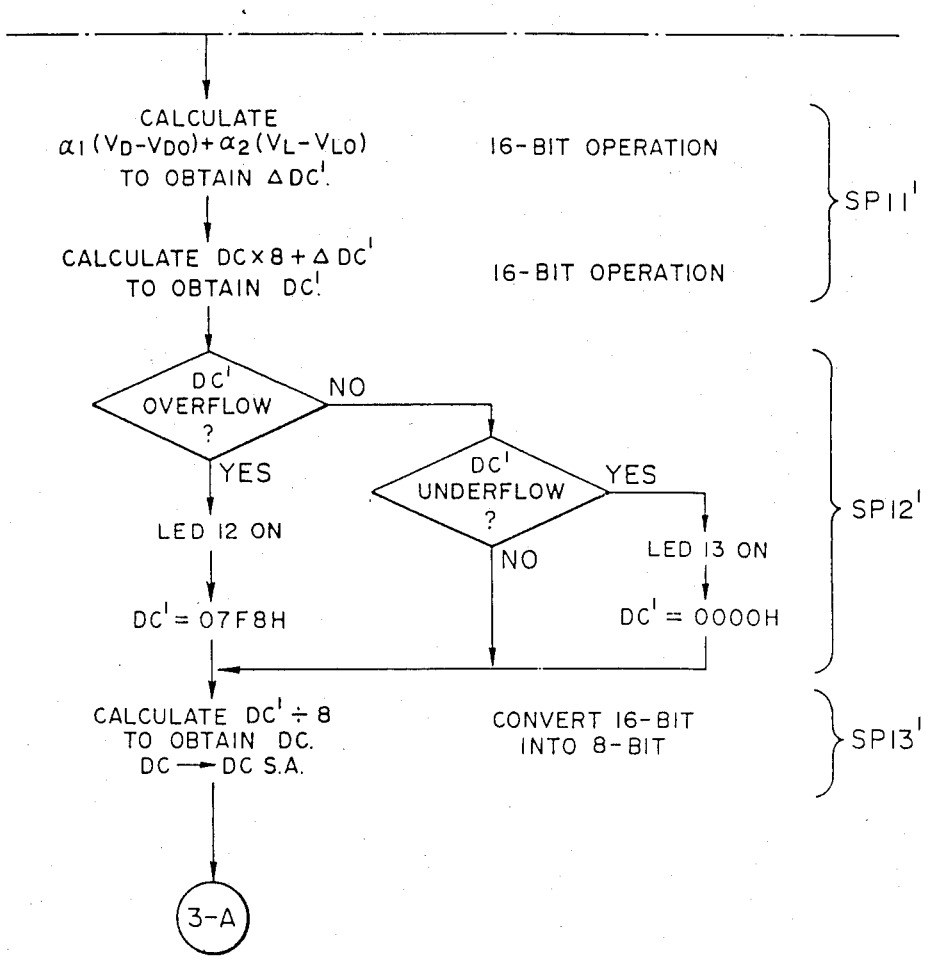
Figures 1, 9C:
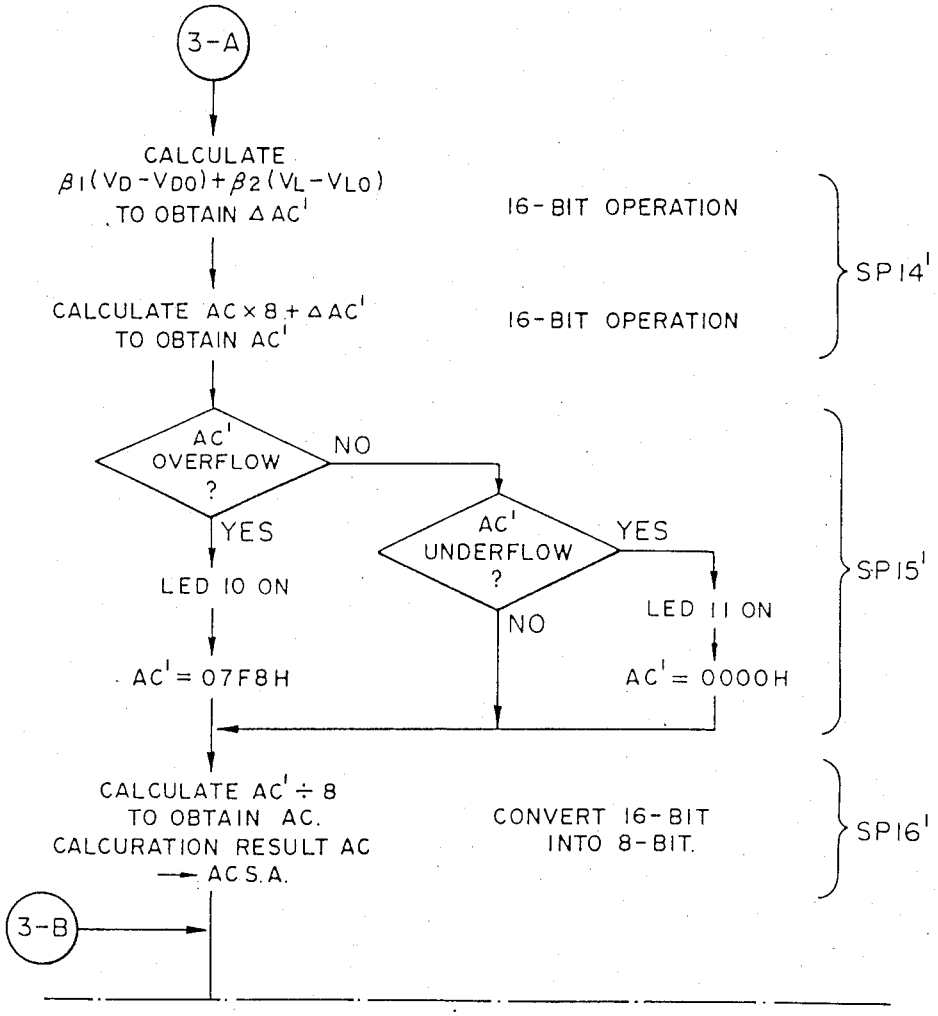
Figures 2, 9C:
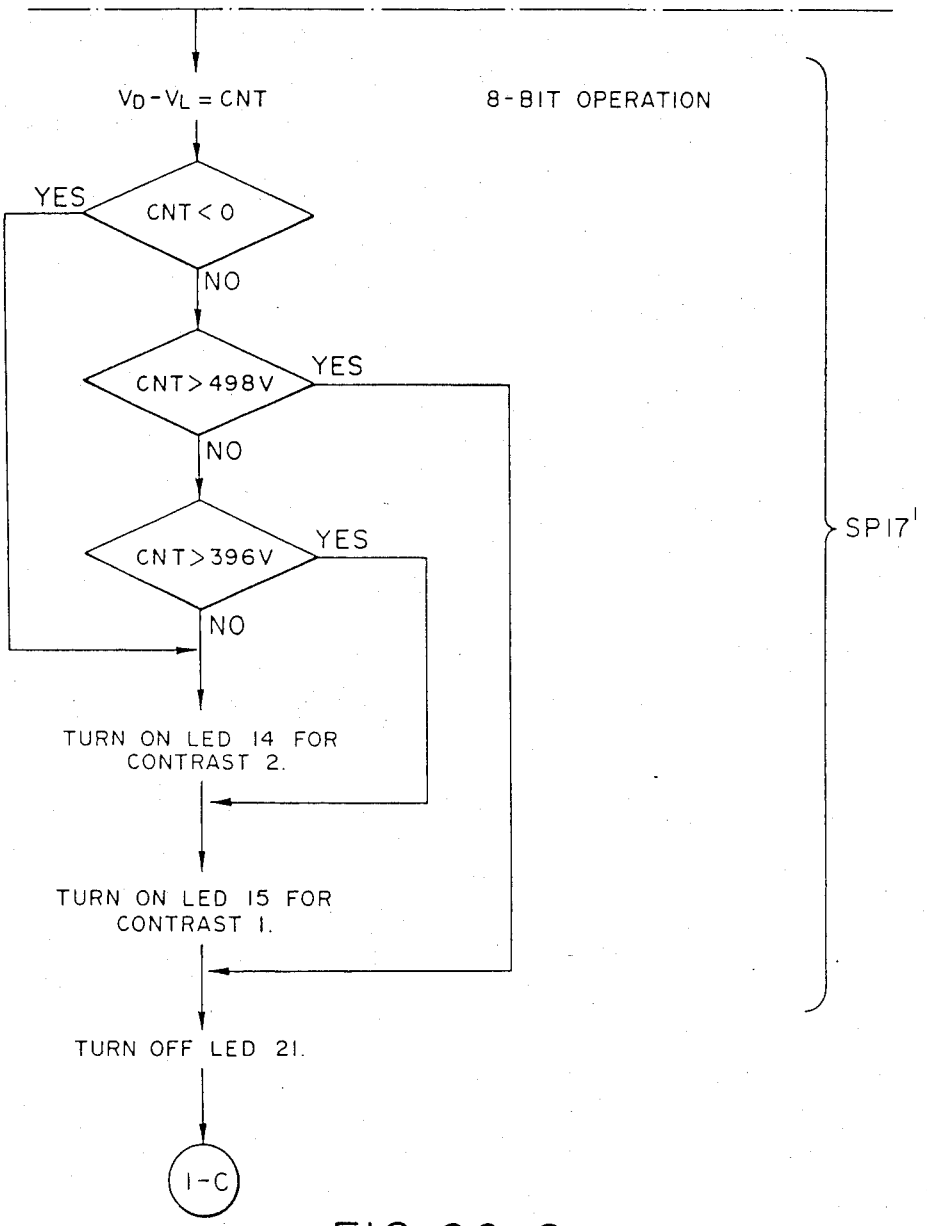
Figures 1, 9D:
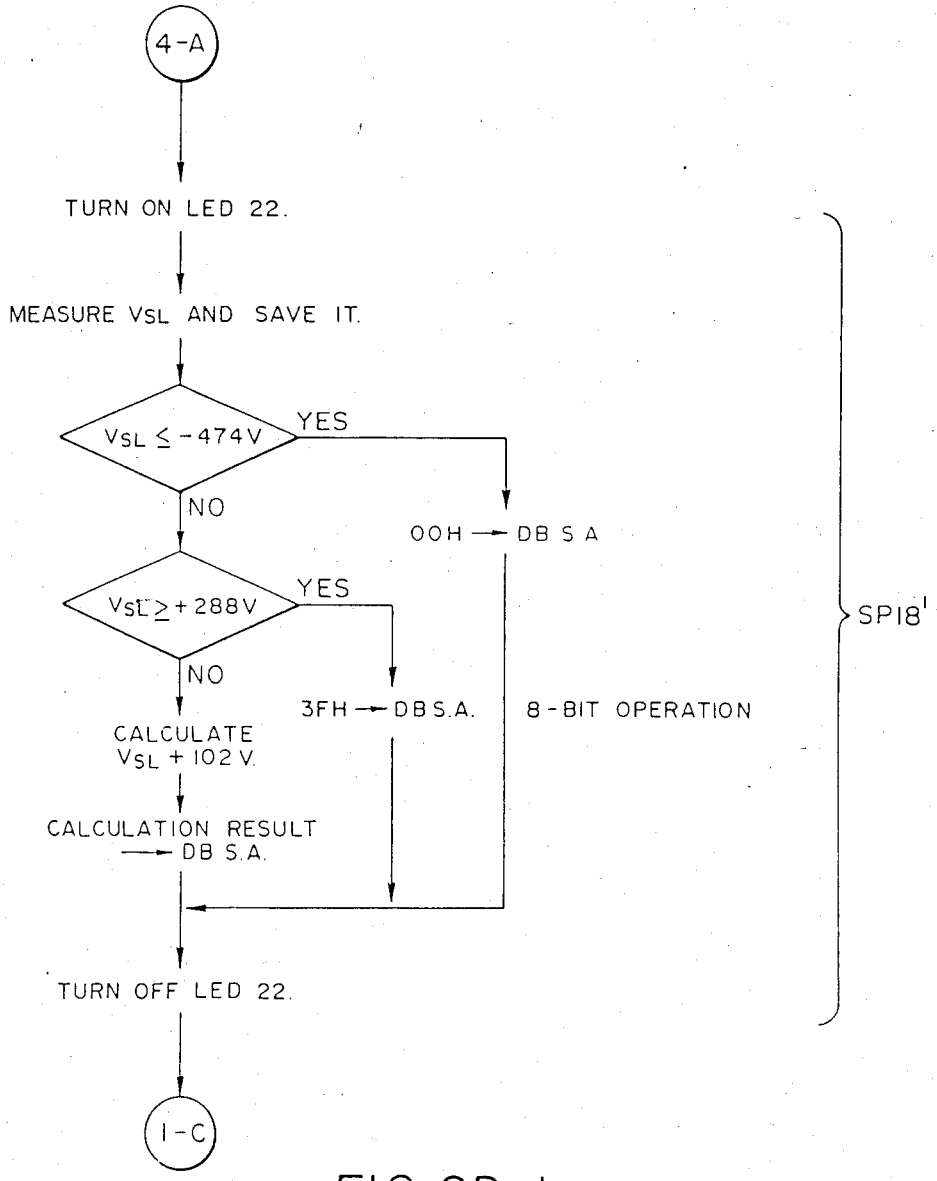
Figures 2, 9D:
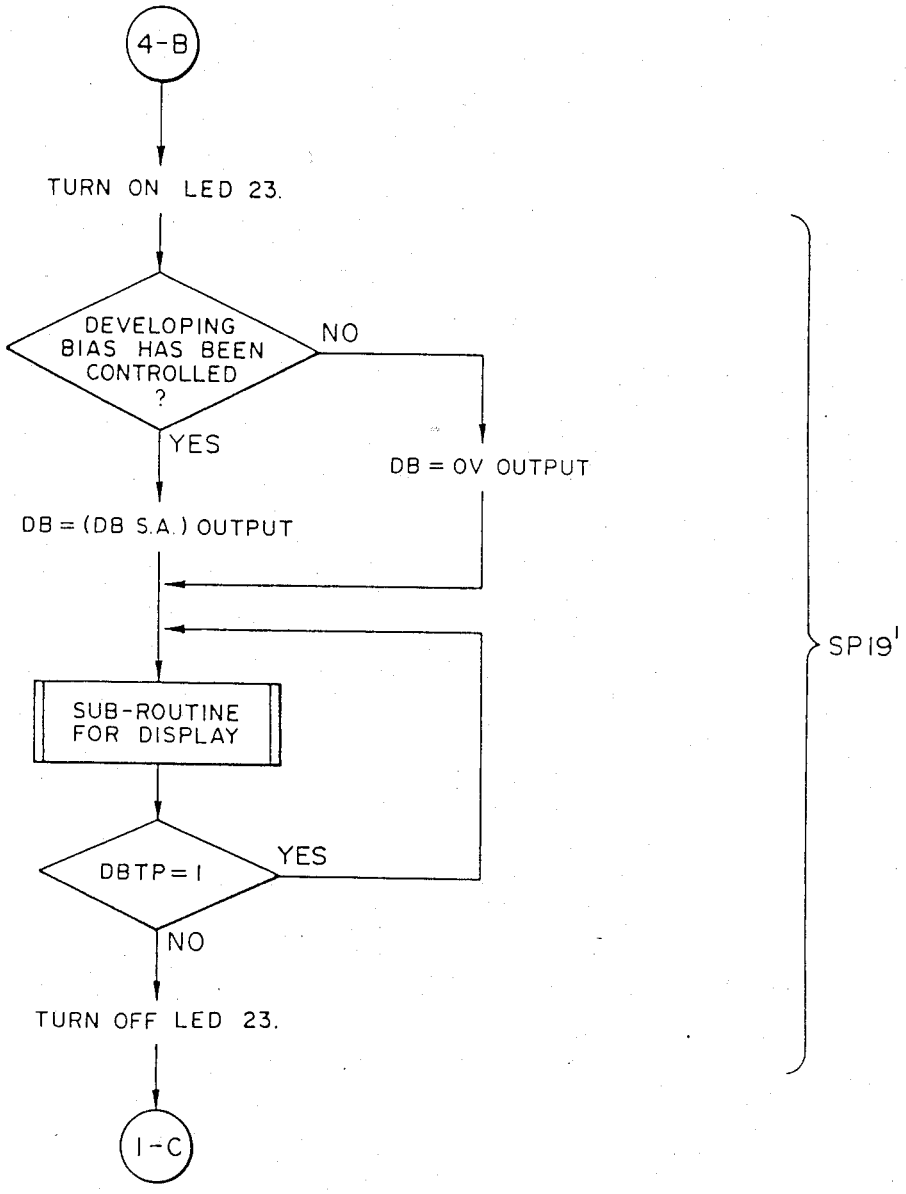
Figures 1, 9E:
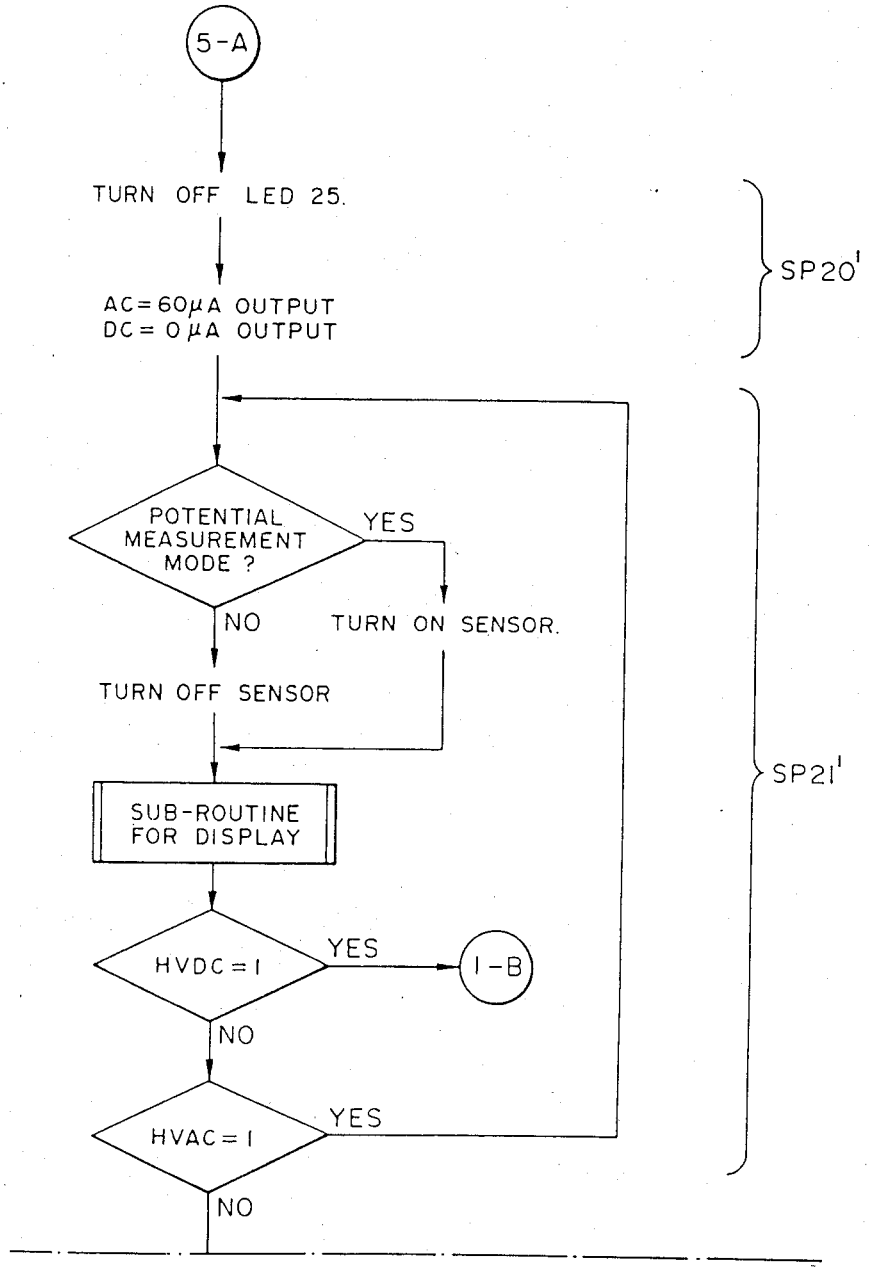
Figures 2, 9E:
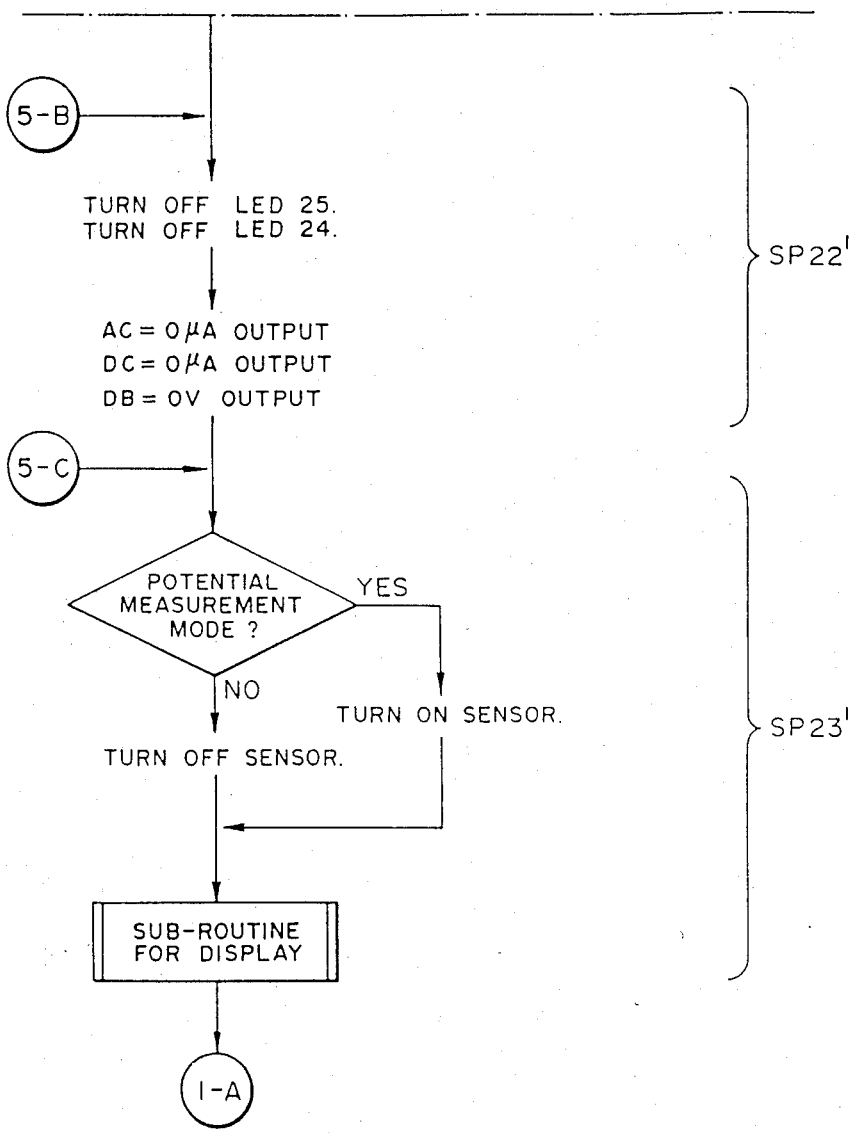

FIG. 8 shows the second embodiment of the potential control unit circuit according to the present invention. Same as in FIG. 5 embodiment, those parts having the same functions are designated by the same reference numerals and symbols.

In the drawing, KM' refers to a key matrix circuit which outputs a magnification signal ms by means of a magnification selection key (not shown). The magnification signal ms is input into both sequence control micro-computer CPU1' and potential control micro-computer CPU2'. When the magnification signal ms is at the level "H", the reproduction is done in a reduced scale. When it is at the level "L", the reproduction is done in a full scale. The CPU1' variably controls the rotational speed of the photosensitive drum 47 in accordance with the magnification signal ms. The CPU2' variably controls the target value of the potential control in accordance with the magnification signal.

Since the operations of the CPU1' have been well known, the explanations thereof are dispensed with. The control operations by the CPU2' are to execute the first control program of the first embodiment basically, hence the following detailed explanations will be given as to those different portions alone from the steps SP 0 to SP 23 in the first embodiment.

(Steps SP 1' through SP 6')

The step SP 1' is same as the step SP 0, while the steps SP 2' to SP 6' are identical with the steps SP 2 to SP 6.

(Step SP 7')

When the bright potential $V_L$ and the detection signal $V_L$CTP are output, the light emitting diode LED20 indicating the outputs is turned on. At the same time, the bright potential $V_L$ is measured, and the measured result is saved. Next, the target value for the bright potential $V_{LO}$ is established by observing the magnification signal ms which has been input into the terminal P26 of the CPU2. When the magnification signal ms is at the level "H", the target value is set in $V_{LOM}$, and, when the magnification signal ms is at the level "L", the target value is set in $V_{LOE}$.

Since, in this embodiment, the process speed increases at the time of the scale reduction, the dark potential is set at a higher level, and the bright potential is set at a lower level than at the time of the full scale reproduction. After the value $V_{LO}$ has been selected, the calculation for $(V_L-V_{LO})$ is effected, and the calculated result is saved. Next, the coefficient $\alpha_2$ is selected by the value CS2, based on which the calculation for $\alpha_2(V_L-V_{LO})$ is conducted, and the result is saved. In the same manner, the coefficient $\beta_2$ is selected, based on which the calculation for $\beta_2(V_L-V_{LO})$ is conducted, and the result is saved. Upon completion of the above process, the light emitting diode LED20 is turned off, and the program returns to the step SP 4'.

(Steps SP 8' and SP 9')

Same as the steps SP 8 and SP 9.

(Step SP 10')

The target value $V_{DO}$ for the dark potential is selected by the value of the magnification signal ms (when ms is at "H", $V_{DOM}$ is selected, and when ms is at "L", $V_{DOS}$), and the calculation for $(V_D-V_{DO})$ is performed, and the result is saved. In the same manner, the coefficients $\alpha_1$ and $\beta_1$ are selected, and the calculations for $\alpha_1(V_D-V_{DO})$ and $\beta_1(V_D-V_{DO})$ are performed, and the obtained results are saved. Then, the program proceeds to the step SP 11'. Incidentally, the values $V_{LOM}$, $V_{LOE}$, $V_{DOM}$, and $V_{DOE}$ are stored in the ROM same as the program.

What we claim is:

1. An image forming apparatus comprising:

(a) image forming means for forming an image on a recording member, said image forming means including means for forming the image with different magnifications, (b) a first control means for detecting an image formation condition and for controlling said image forming means based on the detected condition to form an adequate image, said first control means having a digital memory storing a plurality of control parameters for use in control of said image forming means, and (c) a second control means for controlling said first control means to provide a different control condition for said image forming means in accordance with the magnification, wherein said second control means selects a desired one among said plurality of control parameters in accordance with the magnification, and said first control means controls said image forming means in accordance with the detected image formation condition and the selected control parameter.

2. An image forming apparatus according to claim 1, wherein said first control means includes detecting means for detecting a surface condition of said recording member, said control parameters each being a target value of said surface condition, and said first control means controls the surface condition to converge on a predetermined target value in accordance with the output of said detecting means.

3. An image forming apparatus according to claim 2, wherein in accordance with the magnification, the target value for the surface condition to be converged is varied.

4. An image forming apparatus according to claim 2, wherein said surface condition is a surface potential.

5. An image forming apparatus according to claim 4, wherein said surface potential is a potential associated with a dark portion and a light portion.

* * * * *

UNITED STATES PATENT AND TRADEMARK OFFICE

CERTIFICATE OF CORRECTION

PATENT NO. : 4,618,246

DATED : October 21, 1986

INVENTOR(S) : NAO NAGASHIMA, ET AL.

It is certified that error appears in the above-identified patent and that said Letters Patent is hereby corrected as shown below:

AT [57] IN THE ABSTRACT

Line 1, "constracted" should be --constructed--.

COLUMN 2

Line 15, "other" should be --another--.
Line 25, "drawing" should be --drawings--.
Line 27, "DRAWING" should be --DRAWINGS--.

COLUMN 5

Line 7, "hencethe" should be --hence the--.
Line 60, add "and" after "ACo".

COLUMN 6

Line 15, "constant" should be --constants--.
Line 61, "shows" should be --shown--.

COLUMN 7

Line 58, "sourcegate" should be --source-gate--.

COLUMN 8

Line 11, "lowers" should be --lowered--.
Line 35, "upto" should be --up to--.

UNITED STATES PATENT AND TRADEMARK OFFICE

CERTIFICATE OF CORRECTION

PATENT NO. : 4,618,246

DATED : October 21, 1986

INVENTOR(S) : NAO NAGASHIMA, ET AL.

It is certified that error appears in the above-identified patent and that said Letters Patent is hereby corrected as shown below:

COLUMN 10

TABLE 2, under column "SW1", 2nd column, "DMS1" should be --DMSZ--.

COLUMN 11

Line 49, "establish" should be --established--.

COLUMN 13

Line 22, "constitute" should be --constitutes--.
Line 40, add "The" before "Same" and lower case "S".
Line 41, "limitter" should be --limiter--.

UNITED STATES PATENT AND TRADEMARK OFFICE

CERTIFICATE OF CORRECTION

PATENT NO. : 4,618,246

DATED : October 21, 1986

INVENTOR(S) : NAO NAGASHIMA, ET AL.

It is certified that error appears in the above-identified patent and that said Letters Patent is hereby corrected as shown below:

COLUMN 14

Line 7, "abovemention" should be --abovementioned--.

COLUMN 19

Line 66, "illustrate" should be --illustrates--.

Signed and Sealed this

Twenty-fourth Day of February, 1987

*Attest:*

DONALD J. QUIGG

*Attesting Officer* *Commissioner of Patents and Trademarks*